US011078698B2

(12) United States Patent
Lang et al.

(10) Patent No.: US 11,078,698 B2
(45) Date of Patent: Aug. 3, 2021

(54) NON-PLANAR CLOSED-LOOP HINGE MECHANISM WITH ROLLING-CONTACT HINGE

(71) Applicant: BRIGHAM YOUNG UNIVERSITY, Provo, UT (US)

(72) Inventors: Robert J. Lang, Alamo, CA (US); Larry L. Howell, Orem, UT (US); Spencer P. Magleby, Provo, UT (US); Todd G. Nelson, Provo, UT (US)

(73) Assignee: Brigham Young University, Provo, UT (US)

( * ) Notice: Subject to any disclaimer, the term of this patent is extended or adjusted under 35 U.S.C. 154(b) by 563 days.

(21) Appl. No.: 15/422,195

(22) Filed: Feb. 1, 2017

(65) Prior Publication Data

US 2017/0219007 A1 Aug. 3, 2017

Related U.S. Application Data

(60) Provisional application No. 62/289,817, filed on Feb. 1, 2016.

(51) Int. Cl.
*E05D 3/10* (2006.01)
*E05D 1/00* (2006.01)
(Continued)

(52) U.S. Cl.
CPC ..... *E05D 3/10* (2013.01); *E05D 1/00* (2013.01); *E05D 1/02* (2013.01); *E05D 1/04* (2013.01);
(Continued)

(58) Field of Classification Search
CPC .... E05D 3/10; E05D 3/14; E05D 1/00; E05D 1/02; E05D 1/04; E05D 3/04; E05D 3/06;
(Continued)

(56) References Cited

U.S. PATENT DOCUMENTS 726,787 A * 4/1903 Turner ..... A47B 3/083 108/173
927,773 A * 7/1909 Buel ..... A47B 3/083 108/173
(Continued)

FOREIGN PATENT DOCUMENTS

CN 102436939 B 10/2014
GB 2189290 A * 10/1987 ..... E04B 2/7429

OTHER PUBLICATIONS

Cai, "Kinematic Analysis of Foldable Plate Structures with Rolling Joints", Journal of Mechanisms and Robotics, vol. 8, Jun. 2016, 6 pages.
(Continued)

*Primary Examiner* — William L Miller
(74) *Attorney, Agent, or Firm* — Brake Hughes Bellermann LLP

(57) ABSTRACT

A hinged mechanism includes: panels; and hinges connecting respective pairs of the panels to each other in a closed loop so that the hinged mechanism is non-planar, wherein at least one of the hinges is a rolling-contact hinge. All of the hinges can be rolling-contact hinges. The closed-loop hinged mechanism can comprise at least four hinges, each of the at least four hinges being a sole connection between a respective adjacent pair of the panels. A cross section of rolling surfaces of the rolling-contact hinge can be circular. A cross section of rolling surfaces of the rolling-contact hinge can be non-circular.

22 Claims, 33 Drawing Sheets

(51) Int. Cl.

| | |
|---|---|
| *E05D 1/02* | (2006.01) |
| *E05D 3/12* | (2006.01) |
| *E05D 3/02* | (2006.01) |
| *E05D 3/04* | (2006.01) |
| *E05D 3/06* | (2006.01) |
| *E05D 1/04* | (2006.01) |

(52) U.S. Cl.
CPC ..... *E05D 3/04* (2013.01); *E05D 3/06* (2013.01); *E05D 3/122* (2013.01); *E05D 2003/025* (2013.01); *Y10T 16/5474* (2015.01)

(58) Field of Classification Search
CPC ... E05D 3/122; E05D 2003/025; F16C 11/04; Y10T 16/5472; Y10T 16/5476; Y10T 16/525; Y10T 16/53824; Y10T 16/53833; Y10T 16/53843; Y10T 16/53864; Y10T 16/5257; E04B 1/344; A63F 9/088; A63F 9/0869; B65D 7/26; A47B 3/083; A47B 2003/0835
USPC ..... 16/367, 370, 225, 282, 288, 294, 302, 16/227; 403/53, 121; 52/81.2, 81.1; 273/155; 220/6; 108/166, 63
See application file for complete search history.

(56) References Cited

U.S. PATENT DOCUMENTS

| | | | | | |
|---|---|---|---|---|---|
| 2,184,976 | A * | 12/1939 | McFall | A47B 1/04 | 108/63 |
| 2,292,292 | A * | 8/1942 | Romeyn | A47B 3/083 | 108/166 |
| 2,560,089 | A * | 7/1951 | Cottingham | A01K 97/20 | 220/7 |
| 2,604,932 | A * | 7/1952 | Leggett | A47B 3/00 | 108/174 |
| 2,634,183 | A * | 4/1953 | Derman | A47B 1/02 | 108/90 |
| 2,654,647 | A * | 10/1953 | Murray | A47B 3/083 | 108/173 |
| 2,767,066 | A * | 10/1956 | Zimmerman, Jr. | B01J 8/0207 | 422/218 |
| 3,303,797 | A * | 2/1967 | Mueller | A47B 3/083 | 108/63 |
| 3,488,098 | A | 1/1970 | Sobczak et al. | | |
| 3,696,683 | A | 10/1972 | Preben et al. | | |
| 3,730,007 | A | 5/1973 | Wellington et al. | | |
| 3,779,176 | A * | 12/1973 | Piretti | A47B 3/00 | 108/166 |
| 3,850,043 | A | 11/1974 | Tarbox et al. | | |
| 3,927,438 | A | 12/1975 | Blake et al. | | |
| 3,932,045 | A | 1/1976 | Hillberry et al. | | |
| 3,945,053 | A | 3/1976 | Hillberry et al. | | |
| 4,267,608 | A * | 5/1981 | Bora, Jr. | A61F 2/3836 | 403/111 |
| 4,558,911 | A | 12/1985 | Ruoff et al. | | |
| 4,780,344 | A | 10/1988 | Hoberman et al. | | |
| 4,809,619 | A * | 3/1989 | Piretti | A47B 3/00 | 108/115 |
| 4,821,373 | A * | 4/1989 | Maidment | E05D 1/00 | 16/227 |
| 4,843,679 | A | 7/1989 | Smith et al. | | |
| 4,973,291 | A | 11/1990 | Mottate et al. | | |
| 4,981,732 | A | 1/1991 | Hoberman et al. | | |
| 5,088,419 | A * | 2/1992 | Hartwell | A47B 3/083 | 108/166 |
| 5,146,803 | A | 9/1992 | Juang et al. | | |
| 5,593,351 | A | 1/1997 | Culp et al. | | |
| 6,082,056 | A * | 7/2000 | Hoberman | A63F 9/088 | 52/109 |
| 7,125,015 | B2 * | 10/2006 | Hoberman | A63F 9/0869 | 273/153 S |
| 7,328,481 | B2 | 2/2008 | Barnett | | |
| 7,515,385 | B1 | 4/2009 | Abrahamson et al. | | |
| 8,151,414 | B2 | 4/2012 | Baudasse et al. | | |
| 8,308,801 | B2 | 11/2012 | Halverson et al. | | |
| 10,070,718 | B2 * | 9/2018 | Tao | A47B 3/0803 | |
| 2003/0097801 | A1 * | 5/2003 | Hoberman | E04B 1/3441 | 52/3 |
| 2006/0075940 | A1 * | 4/2006 | Dodge | A47B 1/03 | 108/86 |
| 2010/0139531 | A1 * | 6/2010 | Valeriote | A47B 13/003 | 108/90 |
| 2014/0052265 | A1 | 2/2014 | Slocum et al. | | |
| 2014/0238876 | A1 | 8/2014 | Chen et al. | | |
| 2018/0049336 | A1 * | 2/2018 | Manuel | E05B 65/0067 | |

OTHER PUBLICATIONS

Cannon, et al., "Compliant Rolling-Contact Element Mechanisms", ASME 2005 International Design Engineering Technical Conferences and Computers and Information in Engineering Conference, 2005, pp. 3-13.
Chen, et al., "Origami of Thick Panels", Science, vol. 349, Issue 6246,, Jul. 24, 2015, pp. 396-400.
Collins, et al., "Kinematics of Robot Fingers with Circular Rolling Contact Joints", Journal of Robotics Systems, vol. 20, Issue 6, Jun. 2003, pp. 285-296.
Edmondson, et al., "An Offset Panel Technique for Thick Rigidily Foldable Origami", In ASME 2014 International Design Engineering Technical Conferences and Computers and Information in Engineering Conference, 2014.
Francis, et al., "From Crease Pattern to Product: Considerations to Engineering Origami-Adapted Designs", In ASME International Design Engineering Technical Conferences and Computers and Information in Engineering Conference, 2014, 15 pages.
Gray, "Modern Differential Geometry of Curves and Surfaces with Mathematica", CRC Press., 1998.
Ku, et al., "Folding Flat Crease Patterns with Thick Materials", Journal of Mechanisms and Robotics, vol. 8, Jun. 2016, 6 pages.
Lang, "Single-Degree-of-Freedom Rigidly Foldable Cut Origami Flashers", Journal of Mechanisms and Robotics, vol. 8, Jun. 2016, 15 pages.
Miura, et al., "2-D Array experiment on board Space Flyer Unit", Solar Power Review, vol. 5,, 1985, pp. 345-356.
Miura, "The Science of Miura-Ori: A Review", Origami 4, 2009, pp. 87-99.
Tachi, et al., "Rigid Foldable Thick Origami", Origami 6,, 2011, pp. 253-264.
Trautz, et al., "Deployable Folded Plate Structures—Folding Patterns Based on 4-Fold-Mechanism Using Stiff Plates", Proceedings of the International Association for Shell and Spatial Structures, 2009, pp. 2306-2317.
You, et al., "Expandable Tubes with Negative Poisson's Ratio and their Applications in Medicine", Origami 4,, 2009, pp. 117-128.
Zirbel, et al., "Accommodating Thickness in Origami-Based Deployable Arrays", Journal of Mechanical Design, vol. 135, Issue 11,, 2013, pp. 111005.
Miura, "Propositon of Pseudo-Cylindrical Concave Polyhedral Shells", Institute of Space and Aeronautical Science, University of Tokyo, Report No. 442, Nov. 1969, 23 pages.

* cited by examiner

NON-PLANAR CLOSED-LOOP HINGE MECHANISM WITH ROLLING-CONTACT HINGE

CROSS-REFERENCE TO RELATED APPLICATION

This application claims the benefit of the filing date of U.S. provisional application 62/289,817, filed Feb. 1, 2016 and entitled "FOLDING RIGID-PANEL MECHANISMS," the contents of which are incorporated herein by reference.

STATEMENT REGARDING FEDERALLY SPONSORED RESEARCH OR DEVELOPMENT

This invention was made with government support under Grant Number 1240417 awarded by the National Science Foundation and the Air Force Office of Scientific Research, and under Grant Number 1247046 awarded by the National Science Foundation. The government has certain rights in the invention.

TECHNICAL FIELD

This document relates, generally, to a non-planar closed-loop mechanism having at least one rolling-contact hinge.

BACKGROUND

Origami-inspired, origami-adapted, and origami-applied mechanisms have been used to realize a wide variety of deployable forms, ranging from space-based solar arrays to arterial stents to backpacks. While the applications are quite diverse, most folding-based engineering designs begin with a concept that is fundamentally a zero-thickness mathematical model and then transform it so that it can be realized with non-zero thickness materials.

An origami mechanism—often represented by folded paper and often prototyped in paper—consists of facets, usually flexible and of negligible thickness, connected by folds, where the intended motion occurs. When translated into an engineering application, the facets are replaced by panels, which are commonly rigid and whose thickness is non-negligible. The folds that connect facets are replaced by hinges, which replicate the folding motion of the underlying origami mechanism, typically pure revolution motion about an axis that is at the position of the fold.

When the panels are rigid, the underlying origami mechanism should be rigidly foldable, meaning that facets of the fold pattern remain planar throughout the range of motion; all motion takes place along the hinges. While many zero-thickness origami mechanisms are theoretically rigidly foldable, e.g., the Miura-ori and Yoshimura pattern, the introduction of non-negligible thickness into the model commonly breaks the kinematic behavior associated with the zero-thickness mechanisms.

SUMMARY

In an aspect, a hinged mechanism includes: panels; and hinges connecting respective pairs of the panels to each other in a closed loop so that the hinged mechanism is non-planar, wherein at least one of the hinges is a rolling-contact hinge.

Implementations can include any or all of the following features. All of the hinges can be rolling-contact hinges. The hinged mechanism can comprise at least four hinges, each of the at least four hinges being a sole connection between a respective adjacent pair of the panels. A cross section of rolling surfaces of the rolling-contact hinge can be circular. A cross section of rolling surfaces of the rolling-contact hinge can be non-circular. The hinges can provide a range of motion for the hinged mechanism, wherein at a position within the range of motion the panels are disposed substantially within a single plane without overlapping. The position can correspond to a deployed state. The hinges can provide a range of motion for the hinged mechanism, and at a position within the range of motion the panels are stacked parallel to each other. The position can correspond to a stowed state. The rolling-contact hinge can further comprise bands that hold rolling surfaces of the rolling-contact hinge to each other. The rolling-contact hinge can further comprise a spring that holds rolling surfaces of the rolling-contact hinge to each other. The rolling-contact hinge can further comprise gears that hold rolling surfaces of the rolling-contact hinge to each other. The rolling-contact hinge can further comprise a frame that holds rolling surfaces of the rolling-contact hinge to each other. The rolling-contact hinge can further comprise slots slidingly engaged by a mechanism to hold rolling surfaces of the rolling-contact hinge to each other. Another of the hinges can have an axis of rotation associated with a corresponding pair of panels associated with the other hinge, and a position of the axis of rotation is fixed relative to each of the pair of panels throughout a range of motion of the other hinge. The rolling-contact hinge can have an axis of rotation associated with the pair of panels associated with the rolling-contact hinge, and a position of the axis of rotation comprises a fixed position plus a motion-varying offset of each of the pair of panels in a direction that is perpendicular to the axis of rotation. The closed-loop hinged mechanism can form a symmetric vertex. The symmetric vertex can be a symmetric bird's-foot vertex. The hinged mechanism can form an asymmetric vertex. The asymmetric vertex can be an asymmetric bird's-foot vertex. The rolling-contact hinge can have rolling surfaces, and the rolling-contact hinge is configured so that the rolling surfaces remain in contact with each other without substantial slippage throughout a range of motion of the hinged mechanism.

DETAILED DESCRIPTION

Figure 1B:
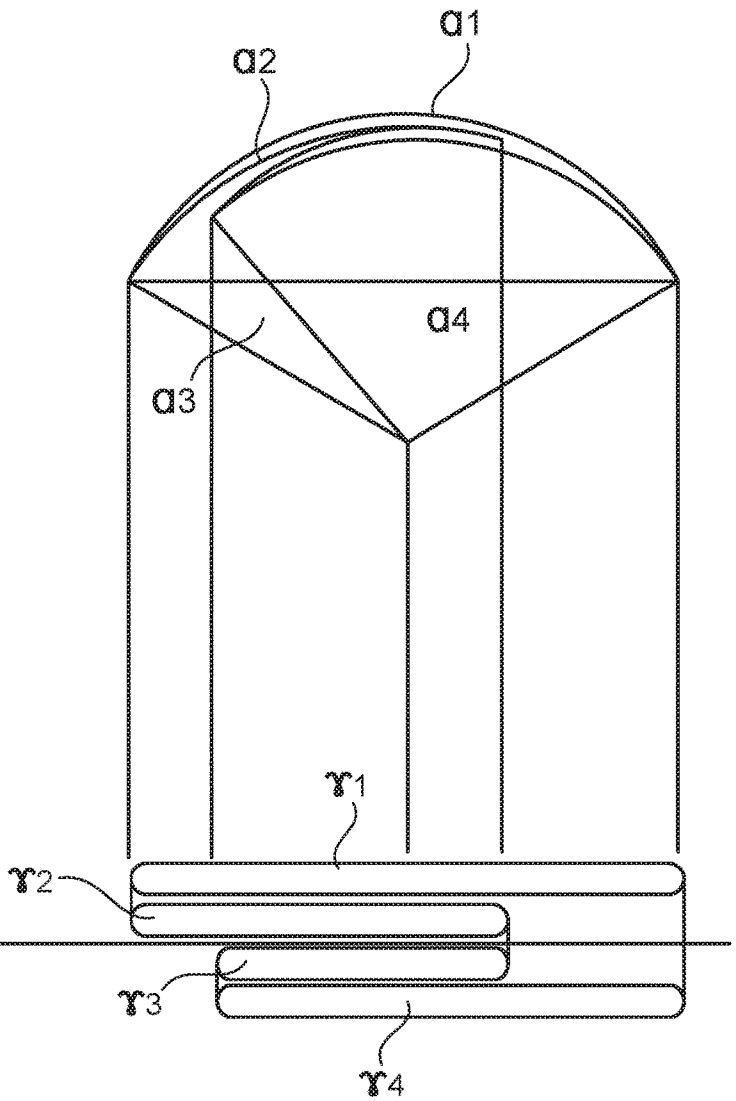
FIGS. 1A-B show an example of a thick degree-4 vertex with sector angles and fold angles.

This document describes examples of closed-loop mechanisms having at least one rolling-contact hinge. A general technique is presented for achieving kinematic single-degree-of-freedom origami-based mechanisms with thick rigid panels using synchronized offset rolling contact elements. The document presents general design analysis for planar and 3D relative motions between panels and shows physically realized examples. The technique overcomes many of the limitations of previous approaches for thick rigidly foldable mechanisms.

The following relates to some terminology. A panel can be considered to be a rigid body. In some implementations, a panel can be approximately planar, having two dimensions that are much larger than a third dimension. See, for example, illustrations of panels in some of the present drawings. In some illustrations herein, the panels have main surfaces that are essentially planar, and edge surfaces that are not completely planar (e.g., they may be a curved surface). This can be a result of a manufacturing process and need not be by design. Rather, in some implementations, both the main surfaces and the side (edge) surfaces of a panel can be substantially planar.

A generalized hinge can be considered to be a mechanism disposed between two panels that permits the panels to rotate with respect to each other about a common axis of rotation with a single degree-of-freedom motion. The axis of rotation can move relative to either or both panels over the range of motion.

A pure revolute hinge can be considered to be a generalized hinge in which the position of the axis of rotation relative to either panel is fixed in the frame of the panel throughout the range of motion.

A hinged mechanism can be considered to be a mechanism that contains a plurality of panels joined pairwise by a plurality of generalized hinges.

A closed-loop mechanism can be considered to be a hinged mechanism in which the pairwise connections between panels and generalized hinges form a closed loop containing at least four hinges, and all four hinges are actuated during at least some part of the mechanism motion. A closed-loop mechanism is therefore one that contains at least one interior vertex.

A planar closed-loop mechanism is one in which said axes of rotation are all oriented in the same direction. A non-planar closed-loop mechanism is one in which the axes of rotation are not all oriented in the same direction.

A rolling-contact hinge is a type of generalized hinge in which there is a rolling surface on each panel. The rolling surface can be formed on, or solidly attached to, the panel, to name just two examples. The rolling surfaces remain in contact with one another throughout the range of motion without substantial slippage or sliding. In some implementations, Slippage can be quantified relative to the amount of travel in the single degree-of-freedom of the rolling-contact hinge. For example, no more than 1% of slippage can occur. As another example, no more than 5% of slippage can occur. The surface of a rolling-contact hinge can be smooth, or structured, like gear teeth, or structured in another way that is different from a smooth surface. Again, in an implementation without substantial slippage, the rolling surfaces should not slide significantly relative to each other during the motion. The rolling surface of a rolling-contact hinge has a cross section that can be circular, or non-circular.

Some implementations based on the present disclosure can overcome a fundamental problem with thick rigidly foldable mechanisms, namely that if one simply "thickens" the panels of a zero-thickness mechanism, one almost immediately runs into problems with mechanical interference between pairs of panels. Indeed, for mechanisms that fold flat (highly desirable for deployable structures), in the flat folded state, all of the panels would be coplanar (and thus, may be mutually interfering) in the stowed (flat-folded) state.

This issue has led to significant study of thick rigidly foldable mechanisms in recent years, and, in particular, of ways of adapting zero-thickness mechanisms so that they use nonzero-thickness panels but still exhibit the desirable motion of the zero-thickness form. There are now several distinct techniques for creating origami mechanisms from thick materials.

The simplest and most straightforward technique to avoid mechanical interference is to offset the fold hinges to top and bottom surfaces of the panels (placing valley folds on top, mountain folds on the bottom). This works perfectly well for linear chains of panels, but once one introduces one or more interior vertices (vertices entirely surrounded by panels) into the fold pattern, most such vertices (with a few exceptions) become bistable, existing only in the flat and fully-folded state, but with no unstrained motion between them. To achieve kinematic motions, several improved approaches have been developed:

The following relates to offset hinges (OH). Hoberman demonstrated a version of the Miura-ori based on laterally offsetting hinges in a way that preserves kinematic behavior across the range of motion. However, this technique was only applicable to the symmetric bird's-foot vertex used in the Miura-ori fold pattern. More recently, Chen et al. showed a technique that generalizes the concept of vertically displacing hinges relative to the unfolded state and preserving kinematic behavior by careful choice of sector angles and panel thicknesses at each vertex. She enumerated the possible vertex configurations for degree-4, -5, and -6 vertices. A challenge for this approach is that only a limited set of vertices support such mechanisms: for degree-4 vertices, for example, only those vertices with sector angles of the form ($\alpha$, 90°, 180°, $-\alpha$, 90°) are allowed. Furthermore, in all of these examples, the relative hinge offsets (and thus relative panel thicknesses) are fully specified and dependent upon the specific sector angles; one cannot choose desired offsets arbitrarily.

The following relates to sliding hinges (SH). Trautz et al. showed sliding hinges that did generalize to various folding mechanisms. The ability to slide panels laterally relative to one another can introduce sufficient degrees of freedom to accommodate offsetting the hinges to top and bottom surfaces. A challenge with this approach is that it introduces multiple degrees of freedom, and the amount of required sliding accumulates in complex ways that can still lead to mechanical interferences.

The following relates to doubled hinges (DH). Hoberman also described a technique in which several of the hinges are split into two parallel or near-parallel hinges, which allows an entirely planar unfolded state and introduces offsets that allow panels to stack side-by-side in the folded form. This technique was generalized by Ku et al., who described how to modify an arbitrary fold pattern to accommodate arbitrary offsets via such hinge-doubling. A challenge of this approach is that because the number of folds is increased at each vertex, in general, in an intermediate state (between fully unfolded and fully flatly folded), there are extra degrees of freedom in the mechanism motion, and even with the extra degrees of freedom, there is not yet a guarantee of a continuous path in phase space from the unfolded to fully folded state for all possible arrangements of vertices.

The following relates to embedded zero-thickness surface (EZTS). Tachi showed that for arbitrary rigidly foldable zero-thickness origami mechanisms, one can create a thick rigidly foldable mechanism that preserves the kinematics of the zero-thickness model by embedding the zero-thickness model within the thick panels and locating the axes of the hinges at the positions of the folds of the zero-thickness model. For some mechanisms, some of the hinges can be located on top and bottom surfaces of the unfolded panels, while others should tilt diagonally from top to bottom and, usually, material is trimmed away near the hinges. A challenge with this approach is that there can remain mechanical interferences to be dealt with, especially for fold angles close to ±180°.

The following relates to offset panels (OP). Edmonson et al. showed an approach that allows rigidly foldable motion and parallel stacking of panels in which the panels can be arbitrarily independently offset from one another, so long as the hinges (though not the panels) remain located at their positions in the zero-thickness model. Challenges of this approach are that many configurations require through-holes in non-adjacent panels to allow hinges to penetrate to the zero-thickness surface; the offsets can impart high stresses on hinges; and in the unfolded state, the fixed offsets give rise to a nonplanar surface.

The following relates to membrane hinges (MH). Zirbel et al. showed a technique for realizing thick origami mechanisms by introducing finite-width compliant membrane hinges that allowed for both flexing and incorporation of offsets between adjacent panels. A challenge of this approach is that the required hinge width is difficult to predict a priori, and the extra compliance of the membrane hinges can give rise to unpredictable degrees of freedom.

In this work, a new concept for thick rigidly foldable mechanisms is described: the Synchronized-Offset Rolling-Contact Element (SORCE), along with a corresponding technique for designing thick rigidly foldable origami mechanisms that combines advantages of many of these techniques and avoids many of the disadvantages. With reference to the above terminology, a SORCE mechanism can be considered to be a closed-loop hinged mechanism in which at least one of the generalized hinges in the mechanism is a rolling-contact hinge. Beginning from a rigidly foldable zero-thickness model, one can design a mechanism that can:

- accommodate panels of arbitrary thickness
- begin with a planar unfolded state
- end with side-by-side parallel stacked panels in the fully folded state, and
- preserve the kinematic motion of the zero-thickness model, including single-DOF motion.

One can accomplish these goals by using rolling contacts, albeit ones designed to incorporate specific offsets between the panels in the fully folded state. The panel offsets vary as the mechanism transitions between the unfolded and folded state, and the relative rates of offset are synchronized between adjacent panels by the shapes of the contacting surfaces. Rolling contacts are, of course, well known in mechanical engineering—they are the basis of bearing joints. Most rolling contacts have involved circular or spherical cross sections, though more specialized configurations have been developed. The present disclosure will show that it is possible to design rolling contact surfaces that give the precise offsets needed to realize thick rigidly foldable origami patterns. Furthermore, for certain configurations, it is possible to implement the rolling contacts as CORE (COmpliant Rolling-contact Element) joints, giving rise to complex thick-panel origami mechanisms that are monolithic and fully compliant, with all flexing remaining in the elastic domain. The present disclosure presents the basic concept; develops equations that allow one to design SORCE joints for arbitrary vertices and networks of panels and vertices; and presents multiple realized examples for individual vertices. The present disclosure ends by discussing avenues for future development.

The following relates to a concept. Consider an origami mechanism based on a zero-thickness model where one wishes to replace the individual zero-thickness facets with non-negligible thickness panels in such a way that

- The motion of the panels approximates the motion of the facets in the zero-thickness model as it flexes from the unfolded state to the fully folded state (which, for purposes of discussion, will be taken to be flat-folded);
- During the motion, the panels are shifted from their zero-thickness positions so as to avoid mechanical interferences throughout the range of motion.

The offset panel technique of Edmonson et al. accomplishes these goals by enabling the designer to independently specify fixed offsets for each panel in the flat-folded state, thereby ensuring that arbitrary thickness panels may be accommodated. Each panel is offset perpendicularly relative to its zero-thickness position. However, those offsets are fixed throughout the range of motion, so that in the unfolded state, they are also present. Thus, the panels are offset relative to one another in the unfolded state and do not lie in a common plane, which is often a desirable goal.

Ideally, in the unfolded state, all of the panels would be precisely aligned with their zero-thickness corresponding facets, with zero offset. In the flat-folded state, one wants a nonzero offset, as illustrated in FIGS. 1A-B, which shows a representative degree-4 vertex in unfolded and flat-folded configurations.

Figure 1A:
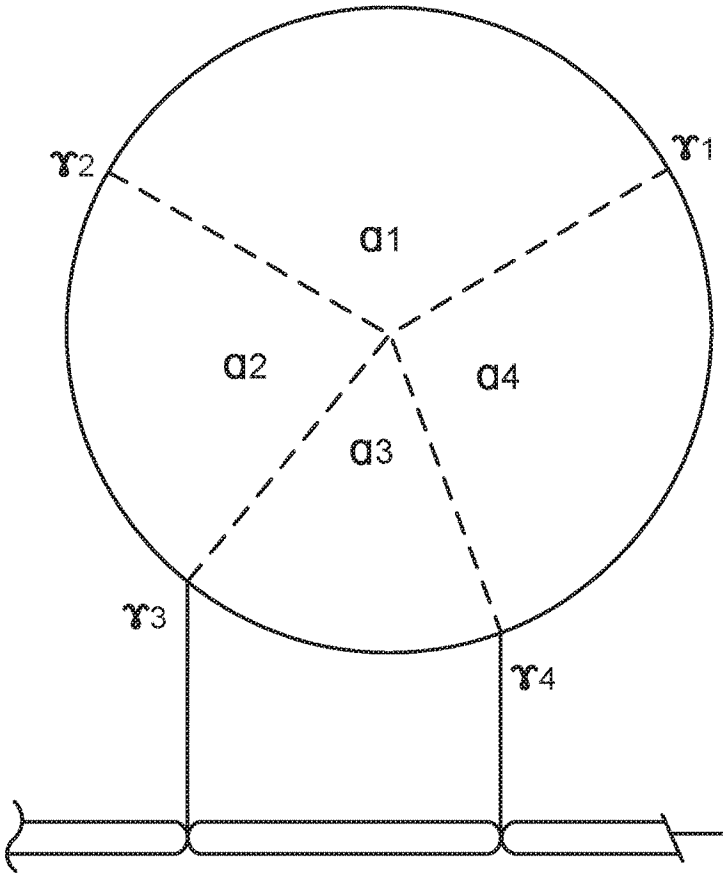

FIGS. 1A-B show an example of a thick degree-4 vertex with sector angles $\alpha_1$ to $\alpha_4$ and fold angles $\gamma_1$ to $\gamma_4$. FIG. 1A shows the unfolded state, for which all panels are coplanar with zero offset. FIG. 1B shows the flat-folded state, for which the four panels should be offset from their zero-thickness position.

In the flat-folded state (FIG. 1B), the panels are essentially parallel to each other and stacked on each other. This vertex is an example of a non-planar hinged mechanism. As mentioned, a non-planar hinged mechanism is a mechanism consisting of a plurality of rigid bodies connected by generalized hinges in which the axes of the hinges do not all point in the same direction. For example, the fold angles $\gamma_1$ to $\gamma_4$ here indicate that the axes of the hinges of this vertex do not all point in the same direction.

A common form of a non-planar hinged mechanism is a spherical mechanism, which is an existing mechanism in which the axes of the generalized hinges all point toward a single common point, which is the center of the hinge. In general, spherical mechanisms are characterized by the property that the axes are fixed relative to each rigid body in the frame of that rigid body, and so thus, the intersection point of all of the axes is also fixed relative to each rigid body in the frame of the rigid body. Because the axes of rolling-contact hinges are not fixed relative to their respective rigid bodies, rolling-contact hinges are less suitable for use in spherical mechanisms, unless practiced according to the present disclosure. For example, a hinged mechanism of four linkages connected in a loop at their respective ends, can have conical rolling contacts.

There are also several known non-planar mechanisms that are not spherical mechanisms. These mechanisms are based on pure revolute hinges, and rely on the property that the axes of rotation are fixed relative to each rigid body in the frame of the rigid body. Because the axes of rolling-contact hinges are not fixed relative to their respective rigid bodies, rolling-contact hinges are generally unsuitable for use in spherical mechanisms, unless practiced according to the present invention.

In addition, there are combinations of rigid bodies and generalized hinges that are non-planar and are not flexible when practiced with pure revolute hinges. When practiced according to the teachings of the present disclosure, additional flexibility may be added to these linkages beyond what would be obtained without the present disclosure.

Let us parameterize the desired motion on a variable $t \in [0, 1]$, where t=0 is the unfolded state, t=1 is the fully-folded state. Variable t is an arbitrary parameter, but throughout this analysis it will be treated it as if it were a time variable describing the temporal evolution of the folding motion.

Figure 2:
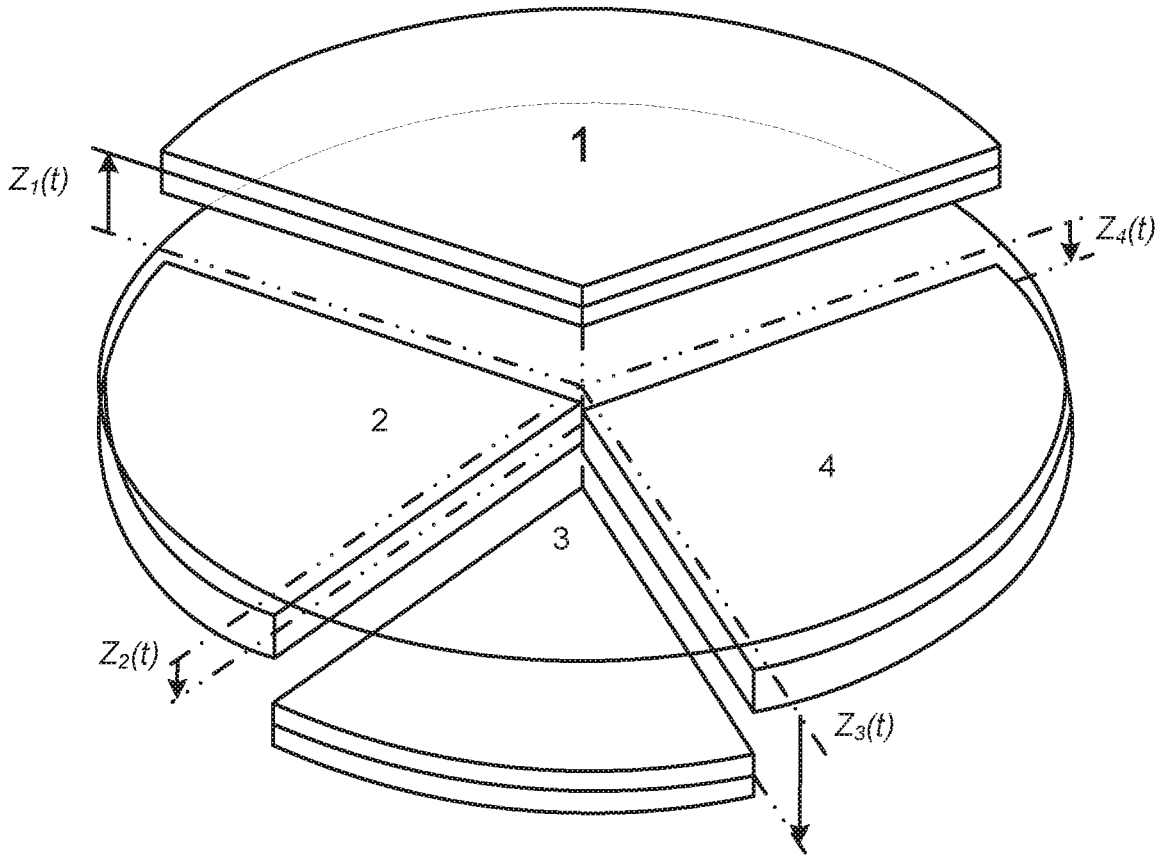
FIG. 2 shows an example of offset panels in a degree-4 vertex.

If one had total control over the panel motion, then one would ideally like to assign each ith panel an offset function $z_i(t):[0, 1] \rightarrow R$ that varies continuously over the range of motion, as illustrated in FIG. 2. The offset function describes the perpendicular offset of the panel from the position of its zero-thickness facet at time t.

FIG. 2 shows an example of offset panels in a degree-4 vertex. Each panel is offset perpendicularly to its zero-thickness facet by an amount $z_i(t)$, where t parameterizes the state of folding.

At the flat state, t=0, one would have $z_i(0)=0$, no offset, for each i. At the fully folded state, t=1, one would have each $z_i(1)$ equal to some nonzero value that allows the panels to stack without interference. Each $z_i(t)$ would vary continuously (perhaps smoothly, perhaps monotonically) between those two values across the range of folding motion.

The fold angles, too, can be parameterized; for the jth fold of the zero-thickness model, the present disclosure describes its fold angle by some function $\gamma_j(t):[0,1] \rightarrow [0,\pm\pi]$, that parameterizes the fold angle on t. For flat-foldable vertices, one will have $\gamma_j(1)=\pm\pi$; for non-flat-foldable vertices, the final values will be some other, but definite, angle.

Figure 3A:
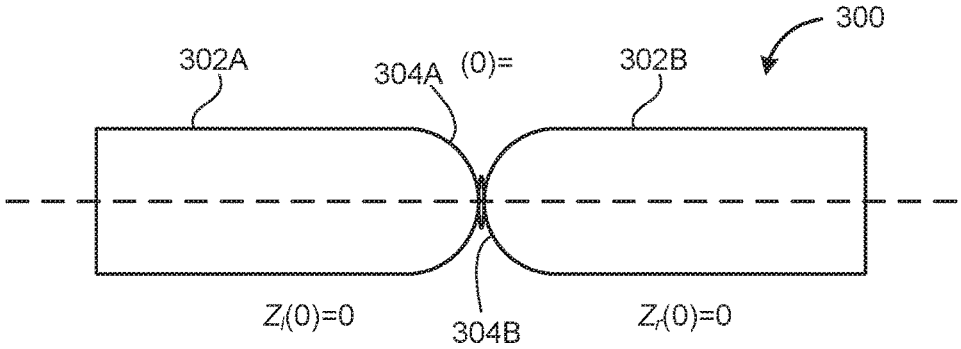
FIGS. 3A-C show an example of three positions of a variable-offset joint, viewed in a plane perpendicular to the axis of rotation.
Figure 3B:
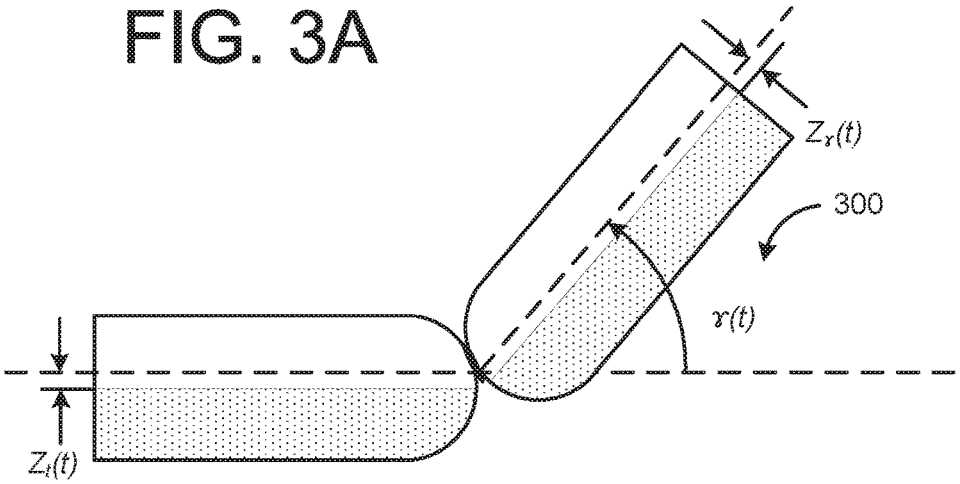
Figure 3C:
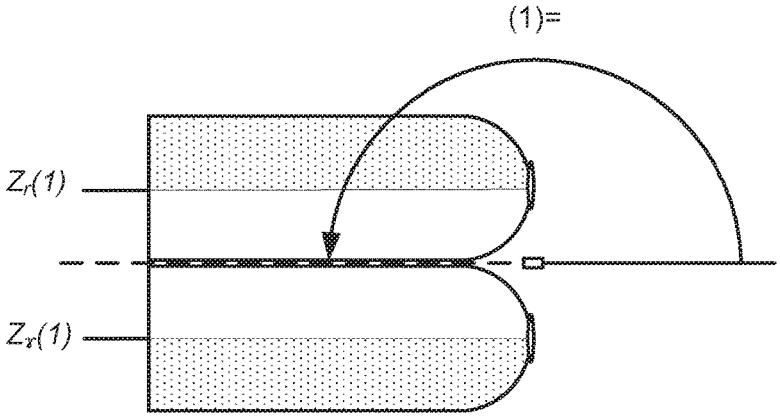

Consider now a plane that is perpendicular to one of the axes of the zero-thickness model and to the two panels adjacent to that axis, such as the cut-plane used in FIGS. 3A-C. Since the panel offsets are pure translation relative to the zero-thickness facets, any point in either panel that lies within the plane in the unfolded state should stay within that plane throughout the full range of motion. In addition, the fold angle between the two adjacent panels is the same as the fold angle between the corresponding two zero-thickness facets, i.e., $\gamma_j(t)$. Thus, the complete desired motion of the two panels relative to the zero-thickness model, and more importantly, relative to each other, can be fully described by three parametric functions: the fold angle $\gamma_j(t)$ between the panels and the two offset functions $z_i(t)$ of the panels on either side of the joint. For a general joint and perpendicular plane, the present disclosure will denote the offset function on the left by $z_l(t)$ and the one on the right by $z_r(t)$, as illustrated in FIGS. 3A-C.

FIGS. 3A-C show examples of three positions of a variable-offset joint 300, viewed in a plane perpendicular to the axis of rotation. The joint 300 includes panels 302A and 302B. Panels 302A has a rolling surface 304A, and the panel 302B has a rolling surface 304B. Each of the rolling surfaces 304A-B has a cross section that is circular. FIG. 3A shows t=0, where the joint is unfolded. FIG. 3B shows an intermediate t, where the rotations and offsets are characterized by $(\gamma_j(t),z_l(t),z_r(t))$. FIG. 3C shows the fully flat-folded state. Both panels are offset relative to their zero-thickness facets, whose positions are indicated by the dotted lines in all three subfigures.

Note that $z_i(t)$ is a signed value that gives the offset relative to the zero-thickness facet in the facet's local coordinate system. In the flat-folded form, half of the facets are flipped upside down, and so their local coordinate systems have a local z-axis that points downward. Thus, for example, if one defines the local coordinate system so that in FIG. 3A, up is positive, then in FIG. 3C, the local z axis for the left panel points up, while the local z axis for the right panel points down. Thus, in FIG. 3C, $z_l(1)$ and $z_r(1)$ are both negative.

The offsets $z_l(t)$ and $z_r(t)$ are the desired perpendicular offsets of the panels from their corresponding zero-thickness facets. If one is given a particular rotational mechanism, though, the values of $z_l(t)$ and $z_r(t)$ will be determined by the mechanism itself. The position of the right panel relative to the left is some combination of rotation (described by $\gamma(t)$) and translation; the translation can be described by appropriate choice of $z_l(t)$ and $z_r(t)$.

Figure 4A:
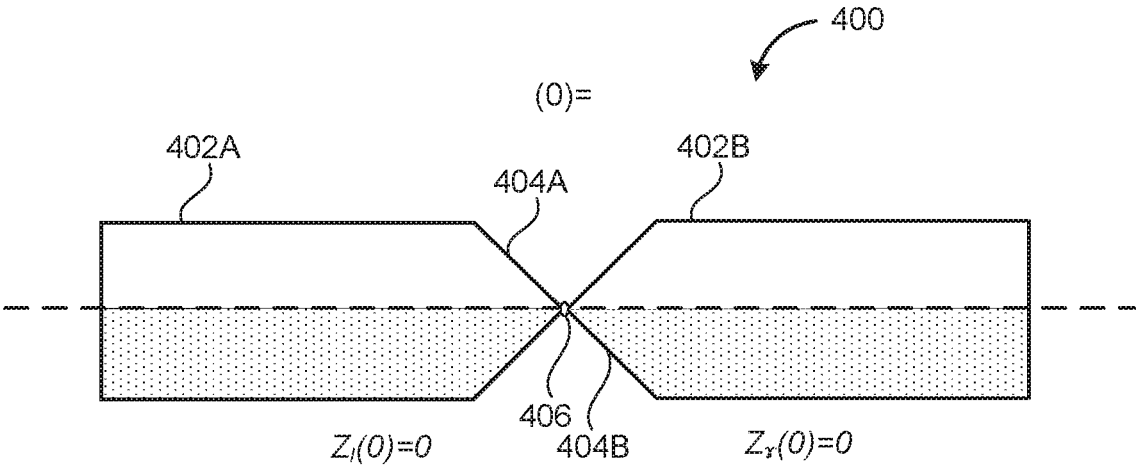
FIGS. 4A-B show an example of two positions of a pure revolute joint, viewed in a plane perpendicular to the axis of rotation.
Figure 4B:
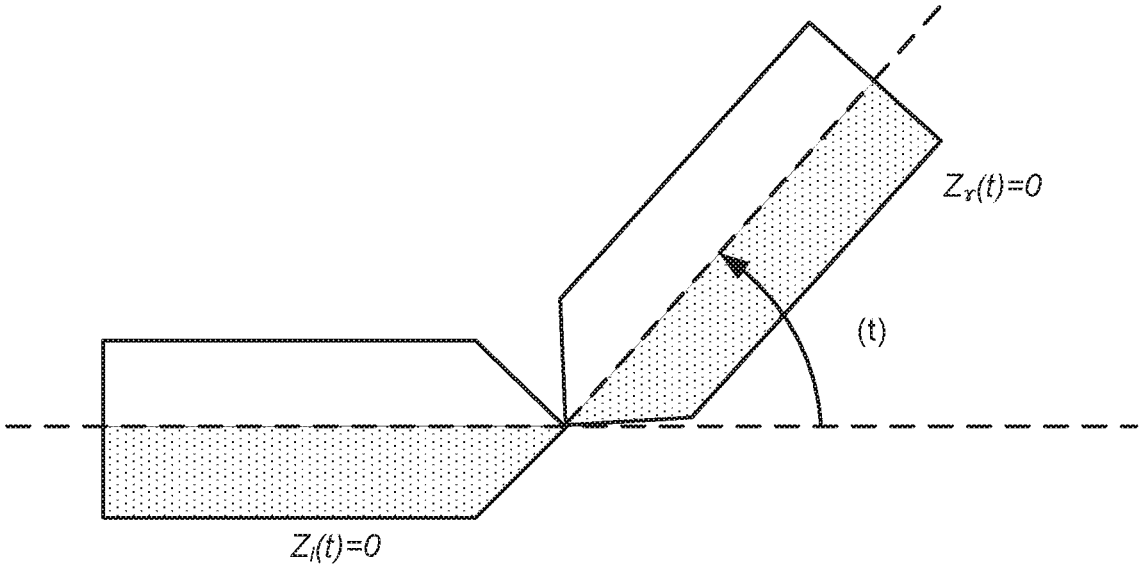

The simplest mechanism to analyze is a pure revolute joint 400, as illustrated in FIG. 4A-B. The joint 400 includes panels 402A and 402B. Panel 402A has a surface 404A, and the panel 402B has a surface 404B. Each of the surfaces 404A-B has a cross section that is non-circular, namely, in this example, a corner shape. In this case, the offsets are both identically zero for all t; both panels remain centered on the zero-thickness facets throughout the range of motion. FIGS. 4A-B show an example of two positions of a pure revolute joint, viewed in a plane perpendicular to the axis of rotation. FIG. 4A shows t=0, where the joint is unfolded. FIG. 4B shows an intermediate t where the rotation angle is $\gamma(t)$; the offsets are $z_l(t)=z_r(t)=0$. The zero-thickness facets' positions are indicated by the dotted lines. An axis of rotation 406 is marked. The axis 406 is associated with the panels 402A-B. For example, the axis 406 marks the rotation of the panel 402B during the range of motion of the joint 400. The position of the axis 406 is fixed relative to each of the panels 402A-B throughout the range of motion.

Clearly, then, pure revolute joints do not work for a mechanism where one wants the offsets to take on nonzero values over the range of motion. Fortunately, there are other forms of joint that can provide perpendicular panel offset along with rotation, and one of them will now be examined.

The following relates to circular CORE joints. In a previous work, Cannon et al. introduced the COmpliant Rolling-contact Element mechanism, or CORE mechanism, which is based on the older notion of no-slip rolling contacts in which the non-slip condition is typically enforced by gear teeth. A circular rolling-contact joint has two circular contacts that roll against one another without slipping, and in such joints, the instantaneous center of rotation of the two surfaces varies with the motion of the joint. The kinematics of circular rolling contact joints have been analyzed by, e.g., Collins; more recently Cai noted that circular rolling contacts are suited to certain classes of folded plate structure. The following examines whether a circular rolling-contact joint could provide the combination of rotation and relative offsets that would enable a thick rigid panel origami mechanism.

Figure 5:
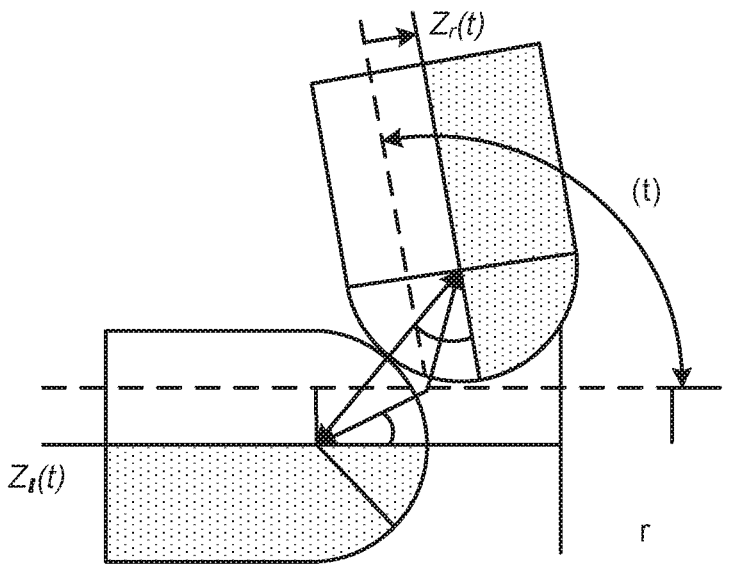
FIG. 5 shows an example of geometry of a circular rolling contact between two contacts with circular cross section.

FIG. 5 shows the configuration of two circular rolling contacts in an intermediate state, along with some additional construction lines.

It is clear from the geometry that the relative motions of the two circular rolling contact panels can be characterized by the three functions ($\gamma_j(t)$, $z_l(t)$, $z_r(t)$), and one can solve for them. If one chooses the parameterization $\gamma(t)$ as $$\gamma(t)=\pi t, \tag{1}$$

then the two offset functions are given by $$z_l(t) = z_r(t) = -r\tan\frac{\gamma(t)}{4} = -r\tan\frac{\pi}{4}t, \tag{2}$$

where r is the radius of curvature of the circular edge of each panel.

Equation (2) has the conceptual form one is after: the offsets are 0 at t=0 and go to constant nonzero values at t=1. However, in this particular case, they both go to the same value, $$z_l(1) = z_r(1) = -r\tan\frac{\pi}{4} = -r. \tag{3}$$

That is insufficient variability to construct a general thick rigidly foldable vertex from such joints, let alone a network of vertices. Look again at FIGS. 1A-C. If one takes d to be the common thickness of the four panels, then for the flat-folded configuration shown on the right, one should have $$z_1(1) = z_4(1) = -\frac{3}{2}d, \quad z_2(1) = z_3(1) = +\frac{1}{2}d. \tag{4}$$

Instead of circular cross section, one could pick various other cross-sectional shapes, e.g., ellipses, hyperbolas, etc., and see what form of offset functions $z_i(t)$ one winds up with, but even that is unlikely to prove fruitful. Equation (2) shows that the offset function depends directly upon the parameterized angle $\gamma(t)$. Since each sector angle is bounded by two different folds that will, in general, have two different angle parameterizations, it would be unlikely for both joints to give rise to the same offset function for their common panel.

Instead, what one would like to do is choose the offset function $z_i(t)$ for each panel, then solve for the joint configuration that gives rise to the desired offset functions at all times t; in effect, one wishes to find contact surfaces that synchronize all of the offset functions $\{z_i(t)\}$ to one's desired values.

Figure 6A:
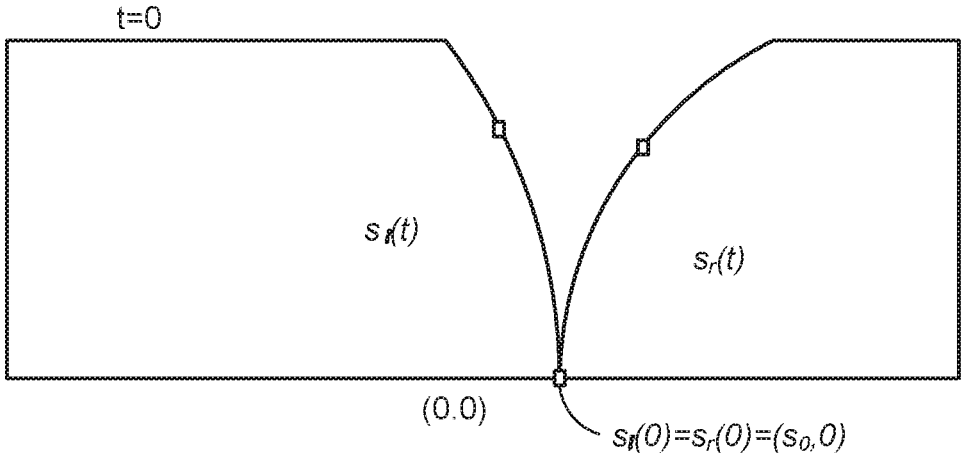
FIGS. 6A-C show an example of geometry of a general rolling contact between two surfaces.
Figure 6B:
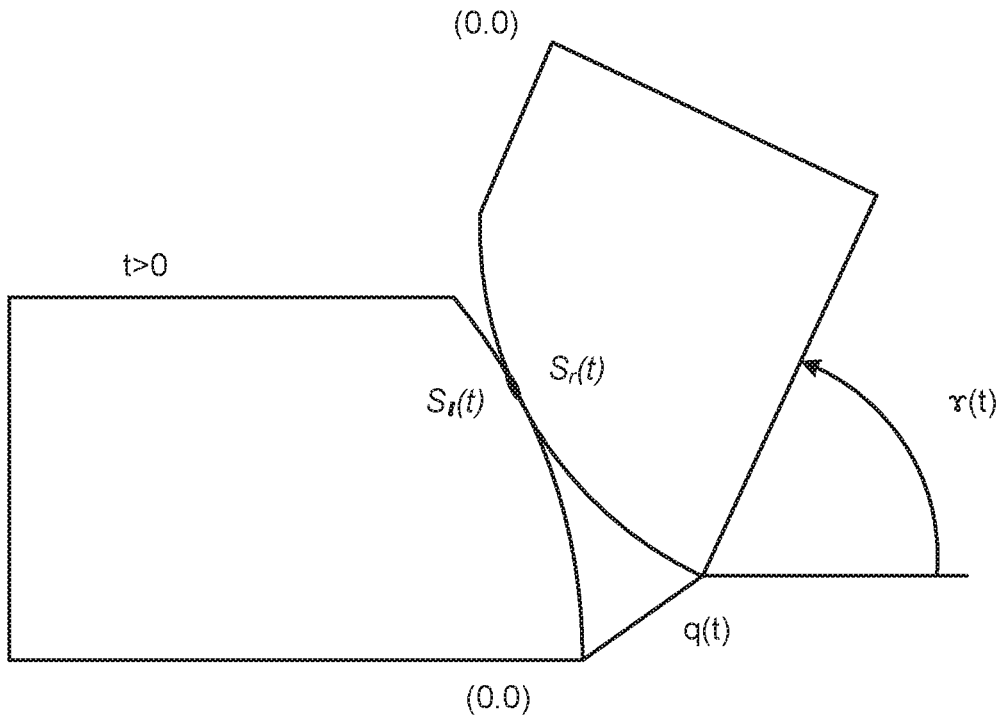
Figure 6C:
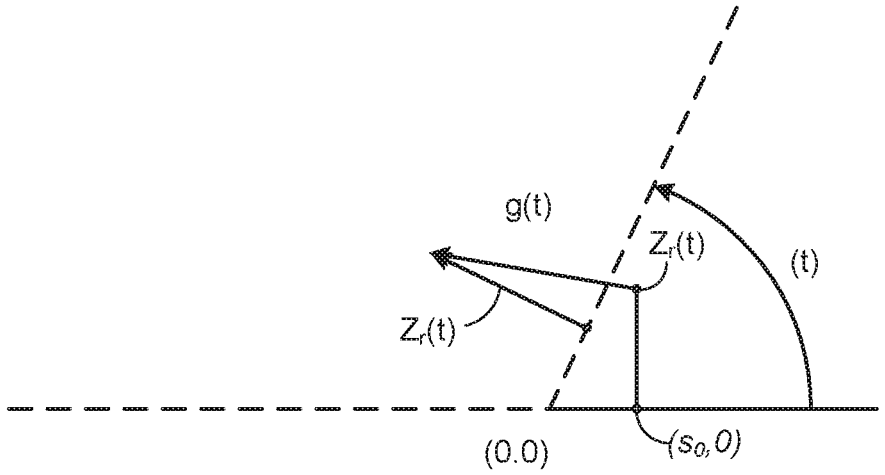

The following relates to synchronized-offset rolling contacts. The present disclosure now assumes an arbitrary cross section for both contacts. The present disclosure now assumes that the left contact surface is parameterized by a vector-valued function $s_l(t):[0,1]\rightarrow R^2$ and the right contact surface is parameterized by $s_r(t):[0,1]\rightarrow R^2$, where $s_l(t)$ and $s_r(t)$ are the points that are brought into contact at fold parameter t, as illustrated in FIGS. 6A-C. The present example fixes the left contact to ground and locates the center of rotation of the zero-thickness fold at the origin (0, 0). For full generality, the present example assumes that the initial point of contact between the two surfaces is at position ($s_0$, 0) for some constant $s_0$, i.e., not necessarily at the origin.

FIGS. 6A-C show an example of geometry of a general rolling contact between two surfaces. FIG. 6A shows a fold angle $\gamma(0)=0$. FIG. 6B shows an intermediate fold angle of $\gamma(t)$ with t>0. FIG. 6C shows geometric relations that relate the elevation functions $z_l(t)$ and $z_r(t)$ to the vector q(t).

In the analysis that follows, the following notations are adopted. The unit vector $\hat{u}(\theta)$ is given by $$\hat{u}(\theta)\equiv(\cos\theta, \sin\theta). \tag{5}$$

The counterclockwise rotation matrix $R(\theta)$ is given by $$R(\theta) \equiv \begin{pmatrix} \cos\theta & -\sin\theta \\ \sin\theta & \cos\theta \end{pmatrix}. \tag{6}$$

For any function f(s), one can denote by f'(s) its derivative $$f'(s) \equiv \frac{d}{ds}f(s), \tag{7}$$

and can denote the vector magnitude by $$\|u\|\equiv\sqrt{u\cdot u}. \tag{8}$$

Now one can enumerate the constraints that define the desired surface functions $s_l(t)$ and $s_r(t)$. First, since $s_l(t)$ is the point on the left surface that contacts $s_r(t)$ on the right surface, the arc lengths from the initial points of contact to $s_l(t)$ and $s_r(t)$ are the same for all t. This gives rise to the non-sliding condition, $$\|s_l'(t)\|=\|s_r'(t)\| \text{ for all } t. \tag{9}$$

Next, as illustrated in FIG. 6B, at the point of contact, the two surfaces are tangent, which means that the tangent vectors of the two surfaces are linked by the fold angle $\gamma(t)$, giving the tangency condition, $$\frac{s_l'(t)}{\|s_l'(t)\|} = R(\gamma(t))\cdot\frac{s_r'(t)}{\|s_r'(t)\|}. \tag{10}$$

The non-sliding condition and tangency condition can be combined into the rolling condition, $$s_l'(t)=R(\gamma(t))\cdot s_r'(t). \tag{11}$$

Now, let us define q(t) as the vector from the initial corner of the left surface to its corresponding corner on the right surface, as illustrated in FIG. 6B. Inspection of the figure shows that it is given by $$q(t)=[s_l(t)-(s_0,0)]+R(\gamma(t))\cdot[(s_0,0)-s_r(t)]. \tag{12}$$

To establish an equivalency between the surface functions $s_l(t)$ and $s_r(t)$ and one's desired offset functions $z_l(t)$ and $z_r(t)$, one notes that if the two corners' positions were defined by the latter, with reference to FIG. 6C, the vector q(t) would be given by $$q(t)=R(\gamma(t))\cdot(s_0,z_r(t))-(s_0,z_l(t)). \tag{13}$$

Equating these two relations for q(t) gives the desired relation between the surfaces and offset functions:

$$[s_l(t)+(0,z_l(t))]=R(\gamma(t))\cdot[s_r(t)+(0,z_r(t))]. \tag{14}$$

The combination of Equation (14) and the rolling condition, Equation (11), constitute a set of first-order differential equations that define the two surfaces $s_l(t)$ and $s_r(t)$.

One can solve this differential system explicitly for the surface functions. One differentiates Equation (14) (now dropping the explicit t dependence for brevity), giving $$[s_l' + (0, z_l')] = R(\frac{\pi}{2} + \gamma)\gamma'[s_r + (0, z_r)] + R(\gamma)\cdot[s_r' + (0, z_r')]. \tag{15}$$

Subtracting Equation (11) from this equation causes both derivatives $s_l'$ and $s_r'$ to drop out, allowing us to solve explicitly for $s_r(t)$. It is given by $$s_r = \frac{1}{\gamma'}[R(-\gamma)\cdot(z_l', 0) - (z_r', 0)] - (0, z_r). \tag{16}$$

Once one has $s_r(t)$, one can use Equation (14) to get the equivalent expression for $s_l(t)$, since $$s_l(t)=R(\gamma(t))\cdot[s_r(t)+(0,z_r(t))]-(0,z_l(t)). \tag{17}$$

Using the unit vector $\hat{u}(\theta)$ for compactness, one has that $$s_l(t) = \frac{z_r'}{\gamma'}\hat{u}(\pi + \gamma) + \frac{z_l'}{\gamma'}\hat{u}(0) + z_l\hat{u}(-\frac{\pi}{2}), \tag{18}$$

-continued $$s_r(t) = \frac{z_l'}{\gamma'}\hat{u}(-\gamma) + \frac{z_r'}{\gamma'}\hat{u}(\pi) + z_r\hat{u}(-\frac{\pi}{2}). \tag{19}$$

One notes that the lateral offset value $s_0$ cannot be chosen independently; in fact, it is given by Equation (18) (or (19)) as $$s_0 = \frac{1}{\gamma'(0)}[z_l'(0) - z_r'(0)]. \tag{20}$$

Thus, for any arbitrary parameterization of the fold angle $\gamma(t)$ and the two offset functions $z_l(t)$ and $z_r(t)$, one can—at least in principle—solve for the surface functions $s_l(t)$ and $s_r(t)$ that, when used in a rolling contact, induce the adjacent panels to undergo the desired offsets synchronously as they rotate through the desired range of motion.

Let us now work out an example.

The following relates to a degree-4 vertex. The present disclosure will first work out the rolling-contact joints for the flat-foldable degree-4 vertex shown in FIGS. 1A-C with sector angles $$\alpha_1=120°,\alpha_2=80°,\alpha_3=60°,\alpha_4=100°.$$

That the vertex is flat-foldable can be seen from the sector angles satisfying the Kawasaki-Justin Theorem, $\alpha_1+\alpha_3=\alpha_2+\alpha_4=180°$. For a flat-foldable degree-4 vertex, the fold angles satisfy $$\gamma_4=\gamma_2,\gamma_3=-\gamma_1, \tag{21}$$

and $$\left|\frac{\tan\frac{1}{2}\gamma_{2,4}}{\tan\frac{1}{2}\gamma_{1,3}}\right| = |\mu|, \tag{22}$$

where the fold angle multiplier $\mu$ is given by $$\mu \equiv \frac{\sin\frac{1}{2}(\alpha_1 + \alpha_2)}{\sin\frac{1}{2}(\alpha_1 - \alpha_2)}. \tag{23}$$

The two opposite fold angles of equal sign, $\gamma_2$ and $\gamma_4$, are the major fold angles; the two opposite fold angles of opposite sign, $\gamma_1$ and $\gamma_3$, are the minor fold angles.

One can choose the parameterization of the fold angles consistently, so that they satisfy Equation (22) at all values of the parameter $t\in[0, 1]$. A simple and logical choice for parameterization is to choose the major fold angles to be linearly proportional to the parameter t, i.e., $$\gamma_2(t)=\gamma_4(t)=\pi t. \tag{24}$$

Then the parameterizations of the other two angles are completely defined; they are $$\gamma_1(t) = -\gamma_3(t) = 2\tan^{-1}\left[\frac{1}{\mu}\tan\frac{1}{2}\pi t\right]. \tag{25}$$

One now chooses the offset functions for the four panels. One has considerable freedom in their functional forms, but one should match specific values at the ends of the range. For t=0, one should have $$z_1(0)=z_2(0)=z_3(0)=z_4(0)=0 \tag{26}$$

so that in the unfolded state, all of the panels are coplanar. In the folded state, they should have various offsets given by Equation (4). The simplest choices are linear functions:

$$z_1(t) = z_4(t) = -\frac{3}{2}dt, \qquad z_2(t) = z_3(t) = +\frac{1}{2}dt. \tag{27}$$

One can now substitute Equations 25 and 27 into Equations 18 and 19 to generate the surface functions for all four joints. Denoting by $s_{l,i}$ and $s_{r,i}$ the two surface functions at the ith fold, one has:

$$\begin{aligned}
s_{l,1} &= \frac{3d}{2\pi\mu}(-1+\cos(\pi t),\ \mu(\pi t+\sin(\pi t))),\\
s_{r,1} &= \frac{3d}{2\pi\mu}(1-\cos(\pi t),\ \mu(\pi t+\sin(\pi t))),\\
s_{l,2} &= \frac{d}{2\pi}(-3-\cos(\pi t),\ 3\pi t-\sin(\pi t)),\\
s_{r,2} &= \frac{d}{2\pi}(-1-3\cos(\pi t),\ -\pi t+3\sin(\pi t)),\\
s_{l,3} &= \frac{d}{2\pi\mu}(-1+\cos(\pi t),\ -\mu(\pi t+\sin(\pi t))),\\
s_{r,3} &= \frac{d}{2\pi\mu}(1-\cos(\pi t),\ -\mu(\pi t+\sin(\pi t))),\\
s_{l,4} &= \frac{d}{2\pi}(1+3\cos(\pi t),\ -\pi t+3\sin(\pi t)),\\
s_{r,4} &= \frac{d}{2\pi}(3+\cos(\pi t),\ 3\pi t-\sin(\pi t)).
\end{aligned} \tag{28}$$

FIGS. 7A-D show the four surfaces along with schematic representations of the panels on either side at four different values of the fold parameter t. For clarity, one can label each panel with its corresponding sector angle $\alpha_i$ and each fold with its corresponding fold angle $\gamma_i$ (see FIG. 2).

If one joins both surfaces (darker lines) to their corresponding panels to form monolithic elements, the resulting panels create rolling contacts that synchronize the offset shifts (relative to the zero-thickness model) with the fold angles. Each rolling contact is a single-degree-of-freedom (1DOF) joint, like a pure revolute joint; the kinematics of the rolling-contact vertex will therefore match the kinematics of the zero-thickness model, giving a 1DOF mechanism for this degree-4 vertex.

Several features of interest (or, perhaps, concern) are visible in the figure:

- In two of the joints ($\gamma_1$ and $\gamma_3$), both contacting surfaces are strictly convex toward each other. That means that these joints could be realized as CORE joints.
- In the other two joints, however ($\gamma_2$ and $\gamma_4$), one of the surfaces has both convex and concave regions. From a design point of view, this is a weakness, as it complicates realization of a CORE joint architecture.
- In three of the joints ($\gamma_1$, $\gamma_2$, and $\gamma_4$), the contacting surfaces extend above or below the panel surfaces. These extensions arise directly from the required offsets, as this disclosure will presently show. In the case of $\gamma_2$ and $\gamma_4$, this means that one of the panels will need to incorporate clearance holes to allow the penetration of the contact surface of its mating panel.
- While it is not immediately obvious from the figure, for $\gamma_1$ and $\gamma_3$, toward the end of the range of motion (t→1), rotation takes place about a point, rather than along rolling surfaces. While the contact is still non-sliding, over a range of t-values, the motion approaches that of a pure revolute joint, which would also be problematic to implement as a CORE joint.

Figure 7A:
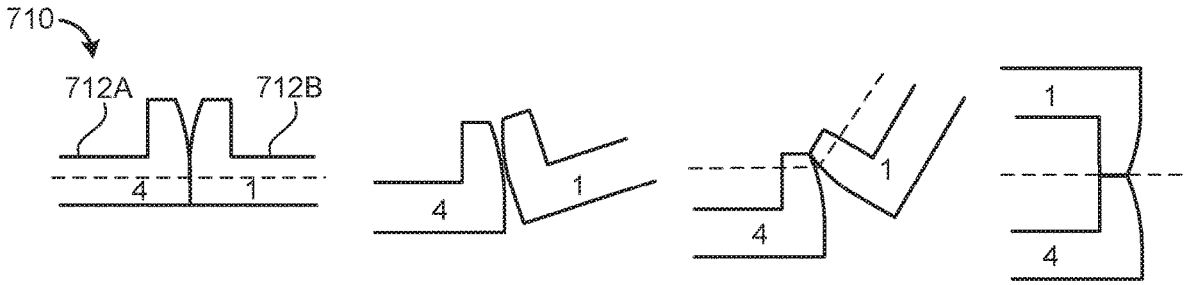
FIGS. 7A-D show an example of surface functions and panel positions for the four joints at four different values of a fold parameter.
Figure 7B:
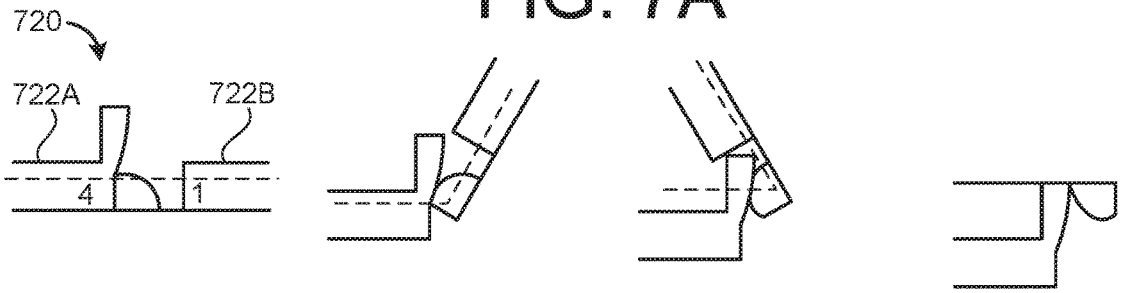
Figure 7C:
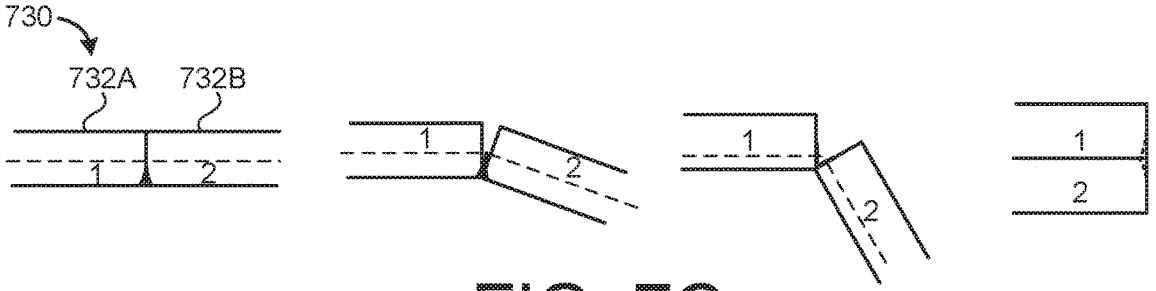
Figure 7D:
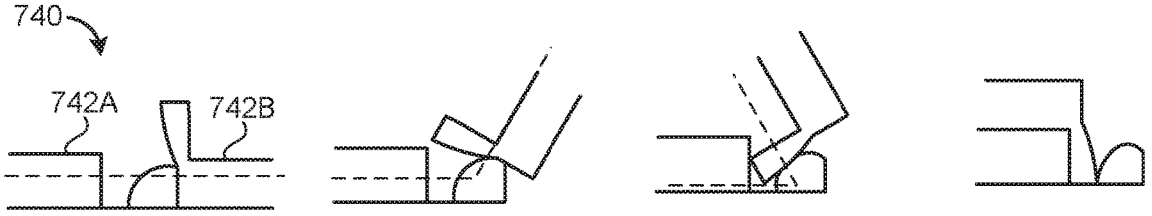

FIGS. 7A-D show examples of surface functions and panel positions for the four joints at four different values of the fold parameter t (from left to right in each figure). FIGS. 7A, 7B, 7C and 7D show respective joints 710, 720, 730 and 740. Each of the joints has a corresponding pair of panels, namely panels 712A-B, 722A-B, 732A-B and 742A-B, respectively. Each of the panels has a rolling surface. The parameter t shown from left to right is: t=0 (unfolded), 0.333, 0.667, and t=1.0 (flat folded). FIG. 7A shows joint corresponding to fold $\gamma_1$. FIG. 7B shows $\gamma_2$. FIG. 7C shows $\gamma_3$. FIG. 7D shows $\gamma_4$. The zero-thickness facets and fold axis are indicated by black dotted lines and dot, respectively. For each of the joints 710, 720, 730 and 740, an axis of rotation is formed according to the corresponding range of motion for that joint. An axis of rotation may not be fixed relative to each of the respective panels of the hinge. Rather, the axis of rotation can be defined by a fixed position plus a motion-varying offset of each of the pair of panels. The offset can be perpendicular to the axis.

So, while one has a solution for rolling contacts that gives a 1DOF mechanism with the desired offset behavior, it does present some challenges for practical implementation. However, one can choose the fold angle functions $\{\gamma_i(t)\}$ and the offset functions $\{z_i(t)\}$ for this example rather arbitrarily. One has considerable freedom in one's choice of functions. This next section will explore the freedom and constraints to choose these functions and show how to achieve better-behaved surface functions that still give the desired kinematic behavior.

The following relates to design considerations. One has considerable latitude in choosing the offset functions $\{z_i(t)\}$; their values at the beginning and the end of motion are specified by panel planarity (at the beginning of motion) and parallel stacking (at the end of motion), but one can choose how they get from one state to the other. However, there are several considerations that will affect the functions one might choose.

The following relates to monotonicity. For many origami mechanisms, the fold angles will vary monotonically from 0° in the unfolded state to some nonzero value—±180° for a flat-foldable pattern. However, there are technologically useful patterns in which some folds do not flex monotonically. An example is the central diagonal crease in a split-diagonal MV twist, which increases from 0° up to a maximum value, then declines again to 0° as the mechanism continues to the flat-folded state.

A non-monotonic fold angle function is problematic: not fatal, but significant, because of the one-to-one mapping between the fold angle $\gamma(t)$ and the position of the point of contact between adjacent panels. If one of the fold angles is non-monotonic, then offset functions $\{z_l(t), z_r(t)\}$ for adjacent panels will need to be chosen so that the surface function positions $\{s_l(t), s_r(t)\}$ are equal for values oft that give the same fold angle.

The following relates to beginning of motion. As already noted above, at the beginning of motion, t=0, the two surface functions are given by $$s_l(0) = s_r(0) = \left(\frac{z_l'(0) - z_r'(0)}{\gamma'(0)}, 0\right). \tag{29}$$

So one can adjust the lateral offset of the point of contact at flatness by choosing appropriately the slopes of the offset functions relative to that of the fold angle function.

The following relates to end of motion. In the same way, one can solve for the surface positions at the end of motion (t=1). For flat-foldable patterns, one will have $\gamma(1)=\pm 180$, which gives $$s_l(1) = \left(\frac{z_l'(1) + z_r'(1)}{\gamma'(1)}, -z_l(1)\right), \tag{30}$$

$$s_r(1) = \left(-\frac{z_l'(1) + z_r'(1)}{\gamma'(1)}, -z_r(1)\right). \tag{31}$$

This is a bit more interesting; it tells one that the lateral offsets of the ends of the surfaces are equal and opposite. (This also follows from the fact that in the flat-folded state, the two panels are 180° flipped and pure z-translated from one another.)

It also tells one that the end of each surface extends vertically by the total amount of z-offset that is programmed for its panel, or, equivalently, at flat-folding, that the point of contact between the surfaces lies in the zero-thickness plane. Since this point starts and ends in the zero-thickness plane, one might ask whether it always remains in that plane. It does not; for most choices of offset function, each point of contact will move in and out of that plane and then back in across the range of motion. This behavior can be seen in FIGS. 7A-D.

The following relates to curvatures and convexity. As noted above, for at least some sets of offset functions, one (or both) of the surfaces can contain both convex and concave surfaces. If both surfaces are convex toward each other, then this permits a straightforward implementation of a CORE joint, and all of the associated robustness and maintenance of relative alignment that ensues. It is useful, then, to have a means of gauging when or whether double-convex surfaces arise, and how that can be ensured in the design.

Since one has a parametric description of each surface, one can readily compute the signed curvature from differential geometry:

$$\kappa 2[s] = \frac{s'' \cdot \left(R\left(\frac{\pi}{2}\right) \cdot \vec{s}'\right)}{\|s'\|^3}. \tag{32}$$

The curvature in Equation (32) is positive if the curve s(t) curves to the left with increasing t and negative if it curves to the right. One can define the function $\text{sign}(\gamma_i)=1$ if $\gamma_i(t)>0$ (valley fold) and $\text{sign}(\gamma_i)=1$ if $\gamma_i(t)<0$ (mountain fold). One can then define the two convexity functions $$c_l(t) \equiv \text{SIGN}(\gamma_i)\frac{s_l'' \cdot \left(R\left(\frac{\pi}{2}\right) \cdot s_l'\right)}{(s_l' \cdot s_l')^{3/2}}, \tag{33}$$

-continued $$c_r(t) \equiv -\text{SIGN}(\gamma_i)\frac{s_r'' \cdot \left(R\left(\frac{\pi}{2}\right) \cdot s_r'\right)}{(s_r' \cdot s_r')^{3/2}}.$$

The convexity functions $c_l(t)$ and $C_r(t)$ are the surface function curvatures with the signs chosen so that a positive value for either surface corresponds to a surface that is convex toward its mating surface, independently of whether the fold is mountain or valley.

Figure 8A:
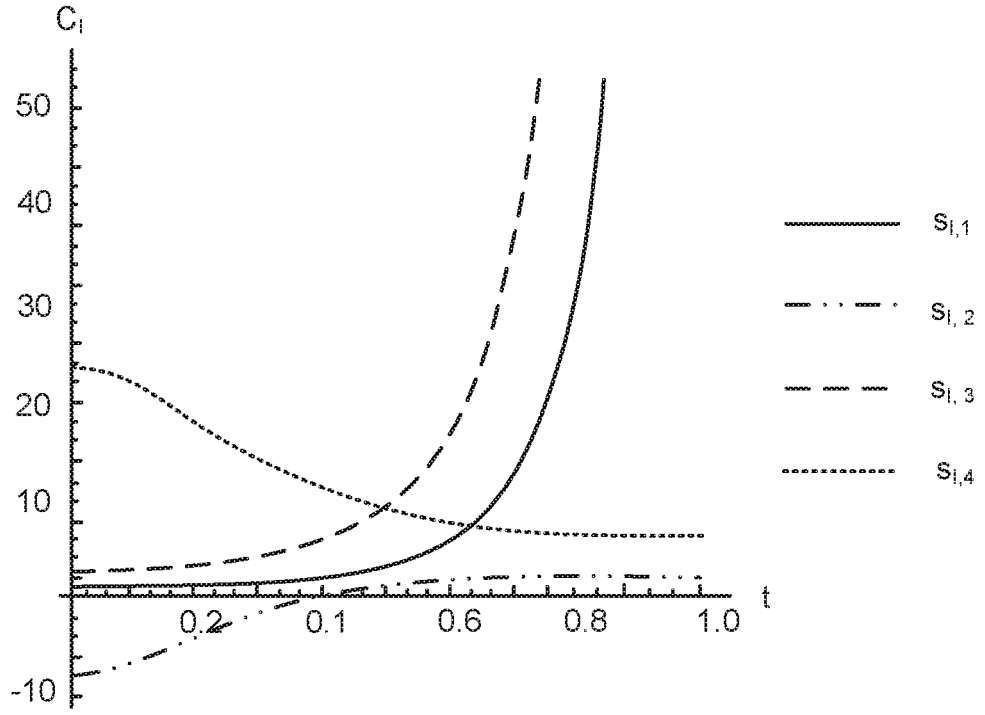
FIGS. 8A-B show an example of convexity functions (signed curvatures) for four joints.
Figure 8B:
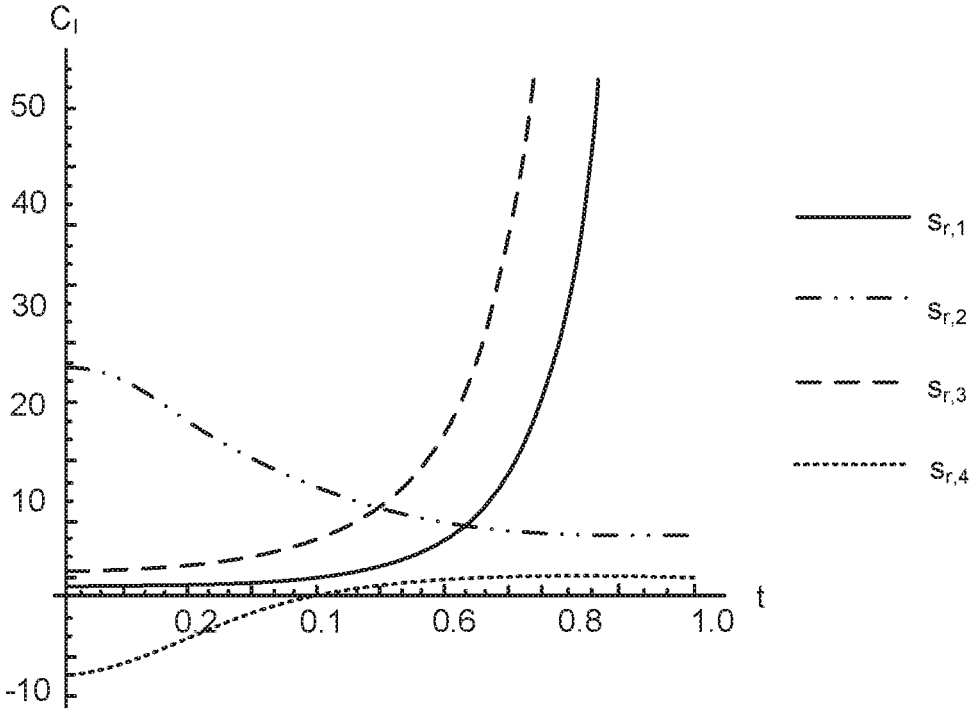

One can now plot in FIGS. 8A-B the convexity functions for both surfaces for all four joints for the surface functions defined in Equations (28).

FIGS. 8A-B show an example of convexity functions (signed curvatures) for the four joints. FIG. 8A shows convexity functions for left surfaces $s_{l,i}$ and FIG. 8B shows convexity functions for right surfaces $s_{r,i}$.

Both of the pathologies noted above are visible in the convexity plots: the divergence of curvatures near t=1, and the negative curvature of one surface (corresponding to a concave surface).

Now that one has expressions for the convexities, though, one can relate these functions back to one's choice of offset functions: the convexities $c_{l,i}$ and $c_{r,i}$ come from the surface functions $s_{l,i}$ and $s_{r,i}$ via Equations (33), which depend on the fold angles and offset functions. The offset functions are pinned by their endpoints, but one is free to search for sets of functions that connect the various endpoints in such a way that the convexities are positive, finite, and generally well-behaved.

Coming back to the goal of creating CORE joints, "well-behaved" would mean that the surface curvature is not too great (which increases the bending strain of compliant members) and not too small (which creates relative compliance in the direction of the surfaces being pulled apart). One can thus define a figure of merit (FOM) for the entire system of joints as the ratio of worst-case largest and smallest convexities:

$$FOM \equiv \frac{\max_{i,t}\{c_{l,i}(t), c_{r,i}(t)\}}{\min_{i,t}\{c_{l,i}(t), c_{r,i}(t)\}}. \tag{34}$$

By then using variational calculus, one could find an optimal set of offset functions $\{z_i(t)\}$ that meet their endpoint values and minimize this figure of merit.

Given the complexity inherent in Equation (34), the variational analysis is going to be non-trivial. However, one may want one's functions to be relatively smooth, to minimize the worst-case curvature. This allows a strategy for finding a near-optimal solution numerically.

The following relates to optimized single-vertex surfaces. One can start by redefining the fold angle functions with a different parameterization that gives more symmetric expressions:

$$\gamma_2(t) = \gamma_4(t) = \gamma_{major}(t) \equiv 2\tan^{-1}\left[\mu^{1/2}\tan\frac{\pi}{2}t\right], \tag{35}$$

$$\gamma_1(t) = -\gamma_3(t) = \gamma_{minor}(t) \equiv 2\tan^{-1}\left[\mu^{-1/2}\tan\frac{\pi}{2}t\right].$$

Then, for the offset functions, since one knows their values at the endpoints, one can perform an expansion in terms of a set of polynomials that will enforce matching at the endpoints and whose coefficients allow for shape variation in between. One can define offset functions thus:

$$z_1(t) = z_A(t) = z_{outer}(t) \equiv -\frac{3}{2}\left[t + \sum_{j=1}^{n} b_{o,j}B_j(t)\right], \quad (36)$$

$$z_2(t) = z_3(t) = z_{inner}(t) \equiv \frac{1}{2}\left[t + \sum_{j=1}^{n} b_{i,j}B_j(t)\right],$$

where $B_j(t)$ is the jth expansion polynomial. Choosing a degree-n expansion gives a total of 2n coefficients $\{b_{i,j}, b_{o,j}\}$ that can be optimized to minimize the figure of merit.

For a first evaluation, one can take n=3 and the following polynomials:

$$B_1(t)=(1-t)^2t,$$

$$B_2(t)=(1-t)t,$$

$$B_3(t)=4(1-t)t^2, \quad (37)$$

which correspond, respectively, to a bump (or divot) in the function at the beginning, middle, and end of the motion.

In order to avoid negative curvatures and numerical instabilities arising from zero curvature, one can adopt a modified figure of merit that clips all curvatures to a small, non-negative value ε:

$$FOM \equiv \frac{\max_{i,t}\{c_{l,i}(t), c_{r,i}(t)\}}{\min_{i,t}\{\varepsilon, c_{l,i}(t), c_{r,i}(t)\}}. \quad (38)$$

Optimizing over the six coefficients finds an optimal solution for coefficients $$b_{i,1}=0.322657, b_{i,2}=0.0885048, b_{i,3}=0.814152, b_{o,1}=0.876535, b_{o,2}=0.32912, b_{o,3}=0.184345. \quad (39)$$

In FIGS. 9 and 10 the present disclosure plots the fold angle functions, offset functions, convexity functions, and shows the surfaces at t=0 for the four joints. Now all four joints have finite positive convexity toward each other, and thus permit a CORE joint implementation.

Figure 11:
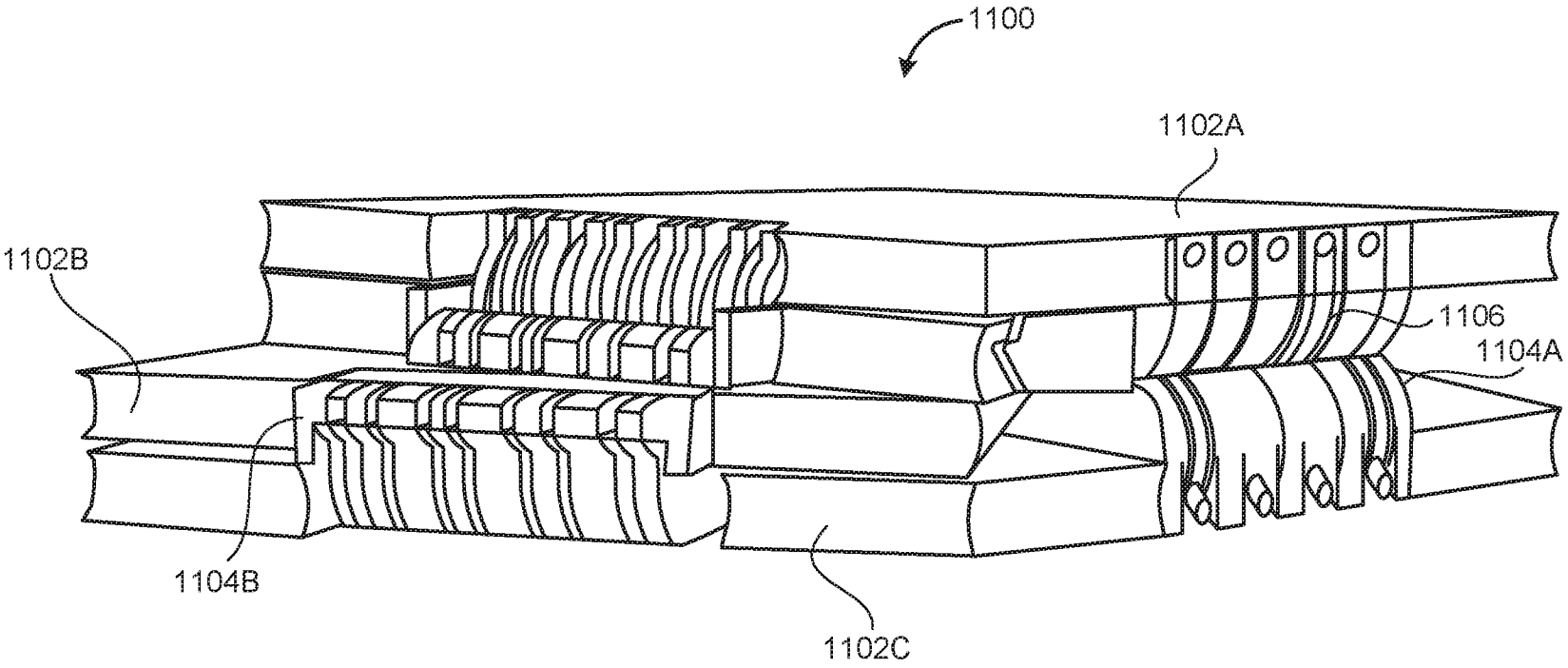
FIG. 11 shows an example of 3D printed rolling core joints with custom rolling surfaces.

The following relates to a physical implementation of a degree-4 vertex. The inventors fabricated two thick-panel origami vertices to demonstrate implementation of the SORCE joints. The panels of these vertices were made from 1.016 cm (0.4 in) thick sandwich panel consisting of a polystyrene foam core and wood-fiber veneer skins (commercially available as "Gator Board"). The rolling contact surface geometries from Section 0.7 were physically realized through 3D printing (Makerbot Replicator 2) using polylactic acid (PLA) filament. Additional features were incorporated into the 3D printed rolling contacts to simplify assembly of the bands connecting the rolling contacts together. An image of these 3D printed joints is shown in FIG. 11 as structure 1100. Four medical-grade latex bands were used to join each pair of rolling surfaces. These bands were arranged such that no net twisting moment would be introduced by the tension in the latex bands. The structure 1100 includes panels 1102, for example panels 1102A, 1102B and 1102C. The panels are connected by hinges 1104, for example hinge 1104A connecting panels 1102A and 1102C, and hinge 1104B connecting panels 1102B and 1102C. Each of the hinges can include one or more bands, such as band 1106 indicated in the hinge 1104A, that hold rolling surfaces of that hinge together. The hinges 1104 form a closed loop of the panels 1102. As such, the structure 1100 is an example of a closed-loop hinged mechanism. For example, such a mechanism can include panels and hinges that connect respective pairs of the panels to each other. At least one of the hinges 1104 can be a rolling-contact hinge. For example, here all of the hinges 1104 are rolling-contact hinges.

Figure 9A:
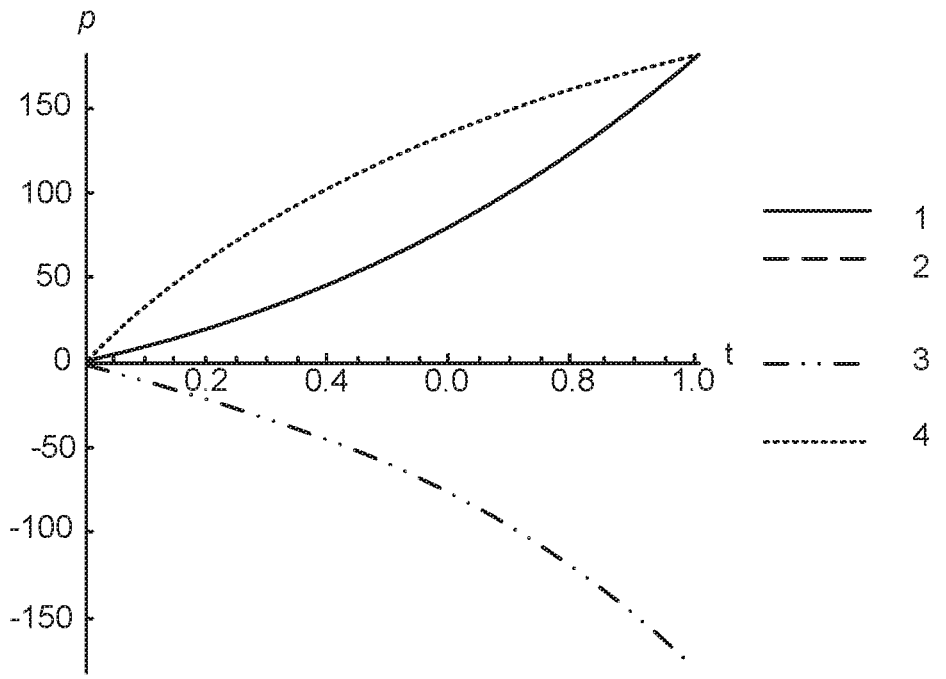
FIGS. 9A-D show an example of design of optimized rolling-contact surfaces for a degree-4 vertex.
Figure 9B:
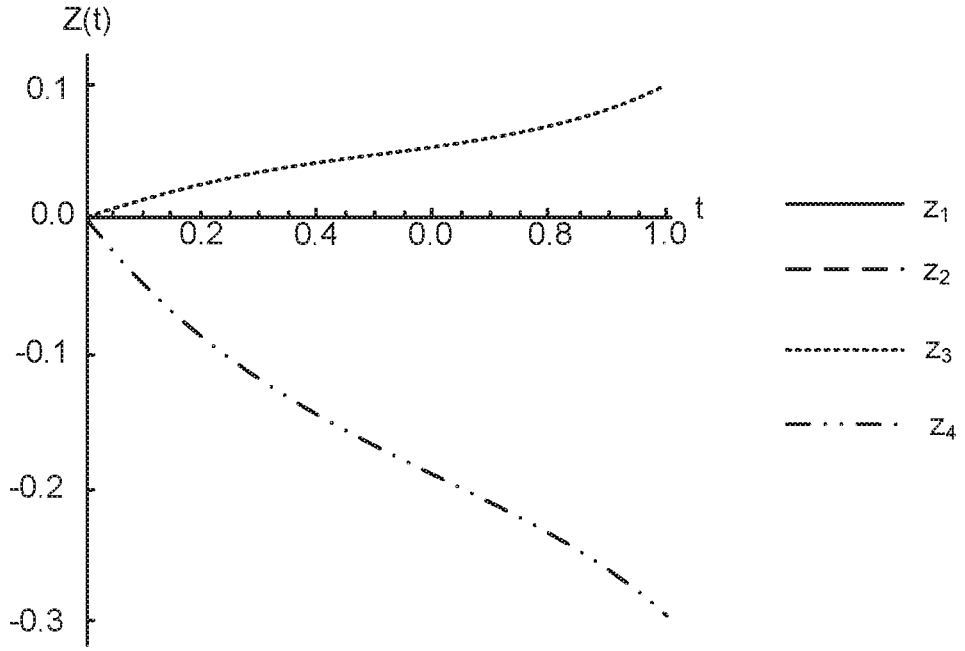
Figure 9C:
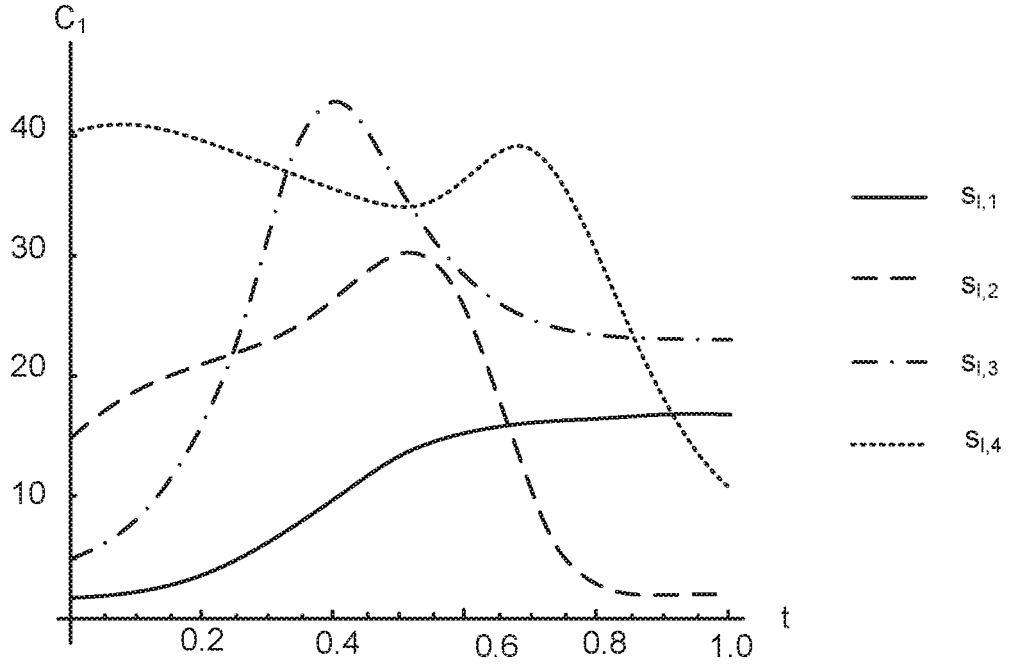
Figure 9D:
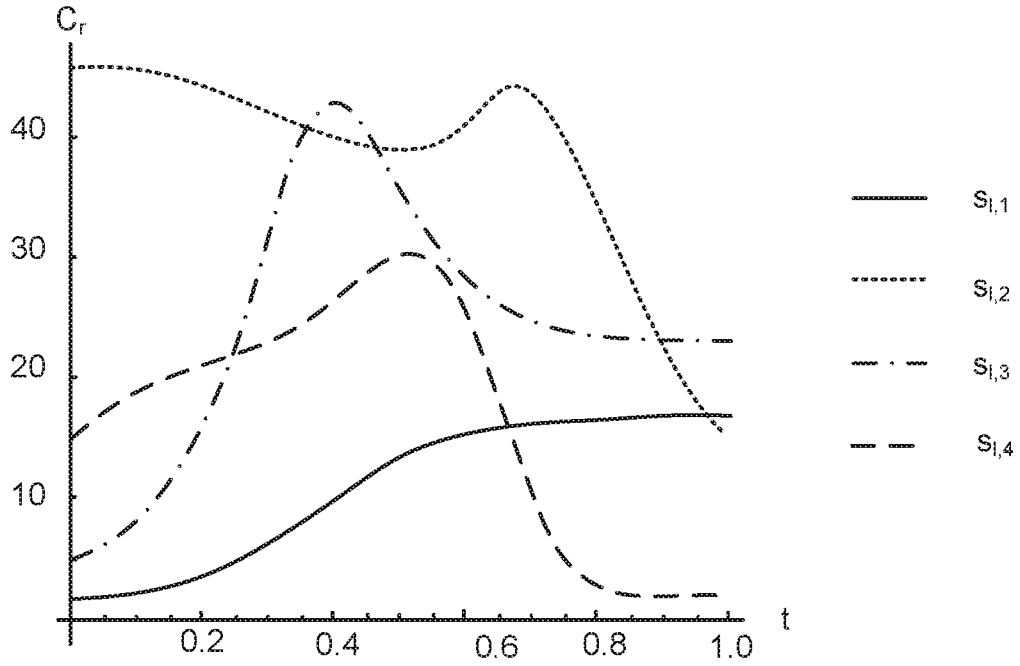

FIGS. 9A-D show an example of design of the optimized rolling-contact surfaces for a degree-4 vertex. FIG. 9A shows the fold angles versus t (note that $\gamma_2$ and $\gamma_4$ overlap). FIG. 9B shows the offset functions (note that $z_1$ and $z_4$ overlap, as do $z_2$ and $z_3$). FIGS. 9C and 9D show the four convexity functions for left and right surfaces.

Figure 10A:
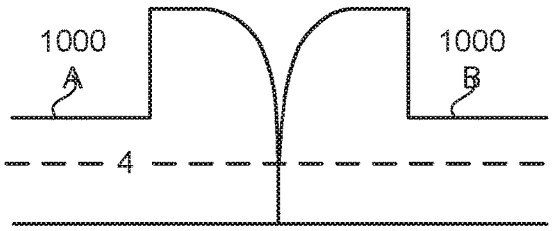
FIGS. 10A-D show an example of design of the optimized rolling-contact surfaces for a degree-4 vertex.
Figure 10B:
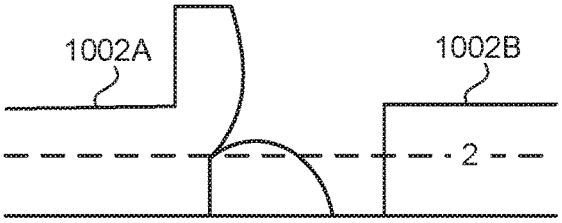
Figure 10C:
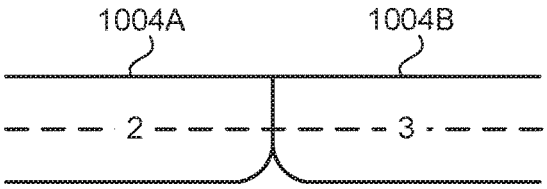
Figure 10D:
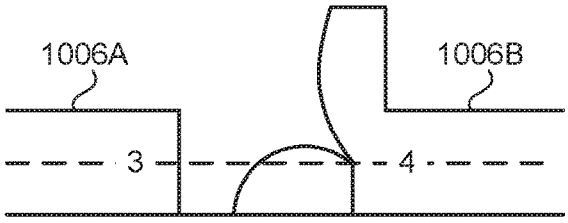

FIGS. 10A-D show an example of design of the optimized rolling-contact surfaces for a degree-4 vertex. Four rolling-contact hinges are shown: in FIG. 10A, panels 1000A and 1000B; in FIG. 10B, panels 1002A and 1002B; in FIG. 10C, panels 1004A and 1004B; and in FIG. 10D, panels 1006A and 1006B. The panels and surfaces for the four joints are shown at t=0. FIGS. 10A and 10B show $\gamma_1$ and $\gamma_2$. FIGS. 10C and 10D show $\gamma_3$ and $\gamma_4$. The zero-thickness facets are indicated by black dotted lines; the fold axis is indicated by the heavy black dot in the middle of each image.

The first origami vertex constructed was the flat-foldable degree-4 vertex described above with sector angles (120°, 80°, 60°, 100°). The surfaces generated in FIGS. 10A-D were 3D printed with grooves and posts to facilitate attachment of the flexible latex bands. The rolling joint contact pairs were assembled with the flexible bands and attached to their corresponding panels with an adhesive. Care was taken to ensure that the lateral offset $s_0$ was properly aligned relative to the zero-thickness pattern for each joint pair; because $s_0$ is non-zero for $\gamma_2$ and $\gamma_4$. (as can be seen in FIGS. 10A-D), the line of contact between the two surfaces is not collinear with the zero-thickness fold line. Nevertheless, the motion is kinematic and 1DOF (subject to the flexibility in the connecting bands). The progression of the motion of the vertex from a closed, folded state to an open, unfolded state is shown in FIGS. 12A-I.

Figure 12A:
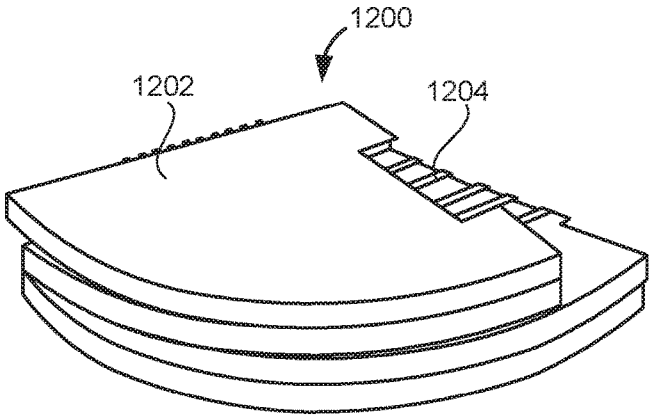
FIGS. 12A-I show an example of a degree-4 vertex constructed with thick sandwich panels and rolling joints.
Figure 12B:
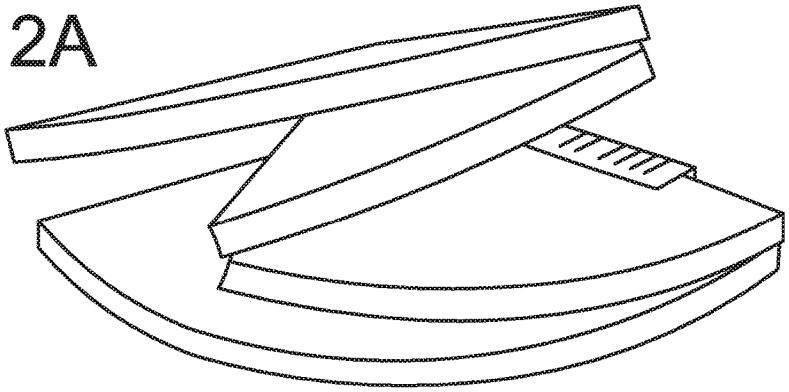
Figure 12C:
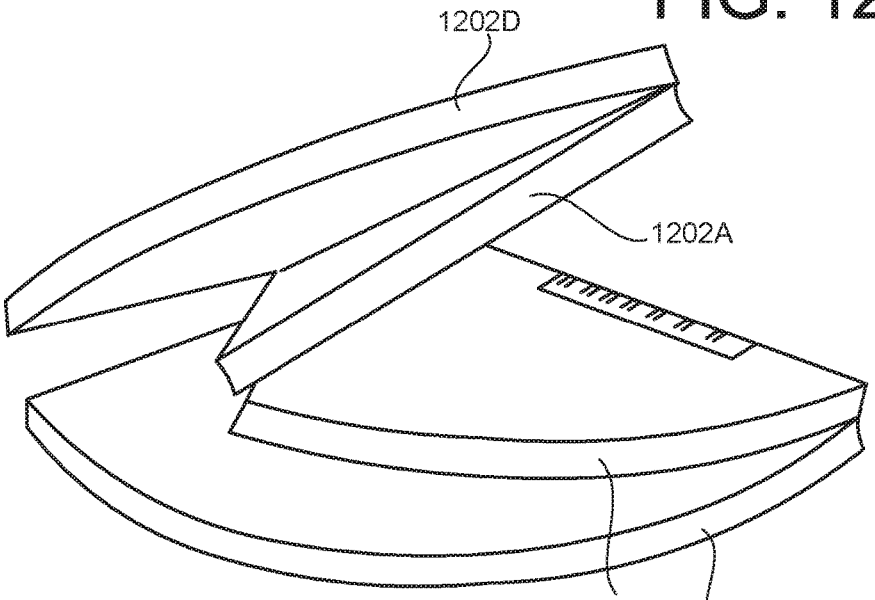
Figure 12D:
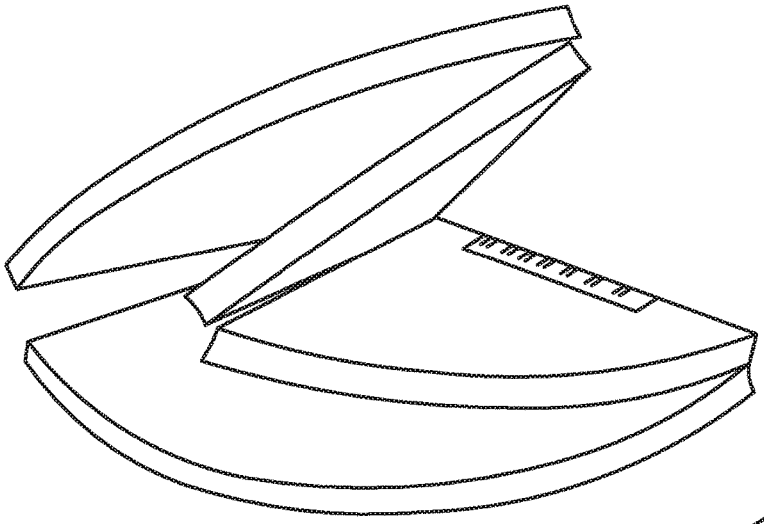
Figure 12E:
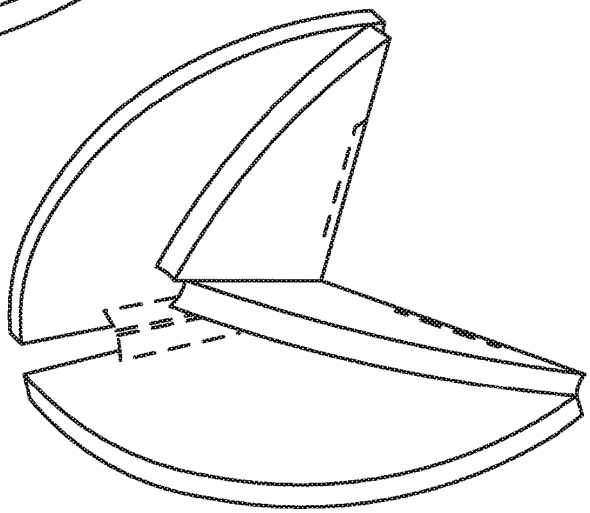
Figure 12F:
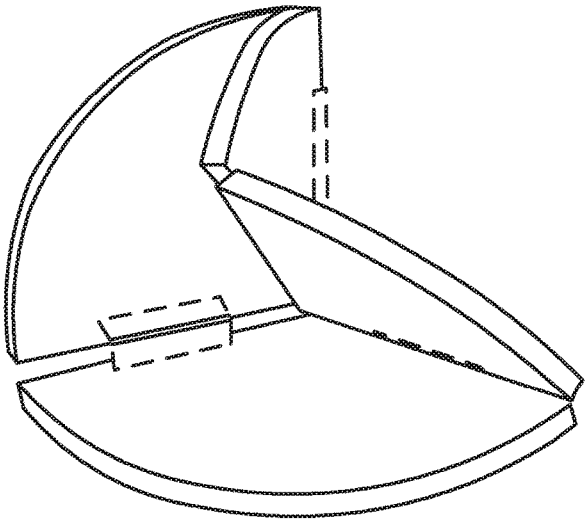
Figure 12G:
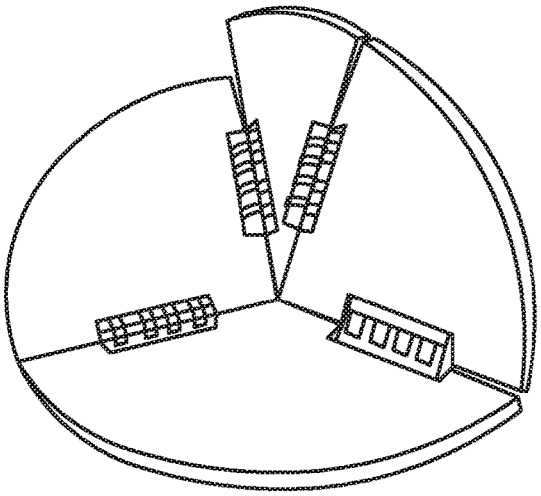
Figure 12H:
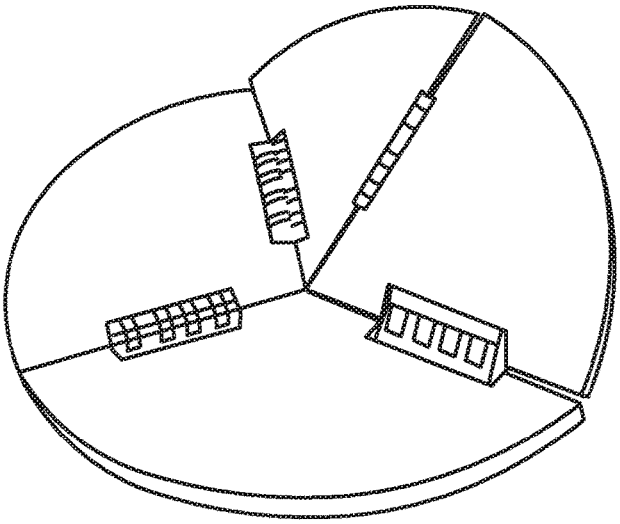
Figure 12I:
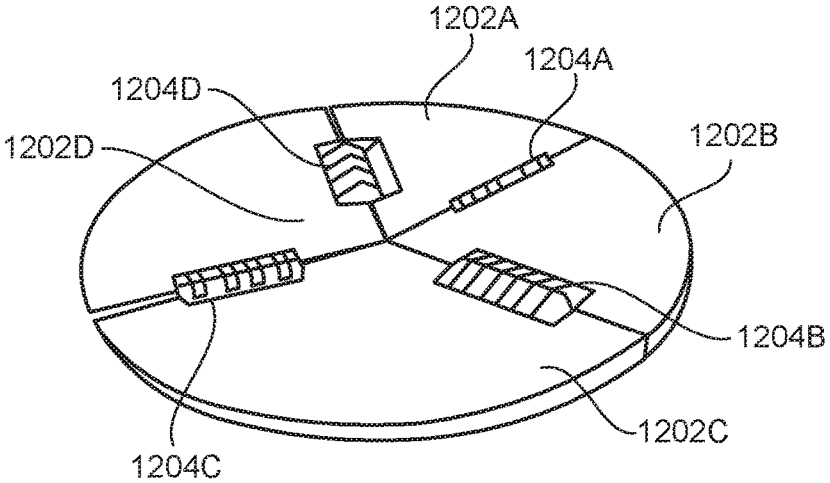

FIGS. 12A-I show an example of a degree-4 vertex 1200 constructed with thick sandwich panels 1202 and rolling joints 1204. This prototype exhibited a smooth folding and unfolding motion while using the rolling joints to create the panel offsets required in the folding. The latex bands allowed some parasitic motion in the joints, but stiffer bands could be used to reduce the parasitic motion; fundamentally, the mechanism is (like one based on pure revolute joints) single-degree-of freedom. The hinges 1204 provide a range of motion for the vertex 1200. FIG. 12A shows the vertex 1200 when the panels 1202 are stacked essentially parallel to each other (e.g., a stowed state), and FIGS. 12B-H show positions during the range of motion of the vertex. In FIG. 12H, finally, the vertex has assumed a state where the panels 1202 are essentially in a single plane without overlapping (e.g., a deployed state). In this example, all of the hinges 1204 are rolling-contact hinges. Each of the rolling-contact hinges can be a sole connection between a respective adjacent pair of the panels 1202. For example, the hinge 1204 is the sole connection between the panels 1202A and 1202B.

The following relates to general planar trajectories. The key concept of the rolling-contact configuration described above is that restricting the displacements of the panels from their zero-thickness facets to be purely perpendicular to the facets ensures that relative motion between adjacent panels lies within the plane perpendicular to the fold between the corresponding facets. Relative planarity of adjacent facet motion means that one can "soak up" the varying spacing between adjacent panels as the panels rotate and translate relative to each other using rolling contacts that have translational symmetry in the direction of the fold.

Defining the motions by scalar offset functions $\{z_i(t)\}$ ensures relative planarity, but does not take in all possible allowed relative motions of the panels. By broadening the description of relative panel motions, one can access a broader range of single-DOF origami mechanisms based on rolling contacts.

In particular, one can introduce time-varying gaps and other translational motions between the facets of the zero-thickness reference model, and, as long as the relative motion between every pair of panels lies within a plane perpendicular to their corresponding fold axis, one can absorb the additional relative motion into the surface functions and still achieve single-DOF kinematic motion.

Going forward, the present disclosure will refer to the plane perpendicular to the zero-thickness fold as the normal plane of the fold.

One can now assume two zero-thickness facets $F_i$ and $F_j$ that both undergo some planar rigid-body motion, i.e., a combination of translation and/or rotation that all take place within the normal plane of the fold. To encompass full generality, one can now allow both $F_i$ and $F_j$ to undergo their own independent planar motions relative to an arbitrary frame of reference, rather than (as in the previous section) working within the frame of reference of one of the zero-thickness facets.

Let $p_i(t)$ describe the trajectory of a point in facet $F_i$. Then, because the motion is planar rigid-body motion, $p_i(t)$ can be written as $$p_i(t)=(R_i(t)\cdot p_i(0))+r_i(t), \tag{40}$$

where $R_i(t)$ is a time-varying 2×2 rotation matrix and $r_i(t)$ is a time-varying translation vector. Similarly, for any point $p_j(t)$ in facet $F_j$, $$p_j(t)=(R_j(t)\cdot p_j(0))+r_j(t). \tag{41}$$

Figure 13:
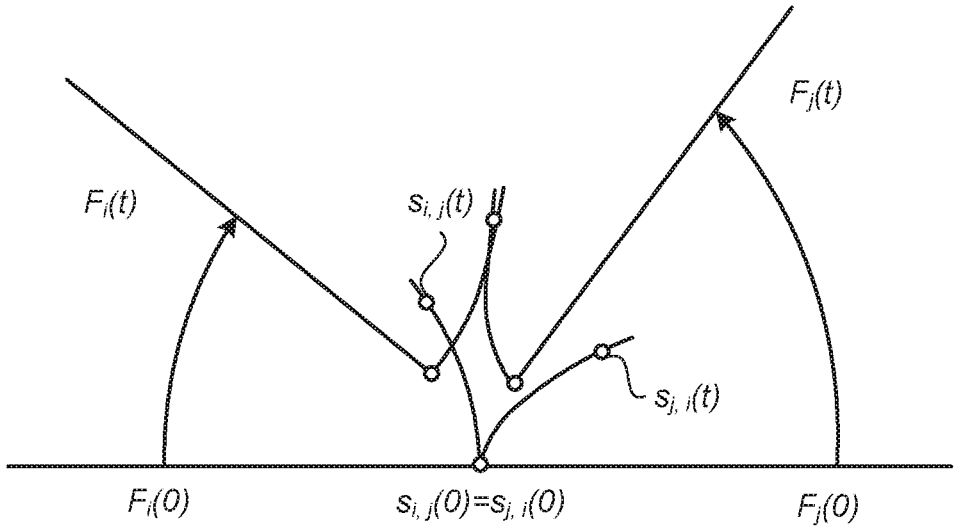
FIG. 13 shows an example of a schematic of two facets undergoing planar motion forming rolling contact between surfaces.

Once again, one can assume rolling contact surface functions. Define $s_{i,j}(t)$ as the position at t=0 of the point connected to facet $F_i$ that touches its corresponding point on facet $F_j$ at time t. Similarly, one can define $s_{j,i}(t)$ as the position at t=0 of the point connected to facet $F_j$ that touches its corresponding point on facet $F_i$ at time t. These surface functions are illustrated in FIG. 13.

As before, the two surface functions $s_{i,j}(t)$ and $s_{j,i}(t)$ should satisfy the 2-D contact equation, which is that the two points touch at time t:

$$R_i(t)\cdot s_{i,j}(t)+r_i(t)=R_j(t)\cdot s_{j,i}(t)+r_j(t). \tag{42}$$

They should also satisfy the 2-D rolling equation, which is that the velocities of the two surface functions match when rotated to their orientations at time t:

$$R_i(t)\cdot s'_{i,j}=R_j(t)\cdot s'_{j,i}. \tag{43}$$

FIG. 13 shows an example of a schematic of two facets $F_i$ and $F_j$ undergoing planar motion forming rolling contact between surfaces $s_{i,j}(t)$ and $s_{j,i}(t)$).

The present disclosure rearranges this equation:

$$s'_{j,i}=R_j^{-1}(t)\cdot R_i(t)\cdot s'_{i,j}, \tag{44}$$

which one can do because $R_j(t)$, being a 2D rotation, is nonsingular and therefore invertible.

One can also rearrange the contact equation:

$$\begin{aligned} S_{j,i}(t) &= R_j^{-1}(t)\cdot[(R_i(t)\cdot s_{i,j}(t))+r_i(t)-r_j(t)] \\ &= [R_j^{-1}(t)\cdot R_i(t)]\cdot s_{i,j}(t)+R_j^{-1}(t)\cdot(r_i(t)-r_j(t)), \end{aligned} \tag{45}$$

and then differentiate this equation (now dropping the explicit t dependence for brevity):

$$s'_{j,i}=[R_j^{-1}\cdot R_i]\cdot s'_{i,j}+[R_j^{-1}\cdot R_i]'\cdot s_{i,j}+[R_j^{-1}\cdot(r_i(t)-r_j)]'. \tag{46}$$

Subtracting off Equation (44) gives an implicit equation for the curve $s_{i,j}(t)$:

$$[R_j^{-1}\cdot R_i]'\cdot s_{i,j}=[R_j^{-1}\cdot(r_i-r_j)]'. \tag{47}$$

Now, both $R_j^{-1}$ and $R_i$ are 2D rotation matrices, and so their product is also a 2D rotation matrix, which can be written in the form $$R_j^{-1}\cdot R_i=R(\theta(t)) \tag{48}$$

for some function θ(t) where R(θ) is the general 2D rotation matrix given by Equation (6). Its derivative, therefore, is given by $$[R_j^{-1}\cdot R_i]'=\theta'(t)R\left(\theta+\frac{\pi}{2}\right). \tag{49}$$

Thus, $[R_j^{-1}\cdot R_i]'$ is invertible if and only if the derivative of its rotation angle (analogous to the relative fold angle γ(t) in the previous section) is nonzero. If the derivative of the rotation angle vanishes, then the matrix $[R_j^{-1}\cdot R_i]'$ is not just singular; it is the zero matrix.

If $[R_j^{-1}\cdot R_i]'$ is invertible, then one can solve for $s_{i,j}$ $$s_{i,j}=[[R_j^{-1}\cdot R_i]']^{-1}\cdot[R_j^{-1}\cdot(r_i-r_j)]'. \tag{50}$$

One can obtain $s_{j,i}(t)$ by swapping subscripts i and j in Equation (50). Alternatively, once one has $s_{i,j}$, one can invert the 2D contact equation, Equation (42), to get $$s_{j,i}=R_j^{-1}\cdot[R_i\cdot s_{i,j}+(r_i-r_j)]. \tag{51}$$

Equations (50) and (51) give the desired surface functions for planar-motion rolling contacts for arbitrary planar rigid-body motions for either facet.

That assumes that the derivative matrix $[R_j^{-1}\cdot R_i]'$ (and its counterpart, $[R_i^{-1}\cdot R_j]'$) do not vanish. If they do for some value $t=t_0$, then Equation (47) cannot be solved by inverting the matrix. One of two conditions must apply:

- The right side of Equation (47) is nonzero. Then there is no solution to Equation (47). One can say that a set of trajectories for which the left side is zero and the right side is nonzero is ill-behaved at time $t_0$.
- The right side of Equation (47) is zero. Then Equation (47) is satisfied for any function $s_{i,j}(t_0)$ (since both sides of the equation vanish).

If both sides of the equation vanish at a particular time $t_0$, Equation (50) is undefined, but it is often still possible to find solutions by taking limits as one approaches $t_0$. (It is not uncommon to encounter this situation at the endpoints of the motion, depending on the trajectory functions.) If both derivatives vanish but the limit of Equation (50) (and counterpart) exist as $t\rightarrow t_0$, one can take $s_{i,j}(t_0)$ to be the limit value; if the limit does not exist, one can also say the motion is ill-behaved. Any set of trajectories that is nowhere ill-behaved is well-behaved.

One can summarize the result as follows:

Theorem 1 (Planar Rolling-Contact Theorem) Given any collection of rigid objects undergoing independent arbitrary time-varying Euclidean motion in a plane, between every pair of objects, if the motion is well-behaved, there exists a pair of translationally symmetric surfaces on each pair of objects that form a rolling contact between the objects, where the axis of translational symmetry is normal to the plane.

Said surfaces are given by the formulas in this section.

One can simplify these formulas somewhat by defining the rotation matrices in terms of their scalar rotation angles. One can define:

$$R_i(t) \equiv R(\theta_i(t)),$$

$$R_j(t) \equiv R(\theta_j(t)). \tag{52}$$

Then, after some manipulation, and making use of the identities $$R^{-1}(\theta) = R(-\theta), \tag{53}$$

$$(R(\theta))' = \theta' R\left(\theta + \frac{\pi}{2}\right),$$

one has that $$s_{i,j} = \frac{1}{\theta_i' - \theta_j'} R(-\theta_i) \cdot \left(\theta_j'(r_i - r_j) + R\left(\frac{\pi}{2}\right) \cdot (r_i' - r_j')\right), \tag{54}$$

$$s_{j,i} = \frac{1}{\theta_j' - \theta_i'} R(-\theta_j) \cdot \left(\theta_i'(r_j - r_i) + R\left(\frac{\pi}{2}\right) \cdot (r_j' - r_i')\right),$$

which now displays the symmetry between the two surface functions directly.

The theory in this section is quite general; the present disclosure now applies it to a specific mechanism of practical interest.

Figure 14:
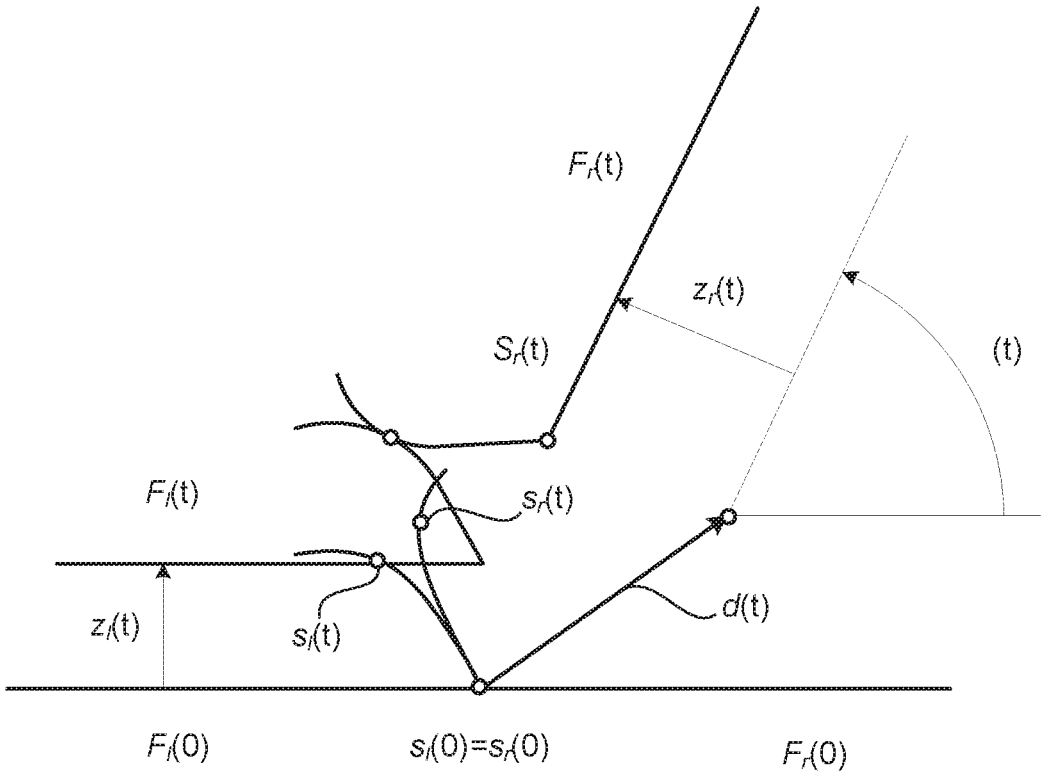
FIG. 14 shows an example of geometry of the zero-thickness reference with an offset between the two halves of the fold.

The following relates to offsets in zero-thickness reference. There are various ways one could describe the additional relative motion supported by the planar rolling contact model. A particularly useful way is the following. For a given fold of a zero-thickness mechanism, one can split the mechanism along the fold and introduce a general relative motion vector d(t), which is the vector between the two halves of the split fold lying in the plane perpendicular to the fold, as illustrated in FIG. 14 (compare with FIG. 6C). FIG. 14 shows an example of geometry of the zero-thickness reference with an offset d(t) between the two halves of the fold.

So, in addition to the panels being perpendicularly offset from their zero-thickness facets, one has introduced the additional offset d(t) between the zero-thickness facets themselves.

One can define the trajectory functions in any frame of reference. One can define them as before in the frame of reference of the zero-thickness facet, again using l and r as the subscripts for the left and right panels. From inspection of FIG. 14, one has the following:

$$R_l(t) = R(0),$$

$$r_l(t) = (0, z_l(t)),$$

$$R_r(t) = R(\gamma(t)),$$

$$r_r(t) = d(t) + R(\gamma(t)) \cdot (0, z_r(t)). \tag{55}$$

Substituting these into Equation (50) and its counterpart with swapped subscripts results in the following for the two surface functions $s_l(t)$ and $s_r(t)$:

$$s_l = \frac{1}{\gamma'}\left[z_r'\hat{u}(\pi + \gamma) + z_l'\hat{u}(0) + R\left(\frac{\pi}{2}\right) \cdot d'\right] - z_l\hat{u}\left(\frac{\pi}{2}\right) + d, \tag{56}$$

$$s_r = \frac{1}{\gamma'}\left[z_l'\hat{u}(-\gamma) + z_r'\hat{u}(\pi) + R\left(\frac{\pi}{2}\right) - \gamma \cdot d'\right] - z_r\hat{u}\left(\frac{\pi}{2}\right). \tag{57}$$

Note that both d and d' appear in $s_l$, but only d' appears in $s_r$.

One can apply this concept to any vertex or collection of vertices that can be split in such a way that over the full range of folding motion, the offset d(t) stays perpendicular to every split fold. A symmetric vertex can have a bird's foot shape or another shape. An example is the symmetric bird's-foot vertex shown in FIGS. 15A-B.

One can split the vertex along folds $\gamma_1$ and $\gamma_3$, choosing the 3D offset vector d(t) to be perpendicular to the plane containing both $\gamma_1$ and $\gamma_3$.

One can define the scalar function $d(t) \equiv \|d(t)\|$. Although the direction of d(t) is prescribed by the symmetry of the pattern, one has considerable freedom in choosing d(t) in order to accommodate panel thicknesses.

Figure 15B:
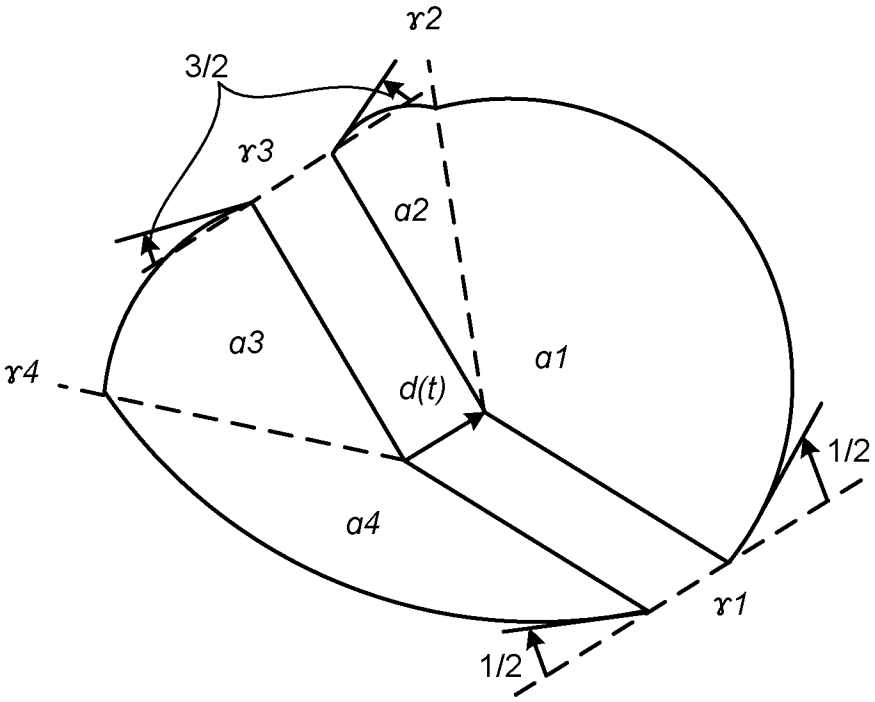
FIGS. 15A-B show an example of splitting a symmetric bird's-foot vertex.
Figure 15A:
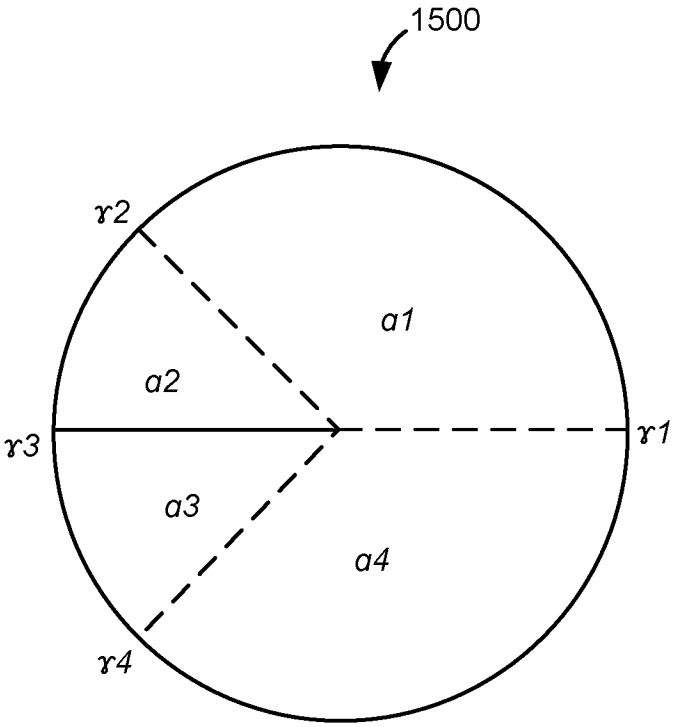

FIGS. 15A-B show an example of splitting a symmetric bird's-foot vertex 1500. The vertex 1500 here includes four panels, labeled according to the respective sector angles ($\alpha 1$, $\alpha 2$, $\alpha 3$ and $\alpha 4$) that they form. A bird's foot vertex can be symmetric or asymmetric. The vertex 1500 is symmetric. For example, $\alpha 2 + \alpha 1$ is equal to $\alpha 3 + \alpha 4$. The corresponding fold angles ($\gamma 1$, $\gamma 2$, $\gamma 3$ and $\gamma 4$) are also indicated. The folds form a shape in the vertex 1500 that resembles a bird's foot, hence the name bird's-foot vertex. FIG. 15A shows the crease pattern (folded state at t=0). FIG. 15B shows the split zero-reference surface in a partially folded state (t>0).

Clearly the offset does not affect the non-split folds $\gamma_2$ and $\gamma_4$. The surface functions at those folds will depend only upon the panel elevation functions to either side. For $\gamma_1$ or $\gamma_3$, though, there will be a non-zero 2D offset vector that will enter into the surface functions according to Equations (56) and (57). For $\gamma_1$, one will have an offset $$d_1(t) = d(t)\hat{u}(\gamma_1(t)/2), \tag{58}$$

while for $\gamma_3$, one will have $$d_3(t) = d(t)\hat{u}(\gamma_3(t)/2). \tag{59}$$

The utility of splitting a vertex (or entire crease pattern) is that it gives us an additional degree in freedom in choosing the zero-thickness reference planes and surface functions. For example, one can choose the zero-thickness reference plane for $\gamma_2$ so that it lies between the two adjacent panels, and similarly for $\gamma_4$, then choose the scalar offset function d(t) so that panels $\alpha_2$ and $\alpha_3$ stack one atop the other in the fully folded form.

As an example, one can choose a vertex with sector angles (135°, 45°, 45°, 135°)
and panel thickness 0.2. These sector angles give a fold angle multiplier of $$\mu=\sqrt{2}$$

One can define $z_i(t)$ as the elevation function for the ith facet and then the following parameterizations:

$$\begin{aligned}
\gamma_1(t) &= 2\tan^{-1}\left[\mu^{-1/2}\tan\frac{\pi t}{2}\right],\\
\gamma_3(t) &= -2\tan^{-1}\left[\mu^{-1/2}\tan\frac{\pi t}{2}\right],\\
\gamma_2(t) &= \gamma_4(t) = 2\tan^{-1}\left[\mu^{-1/2}\tan\frac{\pi t}{2}\right],\\
z_1(t) &= z_2(t) = z_3(t) = z_4(t) = -0.1t,\\
d(t) &= 0.4t,\\
d_1(t) &= d(t)\hat{u}(\gamma_1(t)/2),\\
d_3(t) &= d(t)\hat{u}(\gamma_3(t)/2).
\end{aligned} \tag{60}$$

Figure 16A:
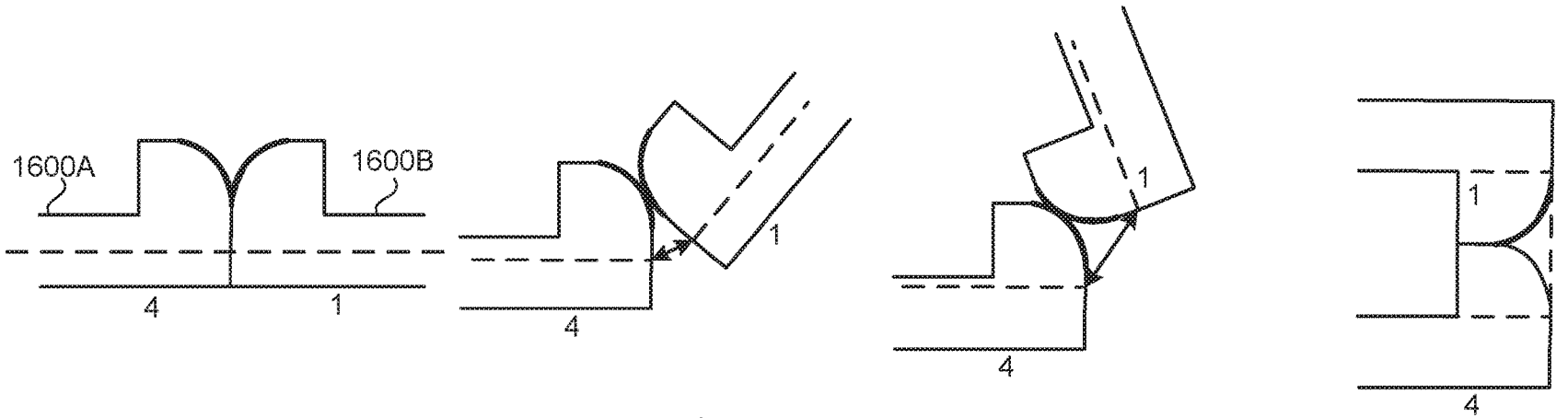
FIGS. 16A-D show an example of surface functions and panel positions for four joints at four different values of a fold parameter with linear offsets.
Figure 16B:
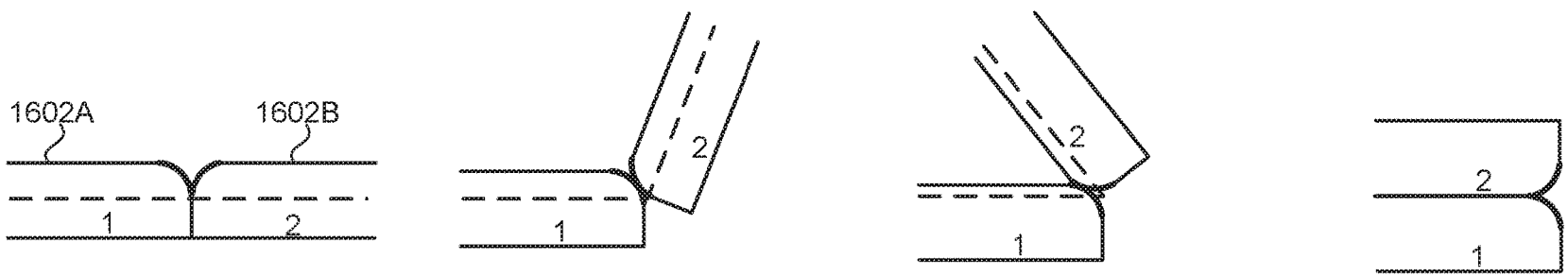
Figure 16C:
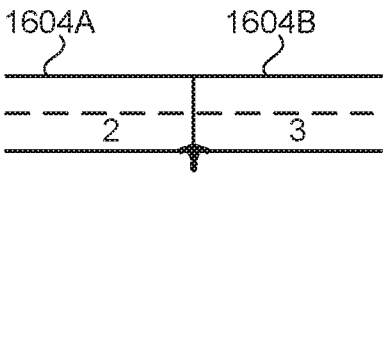
Figure 16C:
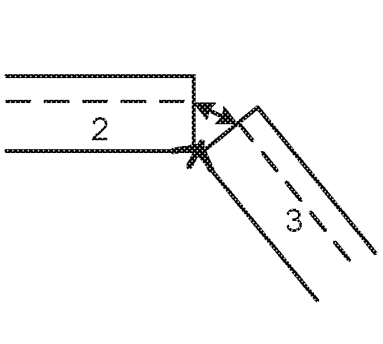
Figure 16C:
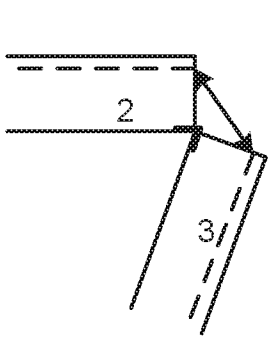
Figure 16C:
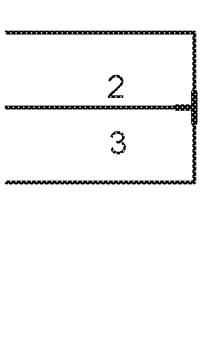
Figure 16D:
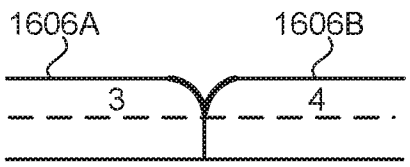
Figure 16D:
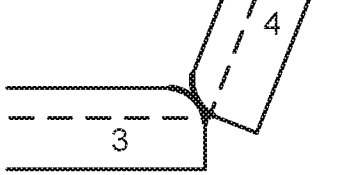
Figure 16D:
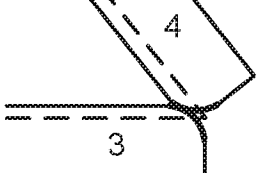
Figure 16D:
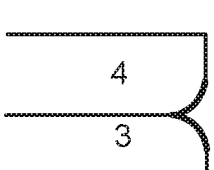

The elevation functions $z_i(t)$ and offset function d(t) should be 0 at t=0 (so that the panels are coplanar when unfolded) and their values at t=1 are chosen so that they stack neatly in the folded form. In between, one has complete freedom in choosing their functional form; for this example, one can choose to make them linear with t. FIGS. 16A-D show the surface functions and panel positions for four different values oft across the range of motion (from left to right in FIGS. 16A-D). FIGS. 16A-D show an example of surface functions and panel positions for the four joints (in FIGS. 16A, 16B, 16C and 16D, respectively) at four different values of the fold parameter t with linear offsets. Four rolling-contact hinges are shown: in FIG. 16A, panels 1600A and 1600B; in FIG. 16B, panels 1602A and 1602B; in FIG. 16C, panels 1604A and 1604B; and in FIG. 16D, panels 1606A and 1606B. Left to right: t=0 (unfolded), 0.333, 0.667, and t=1.0 (flat folded). FIG. 16A shows the joint corresponding to fold $\gamma_1$. FIG. 16B shows $\gamma_2$. FIG. 16C shows $\gamma_3$. FIG. 16D shows $\gamma_4$. The zero-thickness facets and fold axis are indicated by black dotted lines and dot, respectively.

This choice of parameters gives a set of surface function pairs that gives the desired motion—all of the layers stack neatly in the fully-folded state and are kinematic single-DOF in between, but there is a problem. The surfaces for fold $\gamma_3$ have cusps in them and they overlap each other (at least in planar projection), which would make fabrication problematic.

However, one can choose different elevation and/or offset functions to give better behaved surfaces. One has considerable freedom in the choice of the $\{z_i(t)\}$ and d(t); they need to hit certain values at their endpoints, but one can choose different functional forms to connect the endpoints, and different functions will give rise to different rolling-contact surfaces.

A little bit of experimenting with different functional forms gives a set of elevation and offset functions that give rise to smooth, convex, cusp-less surfaces:

$$\begin{aligned}
z_1(t)&=z_2(t)=z_3(t)=z_4(t)=-0.1t,\\
d(t)&=0.4t^2,
\end{aligned} \tag{61}$$

Figure 17A:
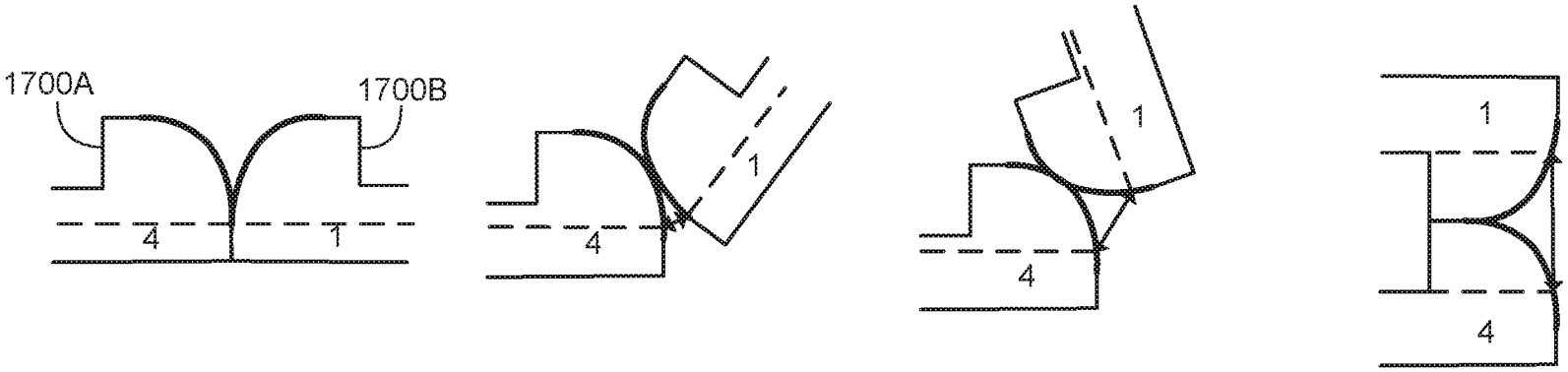
FIGS. 17A-D show an example of surface functions and panel positions for four joints at four different values of a fold parameter with a quadratic offset.
Figure 17B:
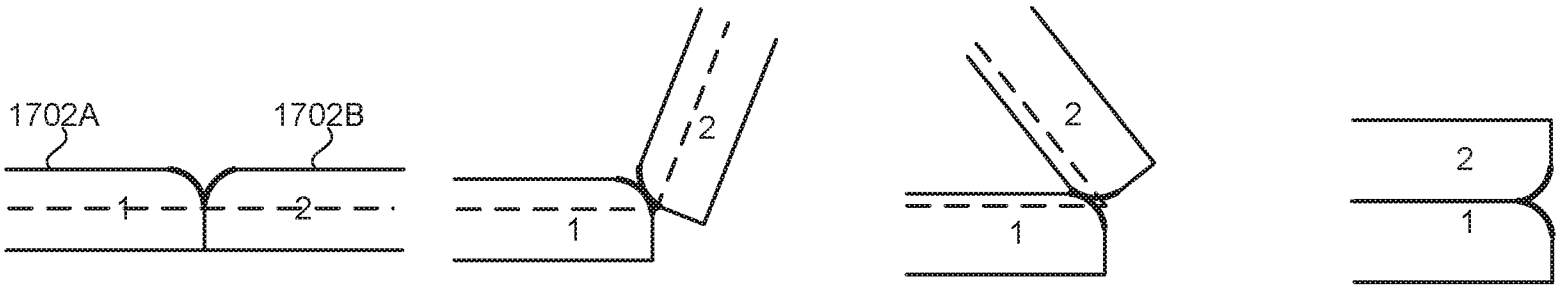
Figure 17C:
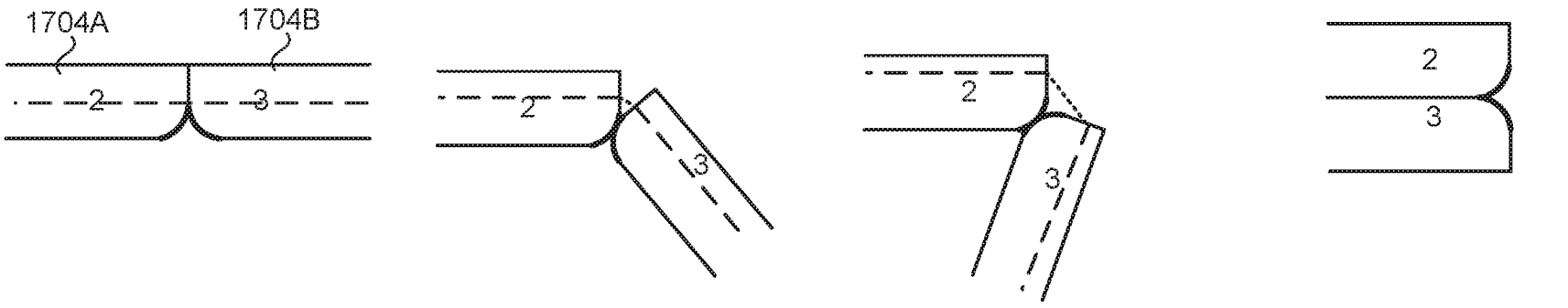
Figure 17D:
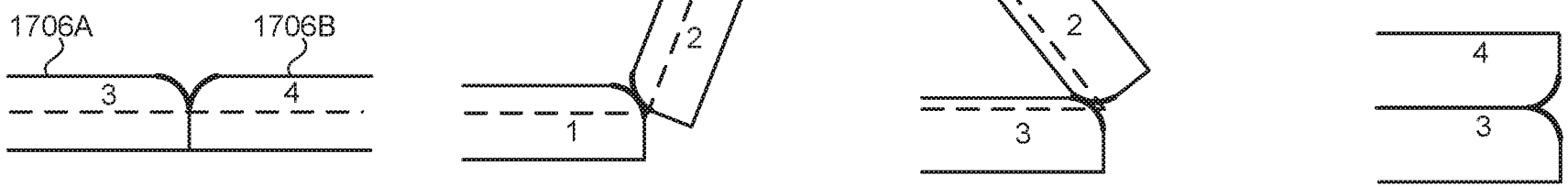

This gives the surface functions and motion illustrated in FIGS. 17A-D. Now all of the surfaces are smooth and convex toward one another. FIGS. 17A-D show an example of surface functions and panel positions for the four joints (in FIGS. 17A, 17B, 17C and 17D, respectively) at four different values of the fold parameter t (across each of FIGS. 17A-D) with a quadratic offset. Four rolling-contact hinges are shown: in FIG. 17A, panels 1700A and 1700B; in FIG. 17B, panels 1702A and 1702B; in FIG. 17C, panels 1704A and 1704B; and in FIG. 17D, panels 1706A and 1706B. Left to right: t=0 (unfolded), 0.333, 0.667, and t=1.0 (flat folded). FIG. 17A shows a joint corresponding to fold $\gamma_1$. FIG. 17B shows $\gamma_2$. FIG. 17C shows $\gamma_3$. FIG. 17D shows $\gamma_4$. The zero-thickness facets and fold axis are indicated by black dotted lines and dot, respectively.

But one can do even better than this. Instead of just picking various elevation and offset functions and seeing what the results are, one can actually choose specific rolling-contact configurations and then solve for the elevation and/or offset functions that give rise to them, as the present disclosure will now show.

The following relates to solving for offsets. Arguably, the most desirable configuration for a rolling-contact joint would be one with two matching circular surfaces, because the constant curvature results in constant stresses in a circular-CORE implementation and can be in static equilibrium at any position. Since, in the bird's-foot vertex, fold angles $\gamma_2$ and $\gamma_4$ are equal from symmetry, it would be desirable to make both of these joints have circular cross sections.

The elevation functions for circular cross sections are known: they are given by Equation (2). To make $\gamma_2$ a circular-CORE joint, one should have $$z_1(t) = z_2(t) = -r\tan\frac{\gamma_2(t)}{4}, \tag{62}$$

and similarly $$z_3(t) = z_4(t) = -r\tan\frac{\gamma_4(t)}{4} = -r\tan\frac{\gamma_2(t)}{4}, \tag{63}$$

where r is half the thickness of the panel and the radius of the circular cross section.

Next, one might like to make $\gamma_3$ a circular-CORE joint as well. The problem is that one can no longer choose its surrounding elevation functions $z_2(t)$ and $z_3(t)$, since those are already fixed; instead, one can, at best, choose the panel offset function d(t) to give the relative motion of the two panels that induces circular-cross-section surfaces between them.

The relative motion between two panels can be completely described by the function q(t) already introduced. In the presence of both elevation functions and offset functions, it is given by $$q(t)=R(\gamma)\cdot(s_0,z_r)-(s_0,z_l)+d(t). \tag{64}$$

If one wants $\gamma_3$ to be a circular-CORE joint with no panel offset, one would have $$q_3(t) = R(\gamma_3)\cdot\left(0, -r\tan\frac{\gamma_3}{4}\right) - \left(0 - r\tan\frac{\gamma_3}{4}\right). \tag{65}$$

But instead, what one actually has (including the panel offset) is $$q_3(t) = R(\gamma_3)\cdot\left(0, -r\tan\frac{\gamma_2}{4}\right) - \left(0 - r\tan\frac{\gamma_2}{4}\right) + d(t). \tag{66}$$

Setting these equal to one another lets us solve for the panel offset function d(t) that gives the desired relative motion:

$$d(t) = (R(\gamma_3) - I)\cdot\left(0, -r\left(\tan\frac{\gamma_3}{4} - \tan\frac{\gamma_2}{4}\right)\right), \tag{67}$$

where I is the 2×2 identity matrix.

With some simplification, it can be shown that $$d(t) = d(t)\hat{u}\left(\frac{\gamma_3}{2}\right), \tag{68}$$

where $$d(t) = 2r\sin\frac{\gamma_3}{2}\left(\tan\frac{\gamma_3}{4} - \tan\frac{\gamma_2}{2}\right) \tag{69}$$

(keeping in mind that all of the $\gamma_i$s are themselves functions of t).

It would be beneficial if one could similarly force fold $\gamma_1$ to be a circular-CORE joint, but one has now run out of functions to play with; rather, for that joint, one gets what one gets.

Fortunately, that joint, too, has well-behaved surfaces. Using these values for the elevation and offset functions gives the surfaces and configurations shown in FIGS. 18A-D.

The following relates to a physical implementation: split bird's-foot vertex. A second vertex, a bird's-foot vertex, with sector angles (135°, 45°, 45°, 135°) was constructed with the computed surfaces shown in FIGS. 18A-D, i.e., incorporating offsets and a split in the vertex. Gaps were introduced along the zero-thickness crease lines to prevent interference between adjacent panels during folding. The progression of the motion of the vertex from a closed, folded state to an open, unfolded state is shown in FIGS. 19A-F. FIGS. 19A-F show an example of a bird's-foot vertex 1900 constructed with thick sandwich panels and rolling joints. In FIGS. 19A-F the vertex 1900 is shown in various states that are part of its range of motion. For example, a stacked configuration (FIG. 19A) and a planar configuration (FIG. 19F) are shown.

Like the first prototype, this exhibited a smooth folding and unfolding motion while using the rolling joints to create the panel offsets required in the folding. Furthermore, by making $\gamma_2$ and $\gamma_4$ to be circular-CORE joints, there is a symmetry that would allow an array of identical vertices to be configured to form a multi-vertex Miura-ori.

Figure 18A:
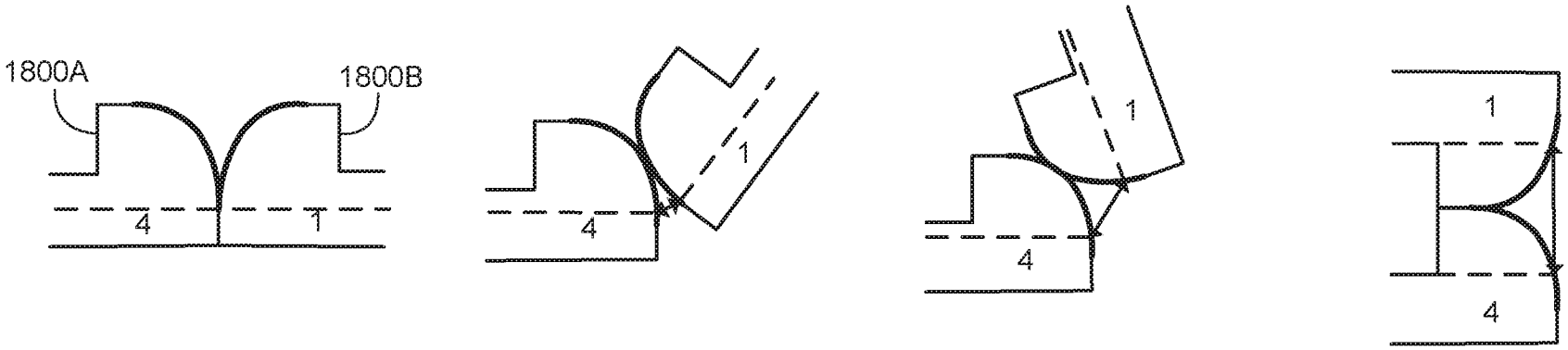
FIGS. 18A-D show an example of surface functions and panel positions for four joints at four different values of a fold parameter with three circular-CORE joints.
Figure 18B:
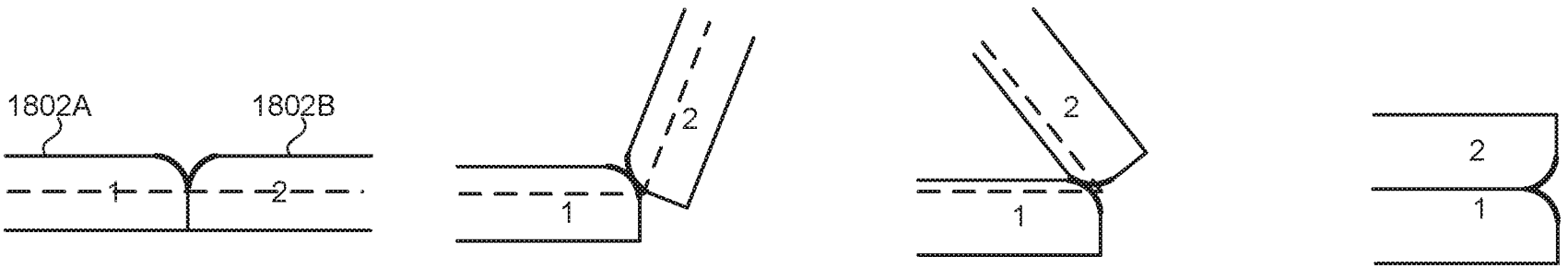
Figure 18C:
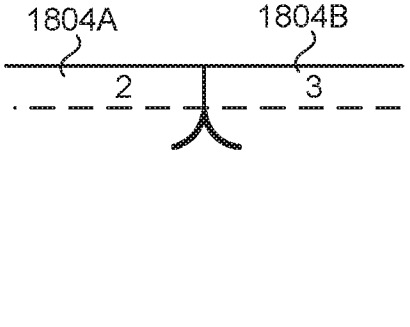
Figure 18C:
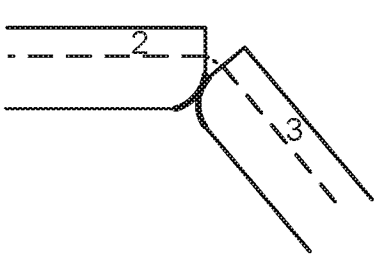
Figure 18C:
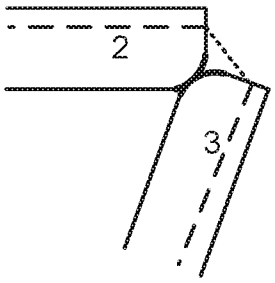
Figure 18C:
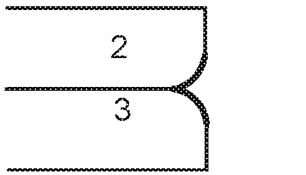
Figure 18D:
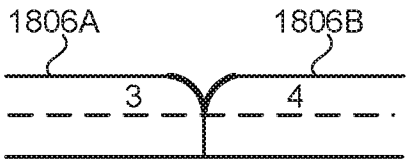
Figure 18D:
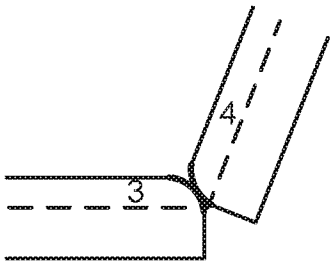
Figure 18D:
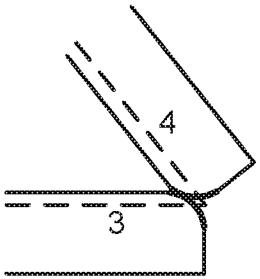
Figure 18D:
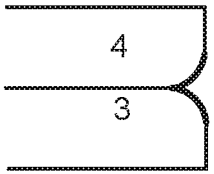
Figure 19B:
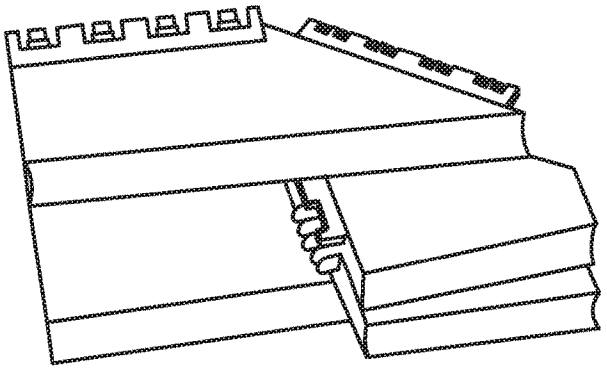
FIGS. 19A-F show an example of a bird's-foot vertex constructed with thick sandwich panels and rolling joints.
Figure 19D:
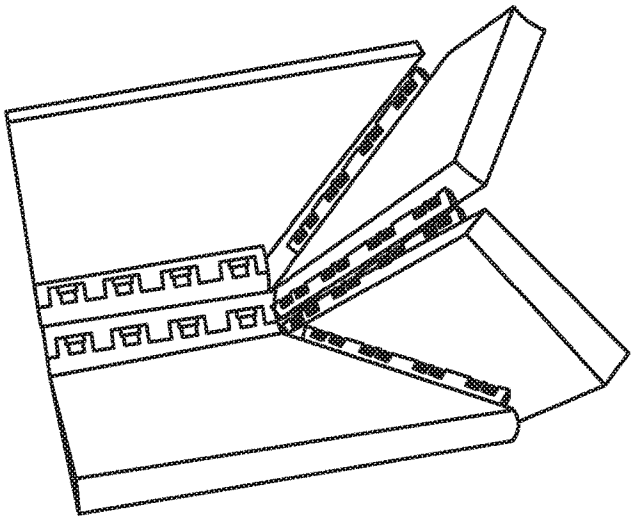
Figure 19A:
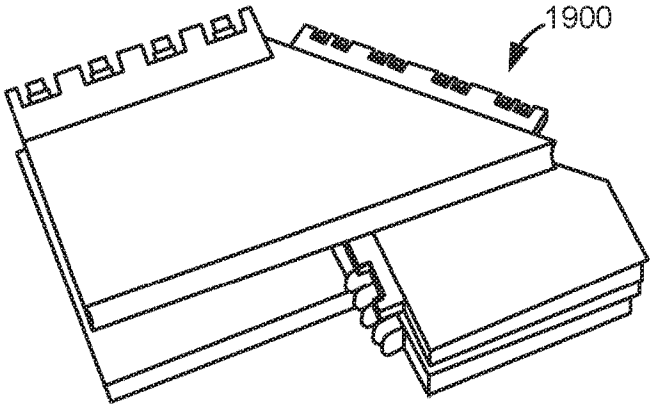
Figure 19C:
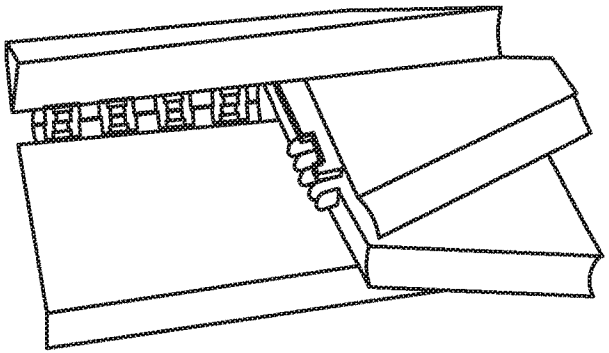
Figure 19E:
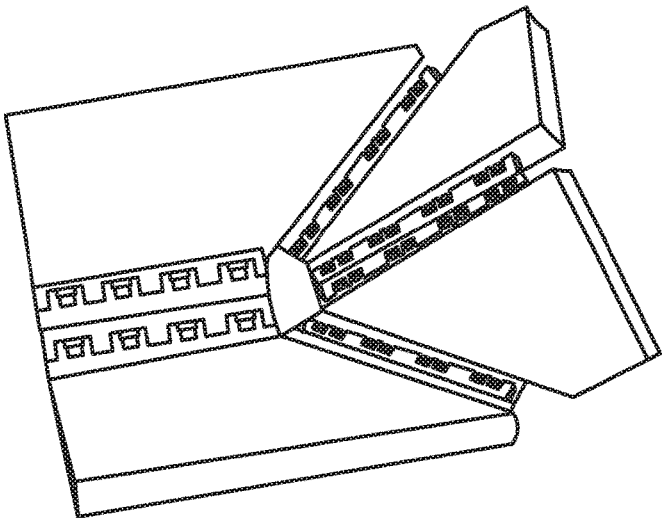
Figure 19F:
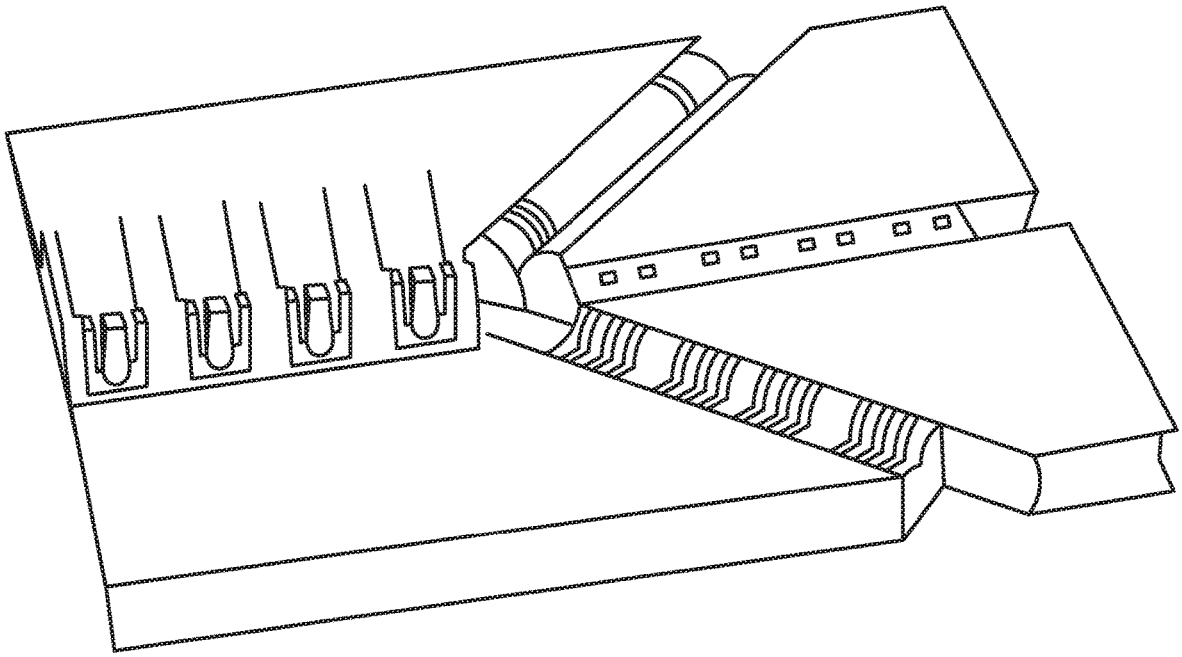

FIGS. 18A-D show an example of surface functions and panel positions for the four joints (in FIGS. 18A, 18B, 18C and 18D, respectively) at four different values of the fold parameter t (from left to right in each of FIGS. 18A-D) with three circular-CORE joints. Four rolling-contact hinges are shown: in FIG. 18A, panels 1800A and 1800B; in FIG. 18B, panels 1802A and 1802B; in FIG. 18C, panels 1804A and 1804B; and in FIG. 18D, panels 1806A and 1806B. Left to right: t=0 (unfolded), 0.333, 0.667, and t=1.0 (flat folded). FIG. 18A shows a joint corresponding to fold $\gamma_1$. FIG. 18B shows $\gamma_2$. FIG. 18C shows $\gamma_3$. FIG. 18D shows $\gamma_4$. The zero-thickness facets and fold axis are indicated by black dotted lines and dot, respectively.

The following relates to general 3D trajectories. The previous sections assumed that for each panel pair, their relative motion lay in a common plane throughout the full range of motion. That requirement is not strictly necessary. As the present disclosure will now show, one can consider entirely general rigid-body motions in 3D and, under certain conditions, can find rolling-contact surface pairs between each pair of panels.

Consider the entirely general situation, where now the "panels" don't even have to resemble origami facets. One can assume a general collection of objects $\{F_i\}$ that individually travel along time-dependent trajectories that are rigid-body motions in 3D. Let $p_i(t)$ be the trajectory of some point in panel $F_i$. Then the trajectory can be written as $$p_i(t)=(R_i(t)\cdot p_i(0))+r_i(t), \tag{70}$$

where now $R_i(t)$ is a time-varying 3×3 rotation matrix and $r_i(t)$ is a time-varying translation 3-vector.

Figure 20:
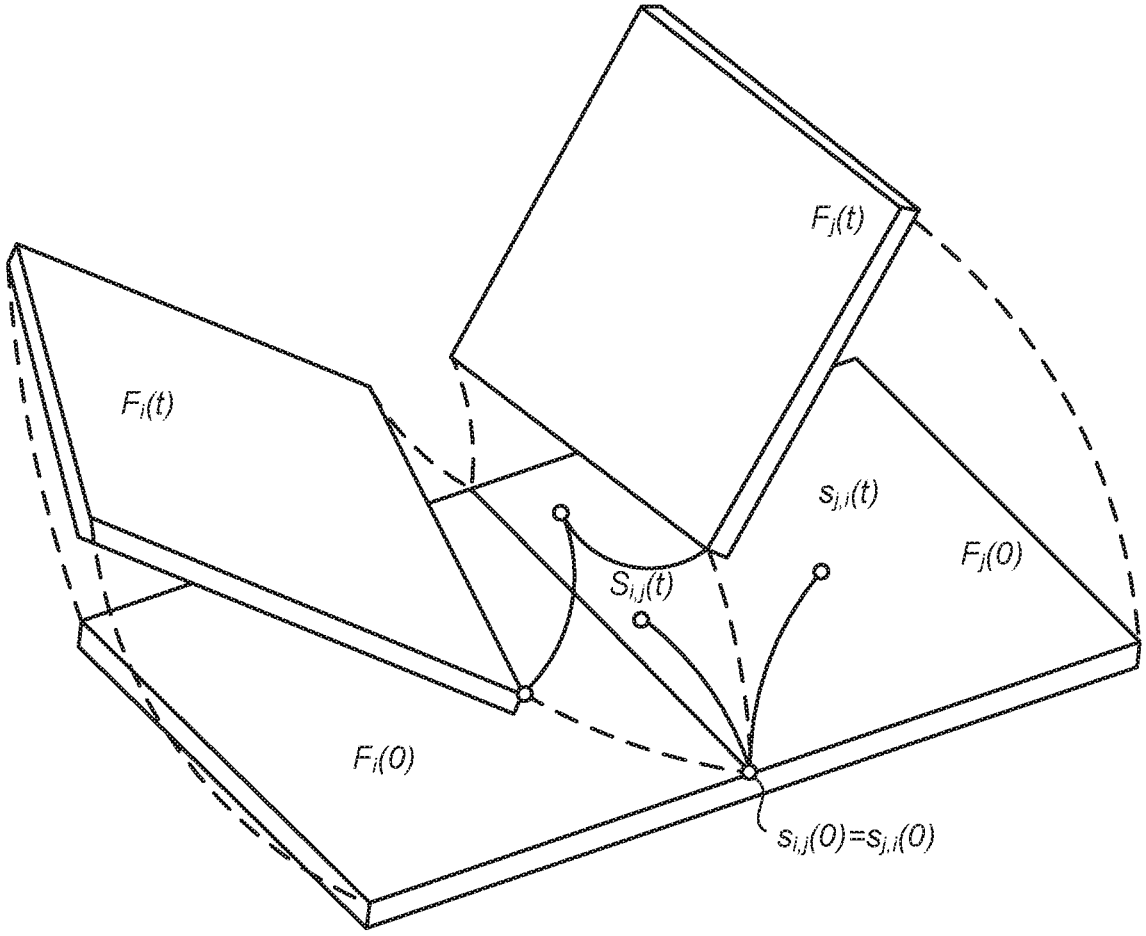
FIG. 20 shows an example of configuration of two interacting panels undergoing relative Euclidean motion.

Now consider two panels $F_i$ and $F_j$ that are in contact with each other at time t=0, as illustrated in FIG. 20. FIG. 20 shows an example of a configuration of two interacting panels $F_i$ and $F_j$ undergoing relative Euclidean motion.

Now, as before, one can solve for the surfaces of rolling contact, but one no longer assumes translational symmetry, and in fact, does not assume a priori that the contacting functions represent surfaces. Instead, imagine that one attaches a wire to each of $F_i$ and $F_j$ whose 3-space shape is described by the parametric curves $s_{i,j}(t)$ and $s_{j,i}(t)$ (which, however, one can continue to refer to as "surface functions"). As before, $s_{i,j}(t)$ represents the point at t=0 on the surface connected to panel $F_i$ that contacts the surface on panel $F_j$ at time t, and vice-versa. One can also assume that the surface functions form a rolling-contact pair: that is, they should satisfy a contact condition (which enforces that they touch) and a rolling condition (which enforces non-sliding contact and tangency of the surface functions).

The contact condition says that point $s_i(t)$ touches point $s_j(t)$ at time t:

$$R_i(t)\cdot s_{i,j}(t)+r_i(t)=R_j(t)\cdot s_{j,i}(t)+r_j(t). \tag{71}$$

The rolling condition, which equates the appropriately rotated velocity vectors of the surface functions, is $$R_i(t)\cdot s'_{i,j}(t)=R_j(t)\cdot s'_{j,i}(t), \tag{72}$$

where, as before, primes denote differentiation with respect to t.

One can rearrange this condition:

$$s'_{j,i}(t)=[R_j^{-1}(t)\cdot R_i(t)]\cdot s'_{i,j}(t), \tag{73}$$

because the matrix $R_i(t)$, being a rotation, is guaranteed to be nonsingular and matrix products are associative.

One can rearrange the contact equation:

$$\begin{aligned} S_{j,i}(t) &= R_j^{-1}(t)\cdot[R_i(t)\cdot s_{i,j}(t) + r_i(t) - r_j(t)] \\ &= [R_j^{-1}(t)\cdot R_i(t)]\cdot s_{i,j}(t) + R_j^{-1}(t)\cdot(r_i(t) - r_j(t)), \end{aligned} \tag{74}$$

and then differentiate this equation (again dropping the explicit t dependence for brevity):

$$s'_{j,i}=[R_j^{-1}\cdot R_i]'\cdot s_{i,j}+[R_j^{-1}\cdot R_i]\cdot s'_{i,j}+[R_j^{-1}\cdot(r_i-r_j)]'. \tag{75}$$

Subtracting off Equation 73 gives an implicit equation for the curve $s_{i,j}(t)$:

$$[R_j^{-1}\cdot R_i]'\cdot s_{i,j}=[R_j^{-1}\cdot(r_j-r_i)]'. \tag{76}$$

This is the 3D equivalent of Equation (47). So, all one needs to do to find $s_{i,j}(t)$ is to multiply both sides by the inverse of the matrix on the left side, just as was done above. But now there is a complication.

Define $$M_{i,j}(t)\equiv R_j^{-1}(t)\cdot R_i(t), \tag{77}$$

and $$m_{i,j}(t)\equiv R_j^{-1}(t)\cdot(r_j)(t)-r_i(t)), \tag{78}$$

so that the surface function $s_{i,j}$ satisfies $$M_{i,j}'\cdot s_{i,j}=m_{i,j}'. \tag{79}$$

Equation (79) chooses the function $s_{i,j}$ to balance the effect of a rotational velocity (on the left) against that of a translational velocity (on the right). Matrix $M_{i,j}$ has a physical interpretation; it is the rotation of facet $F_i$ in the local coordinate system of facet $F_j$, while $m_{i,j}$ is the translation of $F_i$ relative to $F_j$, rotated to the orientation of $F_j$.

The matrix $M_{i,j}(t)$, being the product of two (time-varying) rotation matrices is itself a time-varying rotation matrix. However, unlike in the 2D case, it is readily shown that its derivative M'(t), and indeed, the derivative of any time-varying rotation matrix, is always singular, and this has important ramifications for the existence and form of rolling-contact surfaces.

Since $M_{i,j}(t)$ is a time-varying rotation matrix, the change from time t to time t+Δt is also describable by an infinitesimal rotation matrix; that is, $$M_{i,j}(t+\Delta t)=\delta M_{i,j}(t,\Delta t)\cdot M_{i,j}(t), \tag{80}$$

where $\delta M_{i,j}(t,\Delta t)$ is also some rotation matrix for all t and Δt.

If one computes the derivative M'(t) using the standard limit formulation, one will have $$\begin{aligned} M_{i,j}'(t) &= \lim_{\Delta t\to 0}\frac{M_{i,j}(t+\Delta t)-M_{i,j}(t)}{\Delta t} \\ &= \lim_{\Delta t\to 0}\frac{\delta M_{i,j}(t,\Delta t)\cdot M_{i,j}(t)-M_{i,j}(t)}{\Delta t} \\ &= \lim_{\Delta t\to 0}\frac{\delta M_{i,j}(t,\Delta t)-I}{\Delta t}\cdot M_{i,j}(t), \end{aligned} \tag{81}$$

where I is the identity matrix. This tells us that the spectral properties of M'(t) will be related to the spectral properties of the matrix $\delta M_{i,j}(t,\Delta t)-I$.

Now, it is readily shown that if $\delta M_{i,j}(t,\Delta t)$ is a rotation matrix, then the matrix $\delta M_{i,j}(t,\Delta t)-I$ has the same eigenvectors as $\delta M_{i,j}(t,\Delta t)$, but $\delta M_{i,j}(t,\Delta t)-I$ has a zero eigenvalue with a corresponding null space vector that is the axis of rotation of $\delta M_{i,j}(t,\Delta t)$. The other two eigenvalues are complex conjugates of one another, so the number of zero eigenvalues is either one or three; either there is a single null space vector, or the derivative matrix is identically zero.

Because the right-multiplication by $M_{i,j}(t)$ in Equation (81) is a unitary transformation, the eigenvalues of the right-hand side of Equation (81) will be the same as those of $\delta M_{i,j}(t,\Delta t)-I$. Thus, as one takes the limit, one can say that M'(t) has either one or three zero eigenvalues, and so either has a single null-space vector or is identically zero (at the given time t, not necessarily all t).

For the moment, let us assume that the first case applies. Let $q_{i,j}(t)$ be a vector in the null space of $[R_j^{-1}R_i]'$. The null space vector $q_{i,j}$ has a physical interpretation; it is the instantaneous axis of rotation of the time-varying rotation matrix $M_{i,j}(t)$.

Equation (79) has a solution only if the right hand side contains no component of the null space vector, i.e., only if $$m_{i,j}\cdot q_{i,j}=0. \tag{82}$$

That, in turn, means that not all translations can be accommodated; if, at any time t, the velocity of the relative translation $m_{i,j}(t)$ has a component along the instantaneous axis of rotation, there is no rolling-contact surfaces that can achieve this relative translational motion. One can call Equation (82) the No Lateral Sliding Condition.

If the No Lateral Sliding Condition is satisfied, then the general solution of Equation (76) can be written $$s_{i,j}=[[R_j^{-1}\cdot R_i]]^{(-1)}\cdot([R_j^{-1}\cdot(r_j-r_i)]')+u_{i,j}q_{i,j}, \tag{83}$$

where $[\ldots]^{(-1)}$ denotes the matrix pseudoinverse and $u_{i,j}$ is an arbitrary scalar.

Ordinarily, one would find $q_{i,j}$ by performing a singular value decomposition of the matrix $M_{i,j}'$, i.e., finding the eigenvalues and eigenvectors, and then constructing the pseudoinverse from them all and making a note of the null space vector along the way.

There is a complication that arises when one is trying to construct solutions for a sequence of t-values $\{t_k\}$: while the pseudoinverse is unique for each t-value, the null space vectors are only defined to within a scalar multiple and it is quite possible in the numerics to find $q_{i,j}(t_k)$ pointing in opposite directions for successive values of $t_k$.

One can address this problem by using the pseudoinverse to construct the null-space projector; if q is any vector, then $$(I-[M'_{i,j}]^{(-1)}\cdot M'_{i,j})\cdot q \tag{84}$$

gives the component of q that lies in the null space of $M_i$, from which one can construct a normalized $q_{i,j}$. Constructing the values $q_{i,j}(t_k)$ in this way (from a common initial vector $q_{i,j}$ or for successive values of $t_k$ using $q_{i,j}(t_k-1)$ as the seed for computing $q_j(t_k)$) can guarantee that all of the computed $q_{i,j}(t_k)$ end up pointing in (approximately) the same direction.

Switching subscripts i, j gives the equivalent expression for $s_{j,i}$:

$$s_{j,i}=[[R_i^{-1}\cdot R_j]']^{(-1)}\cdot([R_i^{-1}\cdot(r_i-r_j)]')+u_{j,i}q_{j,i}, \tag{85}$$

where $q_{j,i}$ is the null-space vector of $[R_i^{-1}\cdot R_j]'$ and $u_{j,i}$ is an arbitrary scalar.

Now, the points of contact $s_{i,j}(t)$ and $s_{j,i}(t)$ are each parameterized on two variables: t, which describes the degree of foldedness, and $u_{i,j}$(or $u_{j,i}$), which are free parameters. That means that the solution for point pairs that satisfy the rolling-contact conditions is not just a pair of lines, as illustrated in FIG. 20, but is (still) a pair of surfaces. Furthermore, because those surfaces have the property that (for example) if $s_{i,j}(t)$ is a point on the surface, then $s_{i,j}(t)+u_{i,j}q_{i,j}(t)$ is also on the surface for any $u_{i,j}$, those surfaces are ruled surfaces, and the vectors $q_{i,j}(t)$ run along the ruling lines of the surfaces.

Note that according to Equations (83) and (85), $s_{i,j}(t)$ and $s_{j,i}(t)$ are parameterized on different variables ($u_{i,j}$ and $u_{j,i}$, respectively). Given one surface, though, say, $s_i(t, u)$, one can compute the other surface with the same parameterization from the contact condition, Equation (71).

One can define $$s_{i,j}^{(0)} \equiv [[R_j^{-1} \cdot R_i]']^{(-1)} \cdot ([R_j^{-1} \cdot (r_j - r_i)]'), \tag{86}$$

so that $$s_{i,j}(t,u) = s_{i,j}^{(0)} + uq_{i,j}. \tag{87}$$

One can then solve the contact equation for $s_{j,i}(t, u)$ by solving $$R_j \cdot s_{j,i} + r_j = R_i \cdot (s_{i,j}^{(0)} + uq_{i,j}) + r_i. \tag{88}$$

One finds that $$s_{j,i} = R_j^{-1} \cdot (R_i \cdot (s_{i,j}^{(0)} + uq_{i,j}) + (r_i - r_j)). \tag{89}$$

Using this expression for $s_{j,i}(t, u)$ gives the point on the opposite rolling-contact surface that comes into contact at time t and position u along the ruling line.

Note that Equation (89) can also be written $$s_{j,i} = R_j^{-1} \cdot (R_i \cdot s_{i,j}^{(0)} + (r_i - r_j)) + u(R_j^{-1} \cdot R_i \cdot q_{i,j}), \tag{90}$$

which defines a ruled surface with ruling line direction vectors $\{R_j^{-1} \cdot R_i \cdot q_{j,i}\}$.

This is the same form as Equation (83), which also defines a ruled surface with ruling line direction vectors $q_{j,i}$.

Since $q_{j,i}$ is a vector along the ruling line of surface $s_{j,i}$, varying u in Equation (89) gives points along that same ruling line. Recall that $q_{j,i}$ was only defined to within a scale factor. If one has already solved for $q_{j,i}$, one can avoid a second singular value decomposition to find $q_{j,i}$ and instead, simply take $$q_{j,i} = R_j^{-1} \cdot R_i \cdot q_{i,j} \tag{91}$$

to get a vector along the ruling line on the second surface.

Finally, let us go back to the possibility that the matrix $[R_j^{-1} \cdot R_i]'$ was identically zero for some $t_0$. That is essentially saying that there is no relative rotational motion between panels $F_i$ and $F_j$ at time $t_0$. If this is the case but the right side of Equation (76) is nonzero, it has no solution. Once again, one can say that if this is the case, the motion is ill-behaved at $t = t_0$.

Physically, the lack of solution makes sense. The concept of a rolling contact is that it couples rotary and translational motion. Equation (76) describes that coupling; the left side is rotary motion; the right side is translational. It is possible to have rotary motion without simultaneous translation; that is a conventional pin hinge. But it is not possible for a rolling contact to create pure translation without coupling it to some rotation. So not all motions are possible.

As in the 2D case, one can say that a motion is well-behaved if it is nowhere ill-behaved. One's main result, then, is the following:

Theorem 2 (3D Rolling-Contact Theorem) Given any collection of objects undergoing independent arbitrary time-varying rigid-body motion, between every pair of objects, if the motion is well-behaved and satisfies the No-Lateral-Sliding Condition, there exists a pair of ruled surfaces for each pair of objects that form a rolling contact between the objects.

Said surfaces are given by the formulas in this section.

The following is a discussion of results. Although the inventors have only implemented physical examples for single vertices, the concept extends to arbitrary crease networks. One simply chooses elevation functions $\{z_i(t)\}$ for each of the facets in the pattern (or, more generally, planar or 3D trajectory functions), then constructs the SORCE surfaces pairwise for each of the folds in the pattern. Thus, the SORCE concept can be applied to any zero-thickness folding pattern with arbitrary thickness panels.

It is illustrative to compare SORCE joints to the other methods mentioned in the introduction:

- Like Edmonson et al. and Ku et al., it allows the thick panels to be parallel-offset from one another in the flat-folded state, but unlike Edmonson, the panels are coplanar in the unfolded state.
- Unlike Trautz et al., Ku et al., and Zirbel et al., there are no additional degrees of freedom introduced into intermediate states: the kinematics of the mechanism match that of the underlying zero-thickness model, being single-degree-of-freedom if the underlying model exhibited same.
- Unlike Hoberman and Chen et al. (but like Tachi), the technique can be applied to any rigidly foldable zero-thickness origami mechanism; unlike Tachi, the technique avoids panel interferences even for fold angles up to and including ±180 and allows the panels to be stacked fully parallel in the flat folded state.

A comparison of the different approaches for thick rigidly-foldable mechanisms is given in Table 1. Table 1 shows an example of a comparison of thick rigidly foldable mechanism techniques and their capabilities. Rows (desirable attributes): PU=Planar unfolded state. PSFF=Parallel-stacked flat folded state. PK=Preserves 1-DOF kinematics. ACP=Applicable to arbitrary crease patterns. Columns (different techniques): OH=Offset Hinges. SH=Sliding Hinges. DH=Doubled Hinges. ES=Embedded Zero-Thickness Surface. OP=Offset Panels. MH=Membrane Hinges. RC=Synchronized rolling-contact elements.

| | OH | SH | DH | ES | OP | MH | RC |
|---|---|---|---|---|---|---|---|
| PU | X | X | X | X | | X | X |
| PSFF | X | | X | | X | X | X |
| PK | X | | | X | X | | X |
| ACP | | | X | X | X | | X |

When SORCE elements take the form of mutually convex surfaces, then they can be implemented as CORE joints, which offer the additional benefits that they can be quite robust against deformations and, in principle, compliant and monolithic. One can note, though, that based on preliminary investigations, it looks like biconvex surface solutions are less common than convex-concave surfaces (as was the case in the example of FIGS. 7A-D). Such surface pairs can still be implemented as rolling-contact joints, but call for more complex mechanisms, e.g., teeth and/or spring-loading, to ensure non-slippage between the two surfaces.

One can note, too, that while the offsets can be chosen so that the panels remain coplanar in the unfolded state, there is, in general, no prohibition against one or more of the mating surfaces extending above or below the top and bottom planes of the panels, possibly necessitating clearance holes in the adjacent panel (as the inventors saw in their physical examples). Such interferences can generally be made quite small, and because they typically only affect adjacent panels, are readily accommodated.

One can also note that the SORCE concept can potentially be combined with some of the other techniques: for example, it is possible to selectively double some hinges, a la Hoberman and Ku, but implement the joints as SORCE joints, thereby guaranteeing a 1DOF path from the unfolded to folded state. Similarly, it is possible to combine SORCE joints with ordinary revolute joints, simply by taking some of the elevation functions $\{z_i(t)\}$ to be identically zero (giving revolute joints) and others to be non-zero (giving SORCE joints).

The formulas in this description give explicit expressions for the construction of the two surfaces of a SORCE joint, but they require a synchronous parameterization of the fold angles at each vertex. For degree-4 vertices, an analytic parameterization exists (whether or not the vertex is flat-foldable). For vertices of higher degree, analytic formulas do not generally exist (although specific examples can be found). However, one could construct a suitable analytic model by constructing a spline to a series of numerical solutions across the range of folding, then use one's formulas to construct the desired surfaces.

While there are obvious reasons to aim for circular-CORE surfaces (as the present disclosure did in some of the examples), in general, the required surfaces are going to be non-circular. In the days of conventional machining, the fabrication of such surfaces would have been highly problematic. With the advent of additive manufacturing techniques ("3D printing"), the potential complexity of the required surfaces is far less of a burden.

Although the SORCE technique lends itself nicely to mechanisms that incorporate the flat-folded state as part of the desired operating range, there are rigidly foldable mechanisms, e.g., cut flashers, that do not stow as flat-foldable forms. Nevertheless, such mechanisms are also readily amenable to the SORCE technique. One can expect that many more technologically interesting thick rigidly foldable mechanisms can be realized using this powerful approach.

Figure 21A:
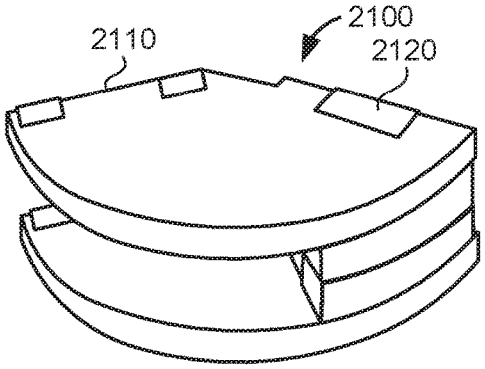
FIGS. 21A-C show an example of a symmetric bird's-foot vertex.
Figure 21B:
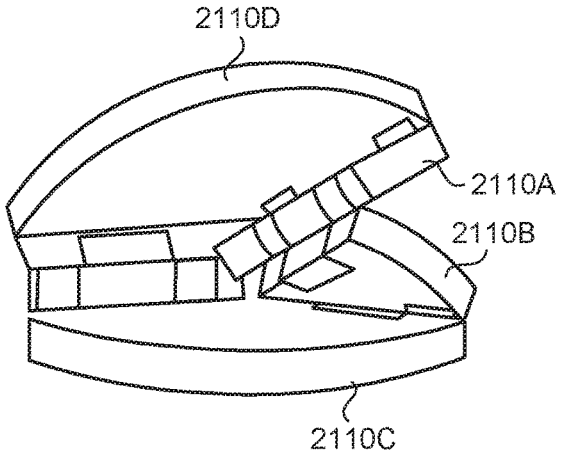
Figure 21C:
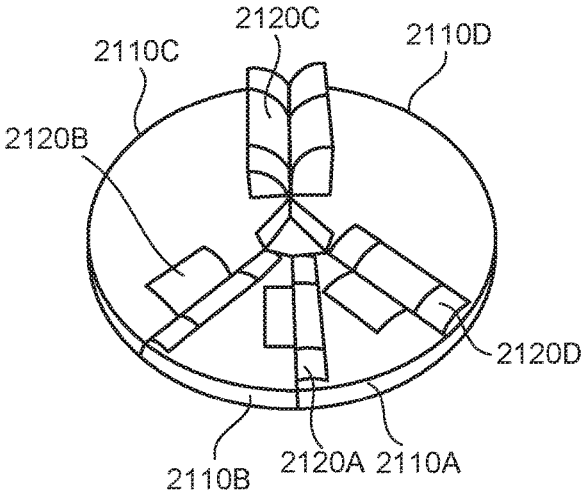

FIGS. 21A-CF show an example of a symmetric bird's-foot vertex 2100. FIG. 21A shows the vertex 2100 in a position of its range of motion where panels 2110 are stacked parallel to each other. As such, this can be considered a stowed state of the vertex 2100. FIG. 21B shows the vertex 2100 in another position of its range of motion. Here, some of the panels 2110 have been moved compared to their previous position using one or more of hinges 2120 in the vertex 2100. Particularly, the vertex 2100 includes respective panels 2110A, 2110B, 2110C and 2110D. Panel 2110A is hinged to panels 2110D and 2110B. Panel 2110B is hinged to panels 2110A and 2110C. Panel 2110C is hinged to panels 2110B and 2110D. Panel 2110D is hinged to panels 2110C and 2110A. FIG. 21B shows an additional position of the vertex 2100 in its range of motion. FIG. 21C shows the vertex 2100 in a substantially planar state, for example a deployed state. A hinge 2120A connects panels 2110A and 2110B to each other. A hinge 2120B connects panels 2110B and 2110C to each other. A hinge 2120C connects panels 2110C and 2110D to each other. A hinge 2120D connects panels 2110D and 2110A to each other. At least one of the hinges 2120 can be a rolling-contact hinge. Here, all of the hinges 2120 are rolling-contact hinges. The vertex 2100 is symmetric. As such, the bird's-foot vertex 2100 is a symmetric vertex. For example, the panels 2110A and 2110B have the same sector angle. As another example, the panels 2110C and 2110D have the same sector angle.

Figure 22:
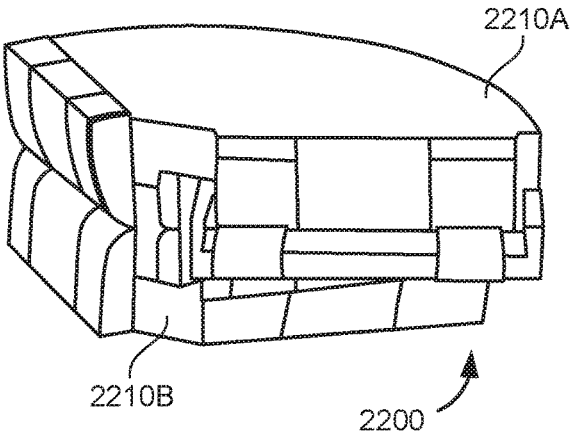
FIG. 22 shows another example of a vertex.

FIG. 22 shows another example of a vertex 2200. The vertex 220 is shown in a position within its range of motion where panels (e.g., panels 2210A and 2210B) are essentially parallel to each other and stacked on top of each other.

Figure 23A:
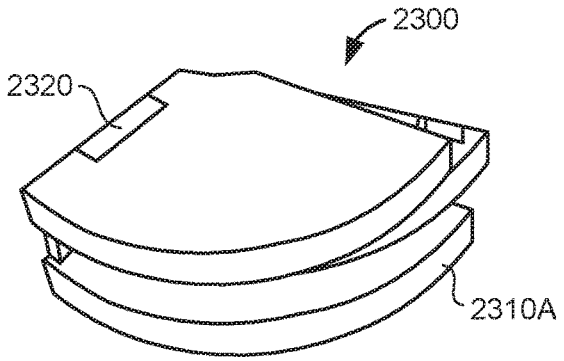
FIGS. 23A-F show an example of an asymmetric bird's-foot vertex.
Figure 23B:
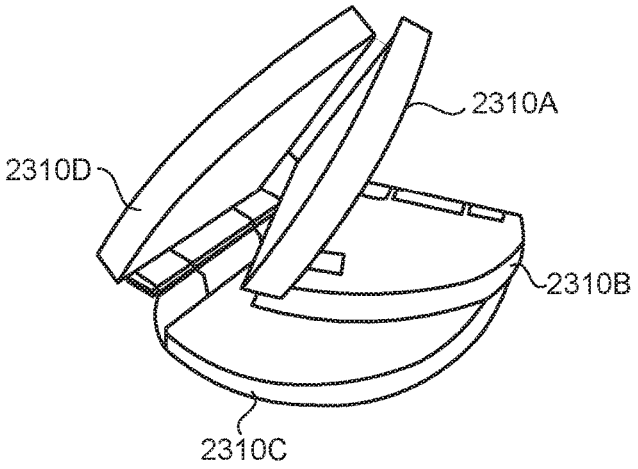
Figure 23C:
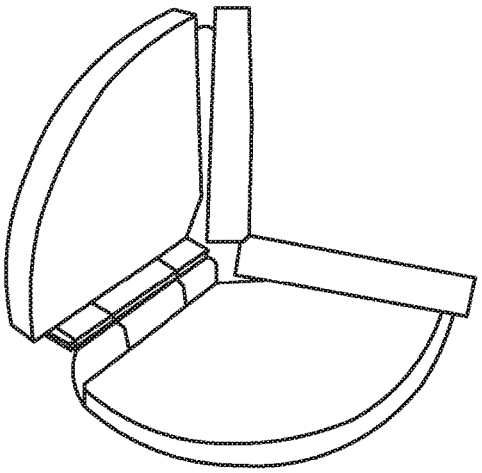
Figure 23D:
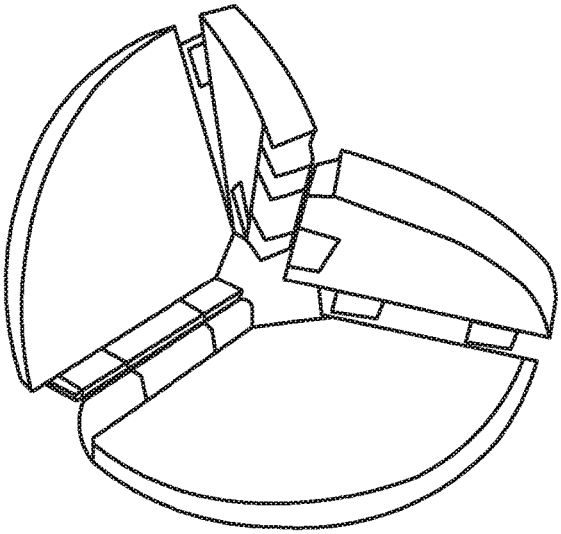
Figure 23E:
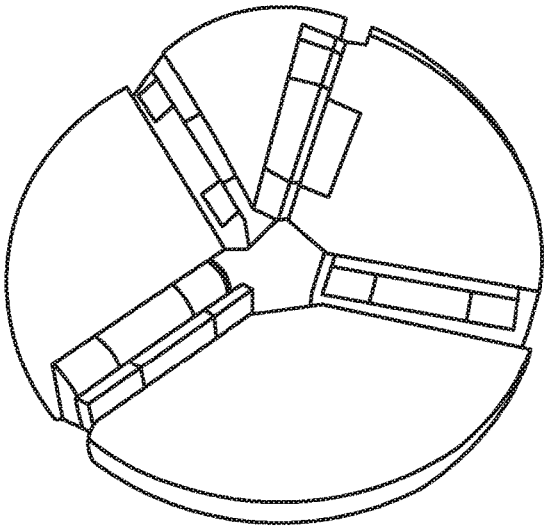
Figure 23F:
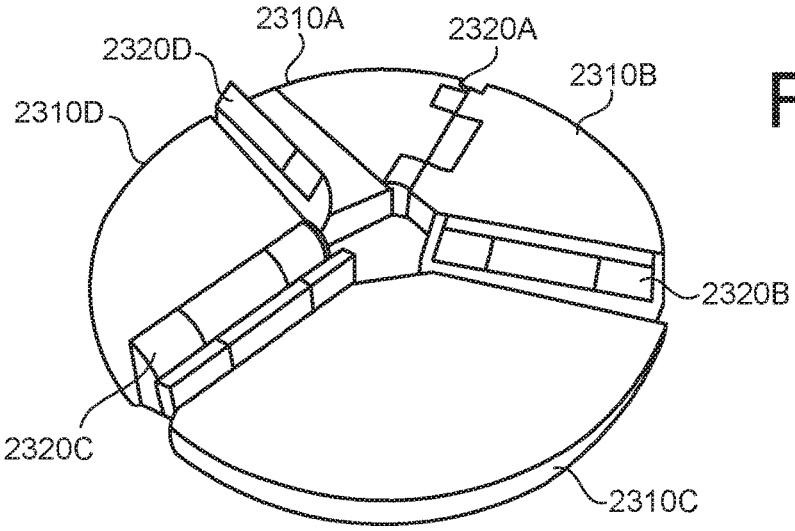

FIGS. 23A-F show an example of an asymmetric bird's-foot vertex 2300. FIG. 23A shows the vertex 2300 in a position of its range of motion where panels 2310 are stacked parallel to each other. As such, this can be considered a stowed state of the vertex 2300. FIG. 23B shows the vertex 2300 is another position of its range of motion. Here, some of the panels 2310 have been moved compared to their previous position using one or more of hinges 2320 in the vertex 2300. Particularly, the vertex 2300 includes respective panels 2310A, 2310B, 2310C and 2310D. Panel 2310A is hinged to panels 2310D and 2310B. Panel 2310B is hinged to panels 2310A and 2310C. Panel 2310C is hinged to panels 2310B and 2310D. Panel 2310D is hinged to panels 2310C and 2310A. FIGS. 23C-E show additional positions of the vertex 2300 in its range of motion. FIG. 23F shows the vertex 2300 in a substantially planar state, for example a deployed state. A hinge 2320A connects panels 2310A and 2310B to each other. A hinge 2320B connects panels 2310B and 2310C to each other. A hinge 2320C connects panels 2310C and 2310D to each other. A hinge 2320D connects panels 2310D and 2310A to each other. At least one of the hinges 2320 can be a rolling-contact hinge. Here, all of the hinges 2320 are rolling-contact hinges. The vertex 2300 is asymmetric. An asymmetric vertex can have a bird's foot shape or another shape. As such, the bird's-foot vertex 2300 is an asymmetric vertex. For example, the panels 2310A and 2310B have different sector angles. As another example, the panels 2310C and 2310D have different sector angles.

Figure 24:
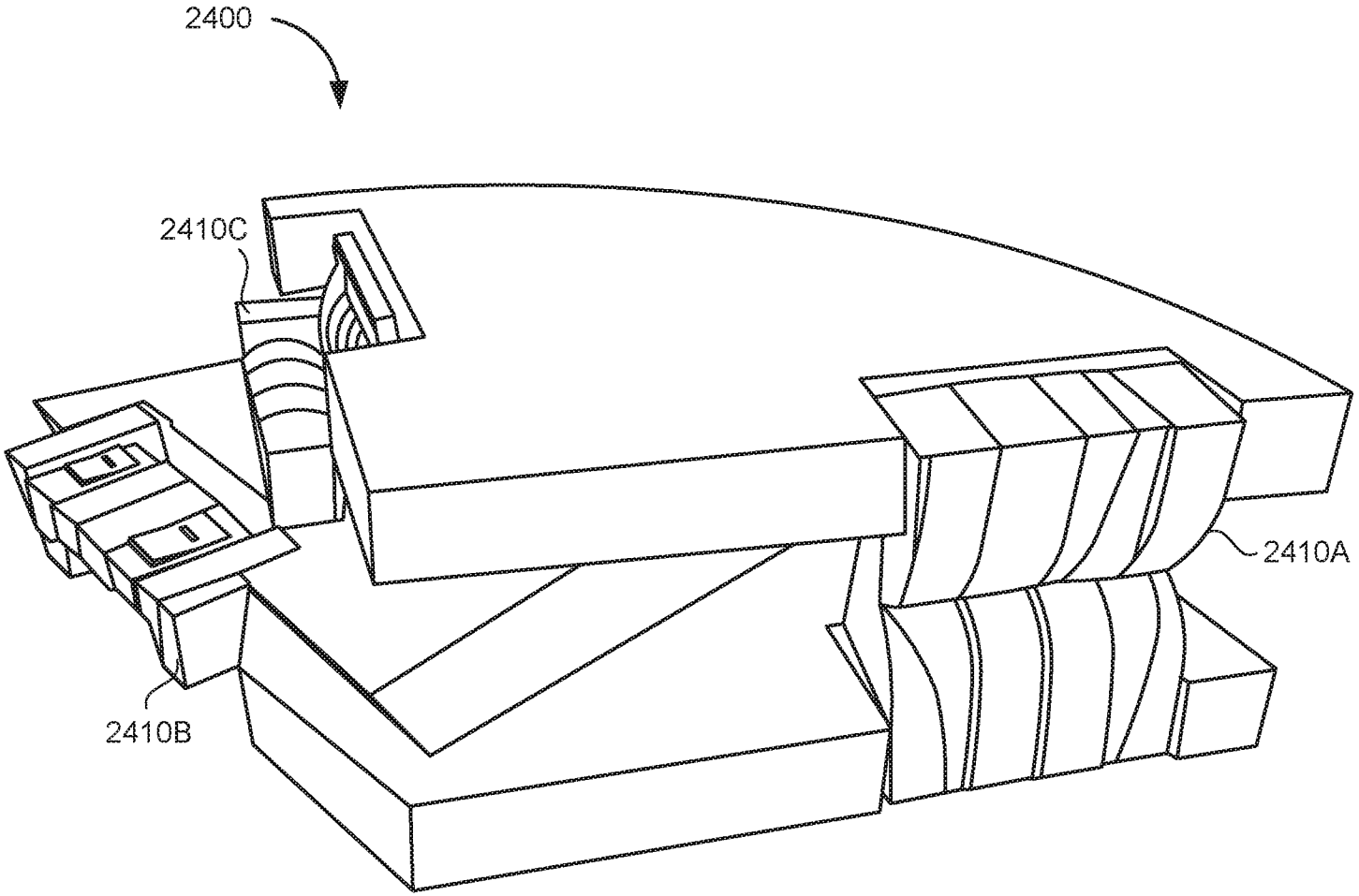
FIG. 24 shows an example of a vertex with rolling-contact hinges.

FIG. 24 shows an example of a vertex 2400 with rolling-contact hinges. In this view, hinges 2410A, 2410B and 2410C are visible. The vertex 2400 can have one or more rolling-contact hinges. In this example, each of the hinges 2410A-C is a rolling-contact hinge. The vertex 2400 is shown in a position that is part of its range of motion. Currently, the panels of the vertex 2400 are stacked essentially parallel to each other. For example, this can be a stowed state. One or more of the panels can be offset laterally from at least one of the panels when the panels are in the stacked position.

Figure 25:
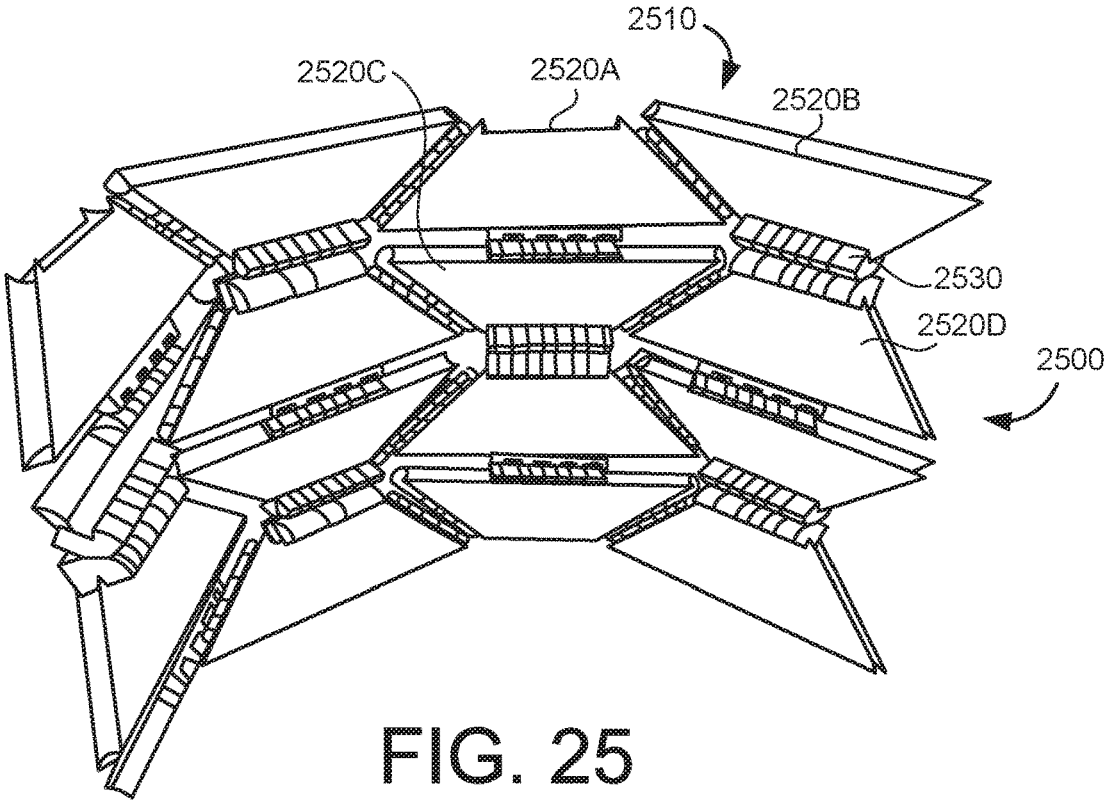
FIG. 25 shows an example of a structure made from a closed-loop hinged mechanism.

FIG. 25 shows an example of a structure 2500 made from a closed-loop hinged mechanism 2510. The closed-loop hinged mechanism 2510 can be made from panels 2520. For example, panels 2520A, 2520B, 2520C and 2520D can be joined into a closed-loop formation by one or more types of hinges 2530. For example, one or more (or all) of the hinges 2530 can be a rolling-contact hinge. Several of the closed-loop hinged mechanism 2510 can be joined to form the structure 2500. In some implementations, one of the closed-loop hinged mechanisms 2510 can be joined by another one of the closed-loop hinged mechanisms 2510 on a first side, and can be joined by yet another one of the closed-loop hinged mechanisms 2510 on a second side, and so on. The sides where the joinder occurs can be on opposite ends of the mechanism 2510, or on sides that are adjacent to each other, to name just two examples. For example, this can form a repeating structure that can be expanded in any or all directions using as many of the mechanism 2510 as desired.

Figure 26:
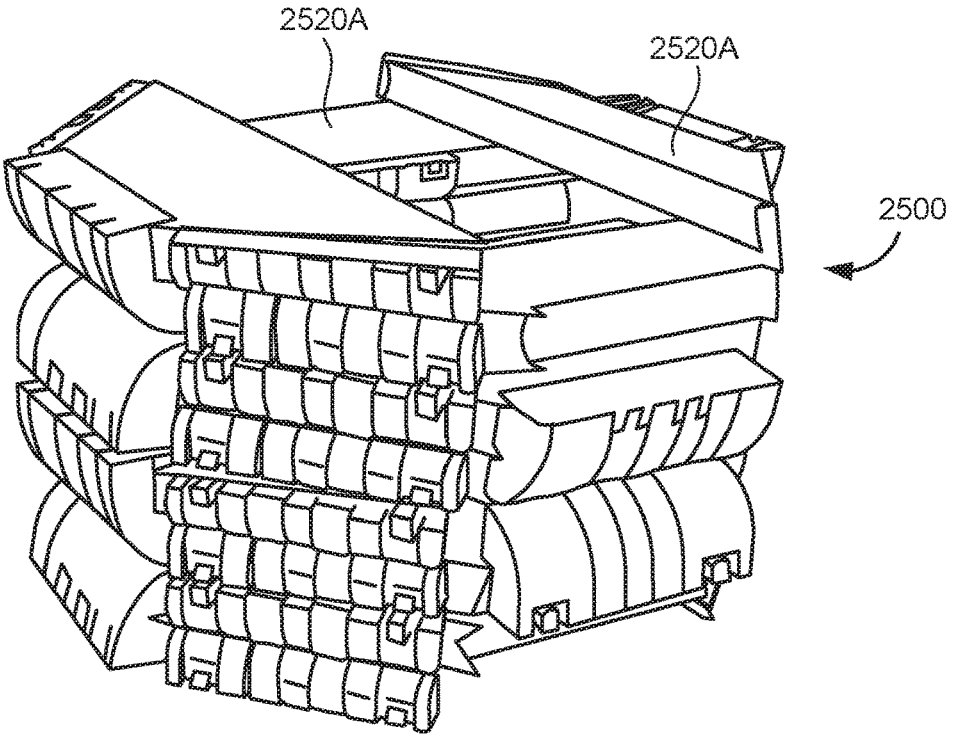
FIG. 26 shows an example of the structure in FIG. 25 in a stowed state.

FIG. 26 shows an example of the structure 2500 in FIG. 25 in a stowed state. For example, this can involve the panels 2520 being stacked essentially parallel to each other. Only some of the panels 2520 are visible in this view. For example, the panel 2520B is currently on top of the structure 2500, and partially covering the panel 2520A. When viewed from the top, the structure 2500 in this state (e.g., stowed) can form an open passageway through its center, the passageway formed by respective edges of some of the panels 2520.

Figure 27A:
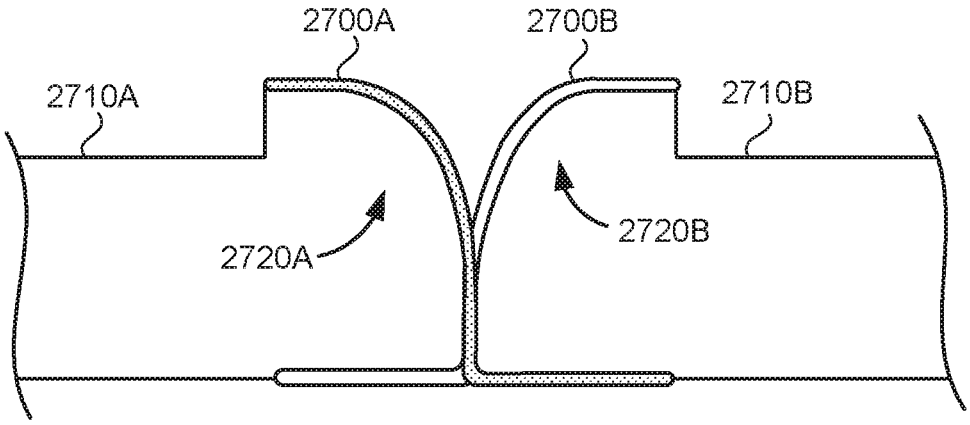
FIGS. 27A-D show examples of rolling-contact hinges.

FIGS. 27A-D show examples of rolling-contact hinges. FIG. 27A shows an example using bands 2700A and 2700B. Here, a panel 2710A and a panel 2710B are partially shown. The panel 2710A forms a rolling surface 2720A, and the panel 2710B forms a rolling surface 2720B. The band 2700A is in contact with at least part of each of the rolling surfaces 2720A-B. Similarly, the band 2700B is in contact with at least part of each of the rolling surfaces 2720A-B. The crosswise relationship formed by the bands 2700A and 2700B and the rolling surfaces 2720A-B forms a rolling-contact hinge. As such, a rolling-contact hinge can include bands that hold rolling surfaces of the hinge together.

Figure 27B:
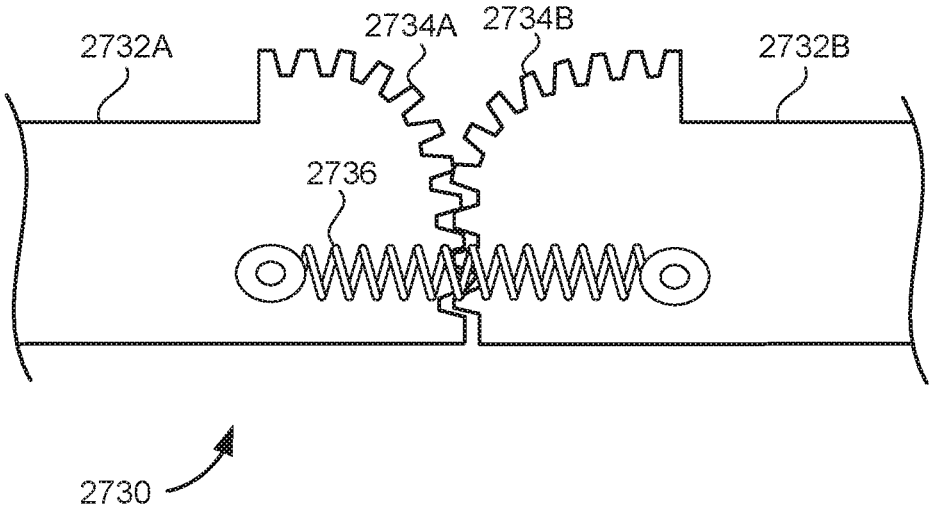

FIG. 27B shows a hinge 2730. Here, a panel 2732A and a panel 2732B are partially shown. The panel 2732A has gears, for example in form of teeth 2734A. Similarly, the panel 2732B has gears, for example in form of teeth 2734B. The gears can form part of respective rolling surfaces of the respective panels. The gears can be configured to mesh with each other to form the rolling-contact hinge. The gears can serve to hold the rolling surfaces together. The teeth of the gears can be of any shape, for example the shapes shown. The teeth can be periodic. In some implementations, an irregular pattern of teeth on one rolling surface can engage with a matching pattern on the other rolling surface.

One or more springs can be used. Here, a spring 2736 extends from a point inside the panel 2732A (e.g., located beyond the rolling surface of that panel) to a point inside the panel 2732B (e.g., located beyond the rolling surface of that panel). The spring 2736 can serve to hold the rolling surfaces together. Any type of spring can be used, including, but not limited to, a coil spring, or a leaf spring. A spring can be used with rolling surfaces that are smooth, or that are structured, to name just two examples.

Figure 27C:
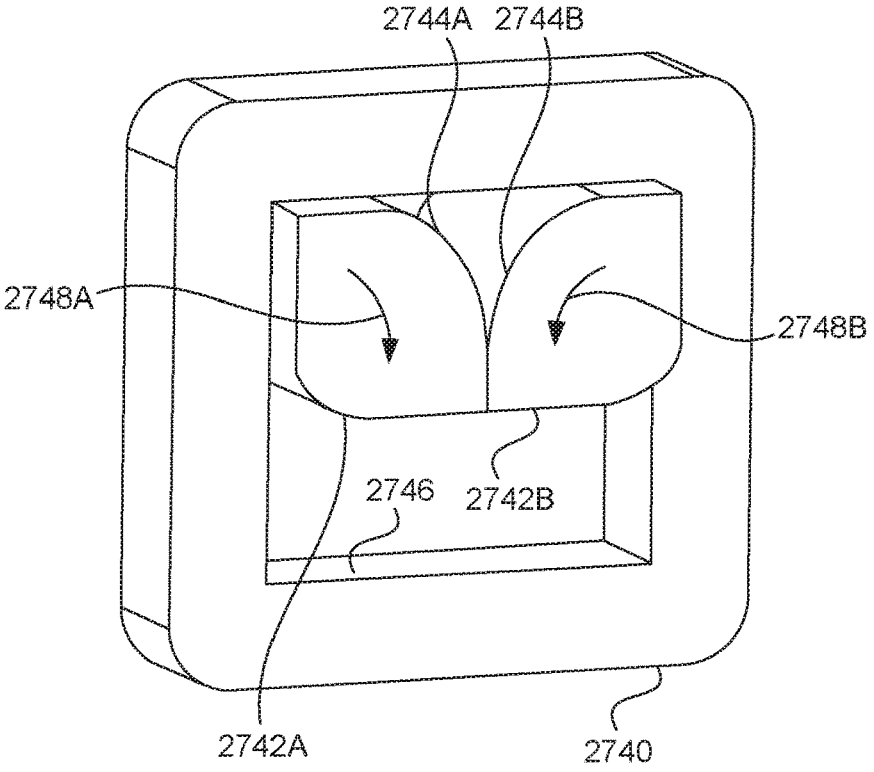

FIG. 27C shows an example including a frame 2740. Inside the frame 2740 are a panel 2742A and a panel 2742B. The panel 2742A has a rolling surface 2744A. The panel 2742B has a rolling surface 2744B. The frame 2740 can force the rolling surfaces 2744A-B together, for example by way of an opening 2746. This can facilitate pivoting of the panel 2742A and the panel 2742B with regard to each other, for example as indicated by an arrow 2748A (for the panel 2742A) and/or an arrow 2748B (for the panel 2742B). The rolling surfaces 2744A-B can be smooth or with gear teeth, to name just two examples.

Figure 27D:
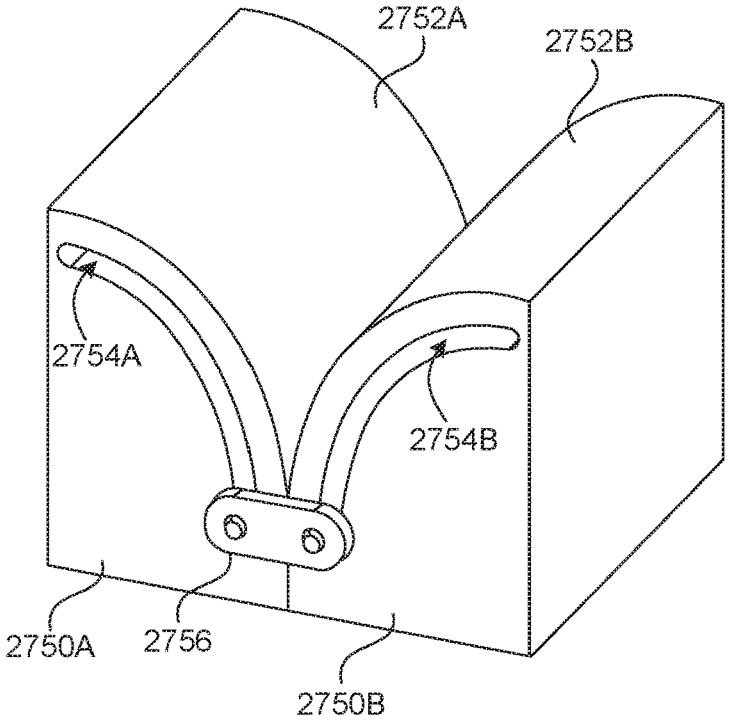

FIG. 27D shows an example involving panels 2750A and 2750B. The panel 2750A has a rolling surface 2752A, and the panel 2750B has a rolling surface 2752B. The panel 2750A has a slot 2754A, and the panel 2750B has a slot 2754B. A mechanism 2756 engages each of the slots 2750A-B in a slidable fashion, so that the mechanism 2756 can in principle be positioned at any location along the length of each of the slots 2754A-B. By the mechanism 2756 thus slidingly engaging the respective slots 2754A-B in the various positions of the panels 2752A-B, the rolling surfaces 2752A-B are held against each other throughout the motion.

A number of embodiments have been described. Nevertheless, it will be understood that various modifications may be made without departing from the spirit and scope of the specification.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

While certain features of the described implementations have been illustrated as described herein, many modifications, substitutions, changes and equivalents will now occur to those skilled in the art. It is, therefore, to be understood that appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A hinged mechanism comprising:

at least four panels, wherein each panel has main surfaces and edge surfaces; and at least four hinges connecting respective pairs of the at least four panels to each other in a closed loop so that the hinged mechanism is non-planar at least in a first position where the respective main surfaces of three or more of the at least four panels are at least partially overlapping each other, wherein at least one of the at least four hinges is a rolling-contact hinge.

2. The hinged mechanism of claim 1, wherein all of the at least four hinges are rolling-contact hinges.

3. The hinged mechanism of claim 1, wherein each of the at least four hinges is a sole connection between a respective adjacent pair of the at least four panels.

4. The hinged mechanism of claim 1, wherein a cross section of rolling surfaces of the rolling-contact hinge is circular.

5. The hinged mechanism of claim 1, wherein a cross section of rolling surfaces of the rolling-contact hinge is non-circular.

6. The hinged mechanism of claim 1, wherein the at least four hinges provide a range of motion for the hinged mechanism, and wherein at a second position within the range of motion the at least four panels are disposed substantially within a single plane without overlapping.

7. The hinged mechanism of claim 6, wherein the second position corresponds to a deployed state.

8. The hinged mechanism of claim 1, wherein the at least four hinges provide a range of motion for the hinged mechanism, and wherein at the first position within the range of motion the at least four panels are stacked parallel to each other.

9. The hinged mechanism of claim 8, wherein the first position corresponds to a stowed state.

10. The hinged mechanism of claim 1, wherein another of the at least four hinges has an axis of rotation associated with a corresponding pair of panels associated with the other hinge, and wherein a position of the axis of rotation is fixed relative to each of the pair of panels throughout a range of motion of the other hinge.

11. The hinged mechanism of claim 1, wherein the rolling-contact hinge has an axis of rotation associated with the pair of panels associated with the rolling-contact hinge, and wherein a position of the axis of rotation comprises a fixed position plus a motion-varying offset of each of the pair of panels in a direction that is perpendicular to the axis of rotation.

12. A hinged mechanism comprising:

panels; and hinges connecting respective pairs of the panels to each other in a closed loop so that the hinged mechanism is non-planar, wherein at least one of the hinges is a rolling-contact hinge, the hinged mechanism forming an asymmetric vertex.

13. The hinged mechanism of claim 12, wherein the asymmetric vertex is an asymmetric bird's-foot vertex.

14. The hinged mechanism of claim 12, wherein the hinged mechanism has a position in a range of motion where the at least four panels are stacked parallel to each other.

15. The hinged mechanism of claim 12, wherein the hinged mechanism has a position in a range of motion where the hinged mechanism is in a substantially planar state.

16. The hinged mechanism of claim 15, wherein the substantially planar state corresponds to a deployed state.

17. The hinged mechanism of claim 12, wherein all the at least four hinges of the hinged mechanism are rolling-contact hinges.

18. The hinged mechanism of claim 12, wherein at least two of the at least four panels have different sector angles.

19. The hinged mechanism of claim 18, wherein the hinged mechanism has first, second, third and fourth panels, the first panel connected only to the fourth and second panels, the second panel connected only to the first and third panels, the third panel connected only to the second and fourth panels, and the fourth panel connected only to the third and first panels, wherein sector angles of the first and second panels are each smaller than respective sector angles of the third and fourth panels, and wherein the sector angles of the first and second panels are different from each other.

20. The hinged mechanism of claim 18, wherein the hinged mechanism has first, second, third and fourth panels, the first panel connected only to the second and fourth panels, the second panel connected only to the first and third panels, the third panel connected only to the second and fourth panels, and the fourth panel connected only to the third and first panels, wherein sector angles of the first and second panels are each smaller than respective sector angles of the third and fourth panels, and wherein the sector angles of the third and fourth panels are different from each other.

21. A hinged mechanism comprising:

panels; and hinges connecting respective pairs of the panels to each other in a closed loop so that the hinged mechanism is non-planar in at least a first position and is substantially planar in at least a second position, wherein at least one of the hinges is a rolling-contact hinge, wherein the rolling-contact hinge has rolling surfaces, and wherein the rolling-contact hinge is configured so that the rolling surfaces remain in contact with each other without substantial slippage throughout a range of motion of the hinged mechanism.

22. A hinged mechanism comprising:

at least four hinges; and at least four panels, wherein respective pairs of the at least four panels are connected to each other in a closed loop by respective ones of the at least four hinges, wherein each panel forms a respective sector angle of the closed loop, and wherein at least two of the at least four panels have different sector angles.

* * * * *